US011622913B2

(12) United States Patent
Zollinger et al.

(10) Patent No.: US 11,622,913 B2
(45) Date of Patent: Apr. 11, 2023

(54) VIAL PUCK SYSTEM FOR AUTOMATIC DRUG COMPOUNDER

(71) Applicant: CareFusion 303, Inc., San Diego, CA (US)

(72) Inventors: Christopher J. Zollinger, Chino Hills, CA (US); Neil Quitoviera, Murrieta, CA (US); Dereck S. Ferdaws, San Diego, CA (US)

(73) Assignee: CAREFUSION 303, INC., San Diego, CA (US)

( * ) Notice: Subject to any disclaimer, the term of this patent is extended or adjusted under 35 U.S.C. 154(b) by 0 days.

(21) Appl. No.: 17/550,831

(22) Filed: Dec. 14, 2021

(65) Prior Publication Data

US 2022/0105004 A1 Apr. 7, 2022

Related U.S. Application Data

(62) Division of application No. 17/062,226, filed on Oct. 2, 2020, now Pat. No. 11,246,803, which is a division (Continued)

(51) Int. Cl.

*A61J 3/00* (2006.01)
*A61J 1/14* (2023.01)

(Continued)

(52) U.S. Cl.

CPC ..... *A61J 3/002* (2013.01); *A61J 1/14* (2013.01); *A61J 1/1406* (2013.01); *A61J 1/2096* (2013.01); *B01F 33/846* (2022.01)

(58) Field of Classification Search

CPC .. A61J 3/002; A61J 1/14; A61J 1/1406; A61J 1/2096; B01F 33/846

(Continued)

(56) References Cited

U.S. PATENT DOCUMENTS 4,233,973 A 11/1980 Shukla
4,614,515 A * 9/1986 Tripp ..... A61J 1/00 604/416

(Continued)

FOREIGN PATENT DOCUMENTS

CN 103998086 A 8/2014
CN 204636988 U 9/2015

(Continued)

OTHER PUBLICATIONS

Japanese Office Action for Application No. 2021-117815, dated Apr. 1, 2022, 11 pages including translation.

(Continued)

*Primary Examiner* — Jessica Cahill
*Assistant Examiner* — Christopher M Afful
(74) *Attorney, Agent, or Firm* — Morgan, Lewis & Bockius LLP

(57) ABSTRACT

A compounder system having a vial puck configured for attachment to a vial containing a drug is provided. The vial puck includes features for facilitating uniform control of vials of various sizes in an automatic compounder system. The vial puck features may include a vial recess for receiving a vial of a particular size and securing the vial within the vial recess. The features may also include a cylindrical central portion, perpendicular extensions that extend from a top of the cylindrical central portion, a gear extending from the cylindrical central portion, and a sealing member disposed in the cylindrical central portion. The vial puck may include a cylindrical protrusion configured to press against a septum of the vial to form a seal between the vial puck and the vial. The sealing member may be configured to receive a needle of the compounder system therethrough to allow access to the vial.

19 Claims, 43 Drawing Sheets

Related U.S. Application Data of application No. 15/780,614, filed as application No. PCT/US2016/062919 on Nov. 18, 2016, now Pat. No. 10,806,673.

(60) Provisional application No. 62/263,565, filed on Dec. 4, 2015.

(51) Int. Cl.
*A61J 1/20* (2006.01)
*B01F 33/84* (2022.01)

(58) Field of Classification Search
USPC ..... 141/105
See application file for complete search history.

(56) References Cited

U.S. PATENT DOCUMENTS

| | | | |
|---|---|---|---|
| 2005/0224137 | A1 | 10/2005 | Tribble et al. |
| 2012/0241042 | A1 | 9/2012 | Strangis |
| 2013/0255831 | A1 | 10/2013 | Shibasaki |
| 2015/0257974 | A1 | 9/2015 | Demers et al. |

FOREIGN PATENT DOCUMENTS

| | | | |
|---|---|---|---|
| EP | 0155560 | A2 | 9/1985 |
| JP | S60501294 | A | 8/1985 |
| JP | S60210261 | A | 10/1985 |
| JP | 2010246713 | A | 11/2010 |
| JP | 2013244371 | | 12/2013 |
| JP | 2015167645 | A | 9/2015 |
| JP | 2015528777 | A | 10/2015 |
| KR | 1020130116871 | A | 10/2013 |
| WO | WO-2012109032 | A1 | 8/2012 |
| WO | WO-2015002011 | | 2/2017 |

OTHER PUBLICATIONS

Chinese Office Action for Application No. 201680079189.5, dated Feb. 1, 2021,6 pages including translation.
Chinese Office Action for Application No. 201680079189.5, dated Jun. 1, 2020, 27 pages.
International Search Report and Written Opinion for Application No. PCT/US2016/062919, dated Feb. 24, 2017, 13 pages.
Israel Office Action for Application No. 259554, dated Mar. 11, 2021, 5 pages including machine translation.
Japanese Office Action for Application No. 2018-529058, dated Dec. 25, 2020, 9 pages including translation.

* cited by examiner

VIAL PUCK SYSTEM FOR AUTOMATIC DRUG COMPOUNDER

CROSS-REFERENCE TO RELATED APPLICATIONS

This application is a divisional application of U.S. patent application Ser. No. 17/062,226, entitled "VIAL PUCK SYSTEM FOR AUTOMATIC DRUG COMPOUNDER," filed on Oct. 2, 2020, which issued on Feb. 15, 2022, as U.S. Pat. No. 11,246,803, which is a divisional application of U.S. patent application Ser. No. 15/780,614, entitled "VIAL PUCK SYSTEM FOR AUTOMATIC DRUG COMPOUNDER," filed on May 31, 2018, which issued on Oct. 20, 2020, as U.S. Pat. No. 10,806,673, which is the National Stage Entry under 35 U.S.C. 371 of International Patent Application PCT/US2016/062919, entitled "VIAL PUCK SYSTEM FOR AUTOMATIC DRUG COMPOUNDER," filed on Nov. 18, 2016, which claims the benefit of U.S. Provisional Application No. 62/263,565, entitled "VIAL PUCK SYSTEM FOR AUTOMATIC DRUG COMPOUNDER," filed on Dec. 4, 2015, the entirety of each of which is incorporated herein by reference.

TECHNICAL FIELD

The present disclosure relates to a vial puck system for connecting to a vial for use in an automatic drug compounder.

BACKGROUND

Pharmaceutical compounding is the practice of creating a specific pharmaceutical product to fit the unique need of a patient. In practice, compounding is typically performed by a pharmacist, tech or a nurse who combines the appropriate ingredients using various tools. One common form of compounding comprises the combination of a powdered drug formulation with a specific diluent to create a suspended pharmaceutical composition. These types of compositions are commonly used in intravenous/parenteral medications. It is vital that the pharmaceuticals and diluents are maintained in a sterile state during the compounding process, and there exists a need for automating the process while maintaining the proper mixing characteristics (i.e., certain pharmaceuticals must be agitated in specific ways so that the pharmaceutical is properly mixed into solution but the solution is not frothed and air bubbles are not created). There exists a need for a compounding system that is easy to use, may be used frequently and efficiently, is reliable and reduces user error.

SUMMARY

A vial puck configured for attachment to a vial containing a drug is provided. The vial puck includes various features for facilitating uniform control of vials of various sizes in an automatic compounder system.

In accordance with one or more embodiments, a compounder system is provided that includes vial calipers coupled to a vial lift; a cartridge comprising a needle assembly and at least one controllable fluid pathway fluidly coupled to the needle assembly; a vial tray having at least one vial puck recess; and a vial puck, the vial puck including a lower portion configured to receive and secure a vial containing a drug; and an upper portion, the upper portion having a first portion configured to seat in the at least one vial puck recess; a second portion configured to be grasped by the vial calipers; and a sealing member configured to receive the needle assembly therethrough, where the vial lift is configured to move the vial that is grasped by the vial calipers toward the cartridge such that the needle assembly is provided through the sealing member to fluidly couple the at least one controllable fluid pathway to the vial via the needle assembly.

In accordance with one or more embodiments, a method of operating the compounder system is provided, the method including coupling the vial puck the vial containing the drug; placing the vial puck in a first vial puck recess; rotating the vial tray to move the vial and vial puck to a first position; grasping the vial puck with the vial calipers; lifting the vial puck and vial out of the vial tray with the vial lift; and lifting the vial puck and vial to compress a needle housing of the compounder system to expose the needle assembly and to extend the needle assembly through the sealing member of the vial puck and the needle housing into the vial.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION

The detailed description set forth below describes various configurations of the subject technology and is not intended to represent the only configurations in which the subject technology may be practiced. The detailed description includes specific details for the purpose of providing a thorough understanding of the subject technology. Accordingly, dimensions may be provided in regard to certain aspects as non-limiting examples. However, it will be apparent to those skilled in the art that the subject technology may be practiced without these specific details. In some instances, well-known structures and components are shown in block diagram form in order to avoid obscuring the concepts of the subject technology.

It is to be understood that the present disclosure includes examples of the subject technology and does not limit the scope of the appended claims. Various aspects of the subject technology will now be disclosed according to particular but non-limiting examples. Various embodiments described in the present disclosure may be carried out in different ways and variations, and in accordance with a desired application or implementation.

The present system comprises multiple features and technologies that in conjunction form a compounding system that can efficiently reconstitute pharmaceuticals in a sterile environment and deliver the compounded pharmaceutical to a delivery bag for use on a patient.

Figure 1:
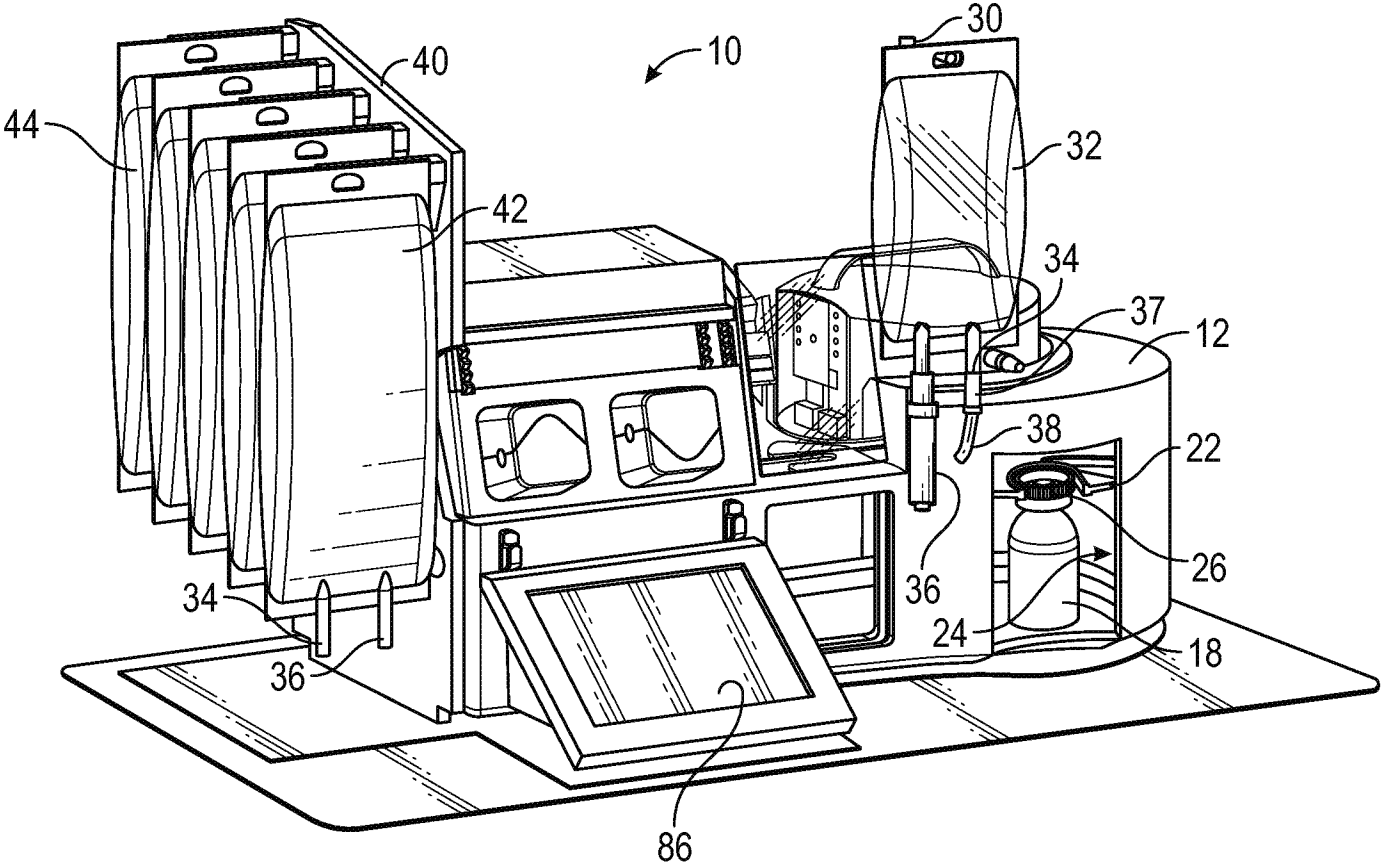
FIG. 1 illustrates a front perspective view of an example of an exemplary embodiment of a compounding system in accordance with aspects of the present disclosure.
Figure 2:
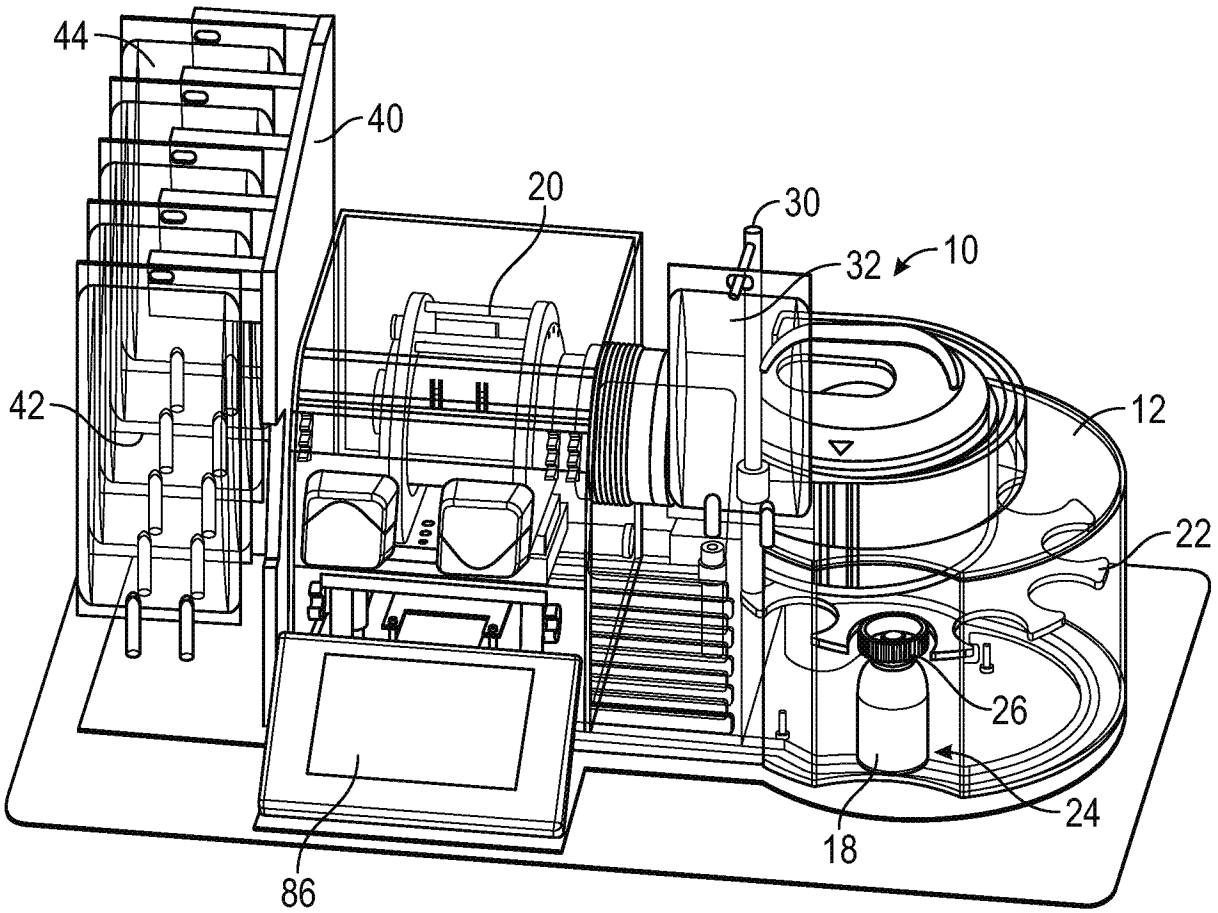
FIG. 2 illustrates a front perspective view of the compounding system of FIG. 1 with a transparent housing in accordance with aspects of the present disclosure.
Figure 3:
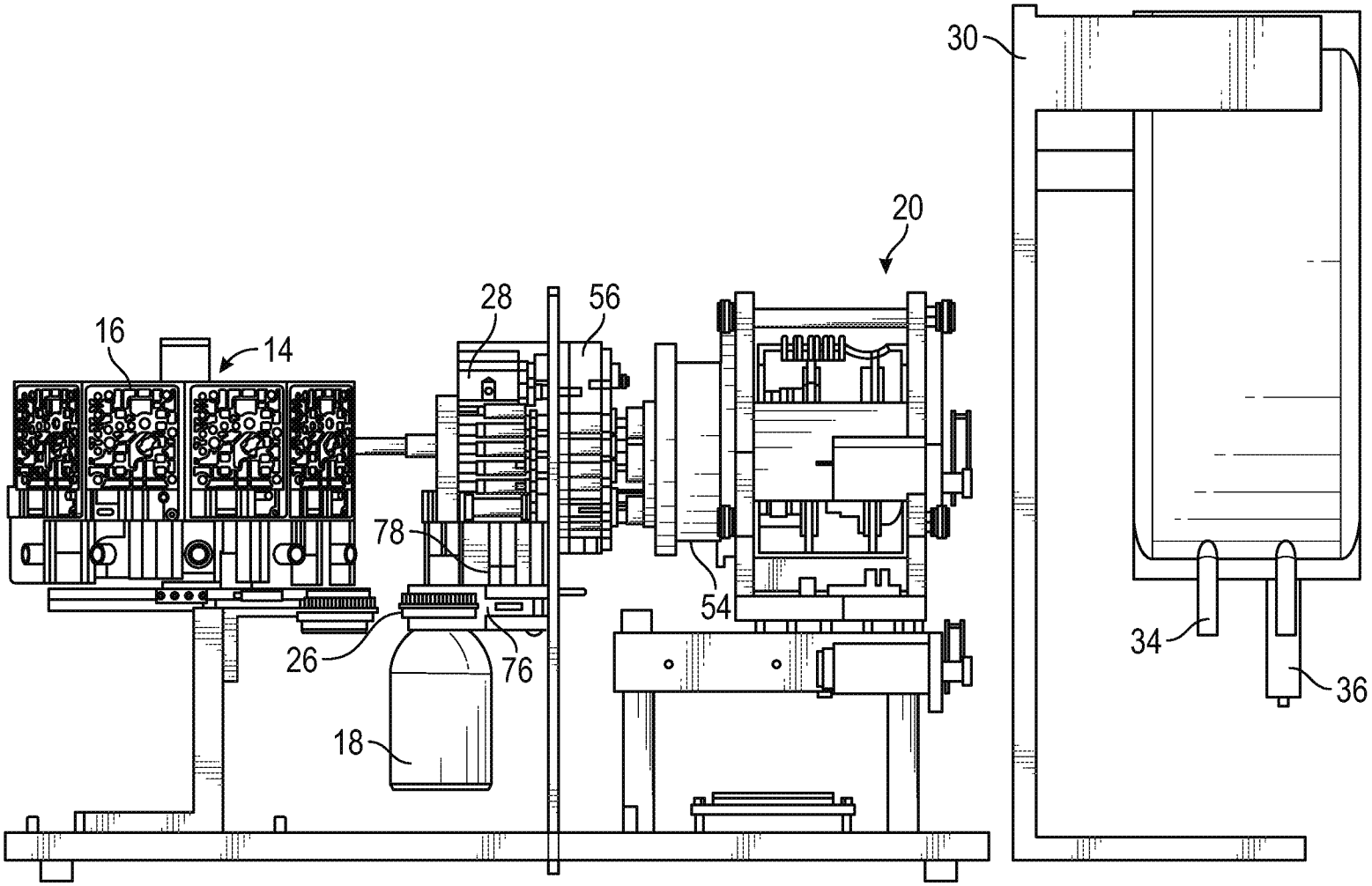
FIG. 3 illustrates a side view of the compounding system of FIG. 1 with the housing removed in accordance with aspects of the present disclosure.

FIG. 1 illustrates a compounder system 10 according to an embodiment. FIG. 2 illustrates the system 10 with a transparent outer housing 12 and FIG. 3 illustrates the system with the housing removed. The system comprises a carousel assembly 14 that contains up to 10 individual cartridges 16. The carousel 14 can hold more or less cartridges 16 if desired. The cartridges 16 are disposable and provide unique fluid paths between a vial 18 containing a powdered drug (or concentrated liquid drug), multiple diluents, and a receiving container. The cartridges 16 may, if desired, also provide a fluid path to a vapor waste container. However, in other embodiments, filtered or unfiltered non-toxic waste may be vented from the compounder to the environment reducing or eliminating the need for a waste port. Each cartridge contains a piston pump and valves that control the fluid intake, outtake, and fluid path selection during the steps of the compounding process as the fluid moves through the cartridge and into a receiving container.

The carousel assembly 14 is mounted on the apparatus such that it can rotate to bring different cartridges 16 into alignment with the pump drive mechanism 20. The carousel 14 is typically enclosed within a housing 12 that can be opened in order to replace the carousel 14 with a new carousel 14 after removing a used one. As illustrated, the carousel 14 can contain up to 10 cartridges 16, allowing a particular carousel to be used up to 10 times. In this configuration, each carousel assembly can support, for example, 10 to 100 receiving containers, depending on the type of compounding to be performed. For example, for hazardous drug compounding, a carousel assembly can support compounding to ten receiving containers. In another example, for non-hazardous drug compounding such as antibiotic or pain medication compounding, a carousel assembly can support compounding to 100 receiving containers. The housing 12 also includes a star wheel 22 positioned underneath the carousel 14. The star wheel 22 rotates vials 18 of pharmaceuticals into position either in concert with, or separate from, the specific cartridges 16 on the carousel 14. The housing 12 may also include an opening 24 for loading the vials 18 into position on the star wheel 22.

Each one of the cartridges 16 in the carousel 14 is a disposable unit that includes multiple pathways for the diluent and vapor waste. Each cartridge 16 is a small, single disposable unit that may also include a "backpack" in which a tube for connection to the receiving container (e.g., an IV bag, a syringe, or an elastomeric bag) may be maintained. Each cartridge 16 also may include a pumping mechanism such as a piston pump for moving fluid and vapor through the cartridge 16 as well as a duel lumen needle in a housing that can pierce a vial puck 26 on top of a vial 18 once the vial 18 has been moved into position by the pump drive mechanism 20. For example, the needle may pierce the vial puck 26 via the compressive action of the vial puck 26, which is moved towards the needle. Each cartridge 16 also includes a plurality of ports designed to match up with the needles of a plurality of diluent manifolds. Each cartridge 16 also includes openings to receive mounting posts and a locking bayonet from the pump head assembly 28. Although a locking bayonet is described herein as an example, other locking mechanisms may be used to retrieve and lock a cartridge to the pump head (e.g., grippers, clamps, or the like may extend from the pump head). Each cartridge 16 also includes openings allowing valve actuators from the pump motor mechanism to interact with the valves on each cartridge 16.

Adjacent the housing 12 that holds the vials 18 and the carousel 14 is an apparatus 30 for holding at least one container 32, such as an IV bag 32 as shown in the figures. The IV bag 32 typically has two ports such as ports 34 and 36. For example, in one implementation, port 34 is an intake port 34 and port 36 is an outlet port 36. Although this implementation is sometimes discussed herein as an example, either of ports 34 and 36 may be implemented as an input and/or outlet port for container 32. For example, in another implementation, an inlet 34 for receiving a connector at the end of tubing 38 may be provided on the outlet port 36. In the embodiment shown, the IV bag 32 hangs from the holding apparatus 30, which, in one embodiment is a post with a hook as illustrated in FIGS. 1-3. As discussed in further detail hereinafter, one or more of the hooks for hanging containers such as diluent containers, receiving containers, or waste containers may be provided with a weight sensor such as a load cell that detects and monitors the weight of a hung container. The holding apparatus 30 can take any other form necessary to position the IV bag 32 or other pharmaceutical container. Once the IV bag 32 is positioned on the holding apparatus 30, a first tube 38 (a portion of which is shown in FIG. 1) is connected from a cartridge 16 on the carousel 14 to the inlet 34 of the IV bag 32. For example, the first tube may be housed in a backpack attached to the cartridge and extended from within the backpack (e.g., by an operator or automatically) to reach the IV bag 32. A connector 37 such as a Texium® connector may be provided on the end of tube 38 for connecting to inlet 34 of receiving container 32.

On the opposite side of the compounder 10 is an array of holding apparatuses 40 for holding multiple IV bags 32 or other containers. In the illustrated version of the compounder 10, five IV bags 42, 44 are pictured. Three of these bags 42 may contain diluents, such as saline, D5 W or sterile water, although any diluent known in the art may be utilized. An additional bag in the array may be an empty vapor waste bag 44 for collecting waste such as potentially hazardous or toxic vapor waste from the mixing process. An additional bag 44 may be a liquid waste bag. The liquid waste bag may be configured to receive non-toxic liquid waste such as saline from a receiving container. Liquid waste may be pumped to the waste bag via dedicated tubing using a mechanical pump. In operation, diluent lines and a vapor waste line from the corresponding containers 42 and 44 may each be connected to a cartridge 16 through a disposable manifold.

The compounding system 10 also includes a specialized vial puck 26 designed to attach to multiple types of vials 18. In operation, the vial puck 26 is placed on top of the vial 18 containing the drug in need of reconstitution. Once the vial puck 26 is in place, the vial 18 is loaded into the star wheel 22 of the compounder 10. Mating features on the vial puck 26 provide proper alignment both while the vial puck 26 is in the star wheel 22 and when the vial puck 26 is later rotated into position so that the compounder 10 can remove it from the star wheel 22 for further processing.

Figure 4:
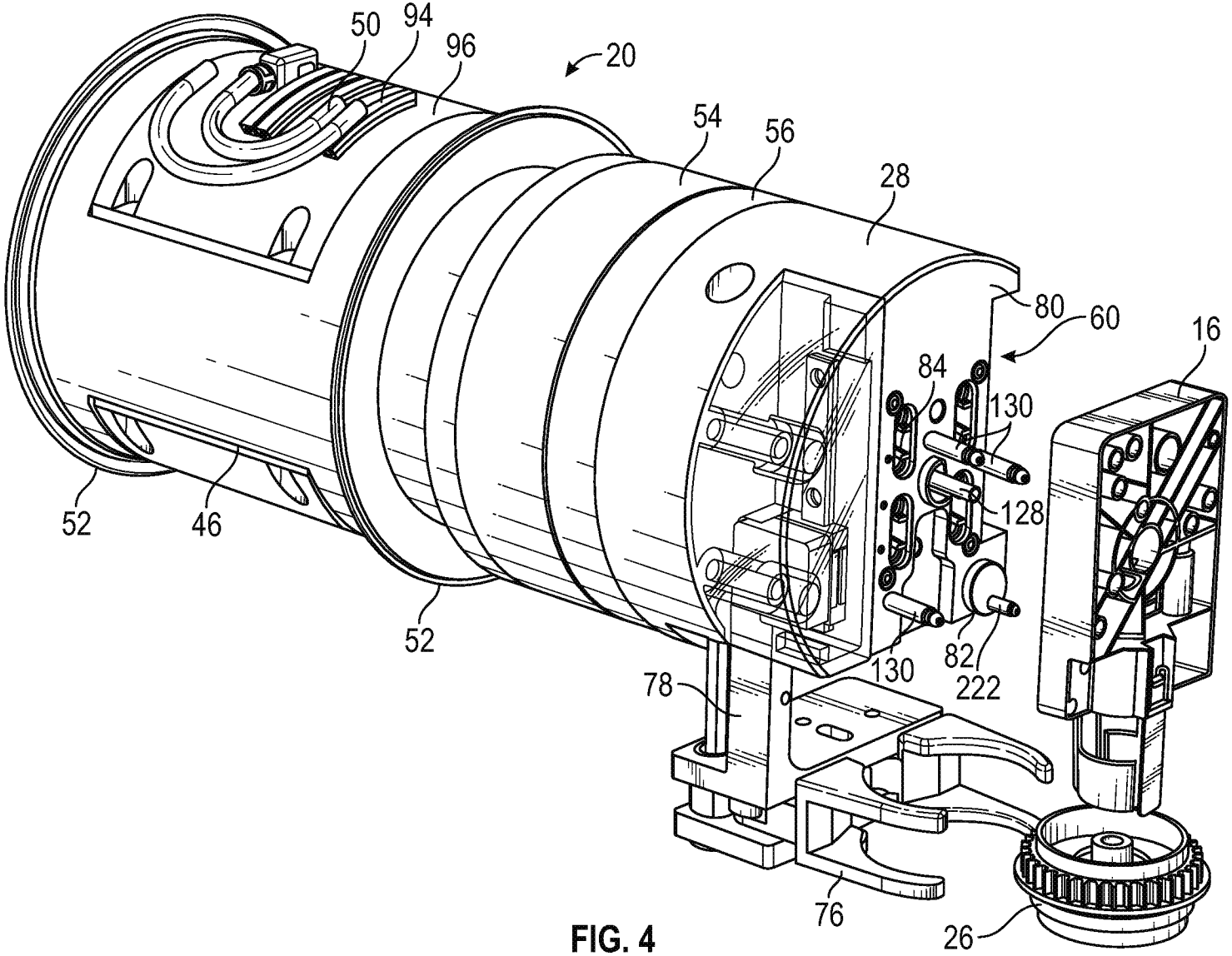
FIG. 4 illustrates a perspective view of an exemplary embodiment of a pump drive mechanism in accordance with aspects of the present disclosure.
Figure 5:
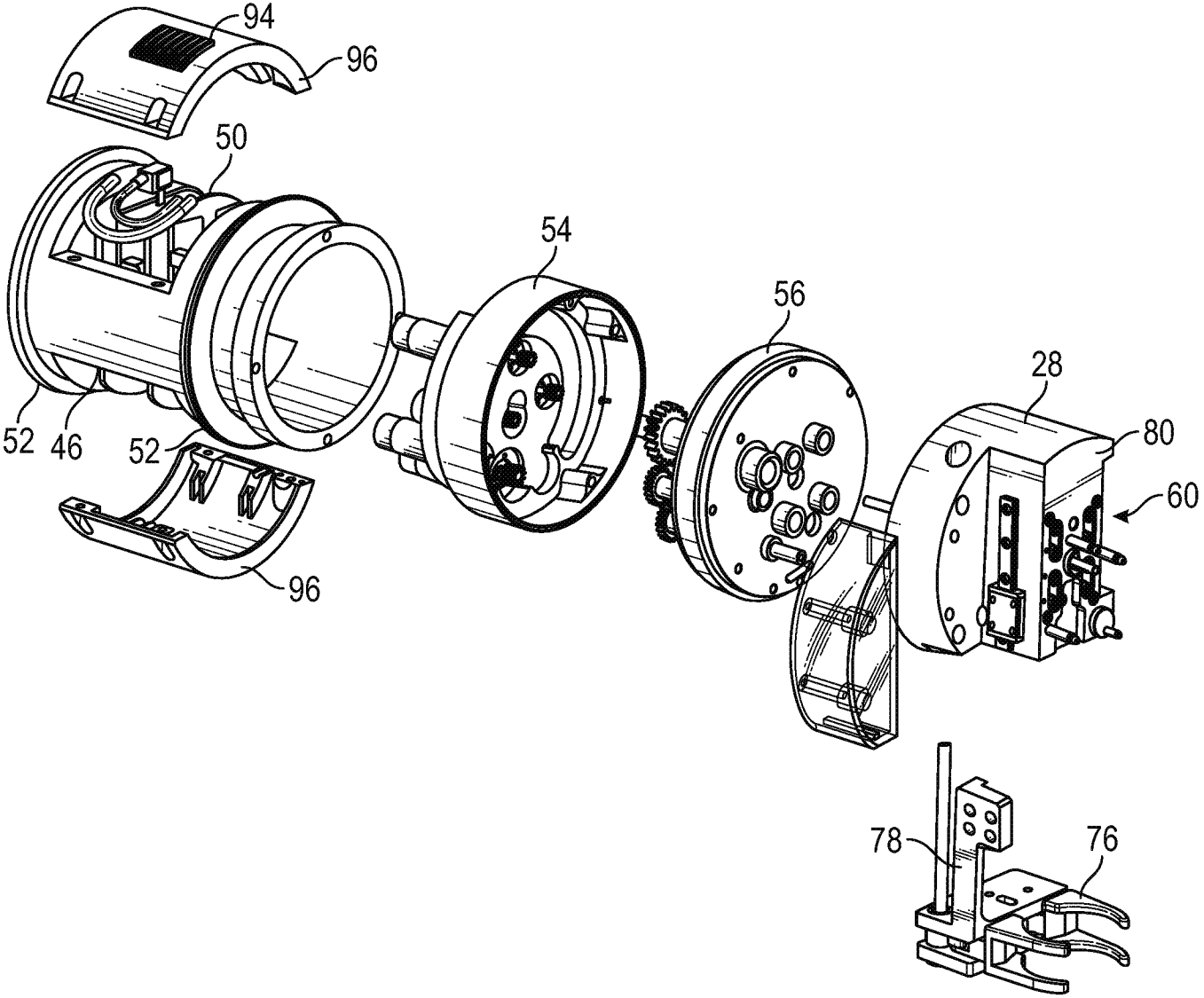
FIG. 5 illustrates an exploded view of the pump drive mechanism of FIG. 4 in accordance with aspects of the present disclosure.

The pump drive mechanism 20 is illustrated in FIG. 4, and in an exploded view in FIG. 5, according to an embodiment. In the embodiment shown in FIGS. 4 and 5, the pump drive mechanism 20 comprises a multitude of sections. At one end of the pump drive mechanism 20 is the rotation housing 46, which holds the drive electronics and includes locking flanges 94 on its housing 96 for flexible tubing 50 which may run from one or more diluent containers and/or waste containers to one or more corresponding manifolds. The rotation housing 46 is capable of rotating around its axis to rotate the rest of the pump drive mechanism 20. The rotation housing 46 includes bearing ribs 52 on its ends which allow it to rotate. For example, the pump drive mechanism may be configured to rotate through any suitable angle such as up to and including 180°, or more than 180°.

Figure 6:
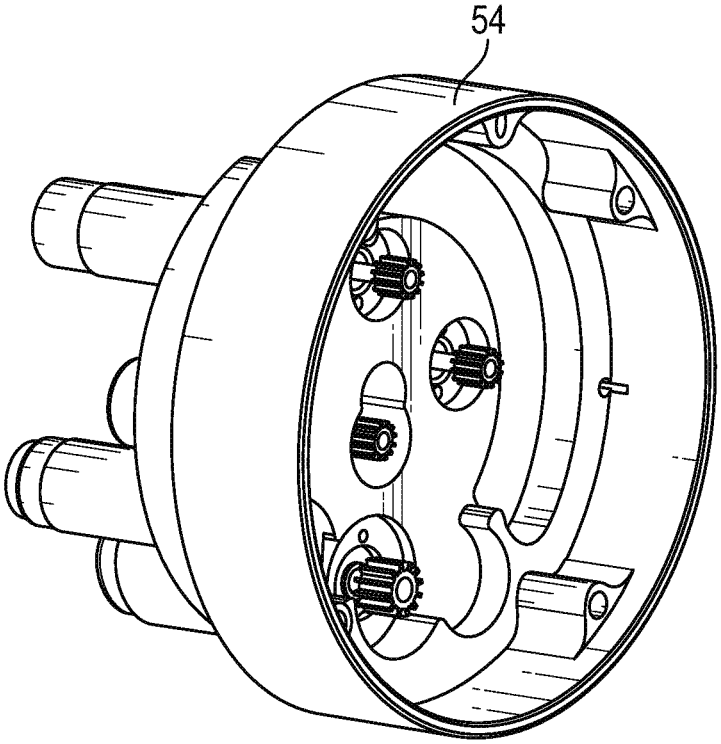
FIG. 6 illustrates a perspective view of an example of an exemplary embodiment of a motor mount in accordance with aspects of the present disclosure.
Figure 7:
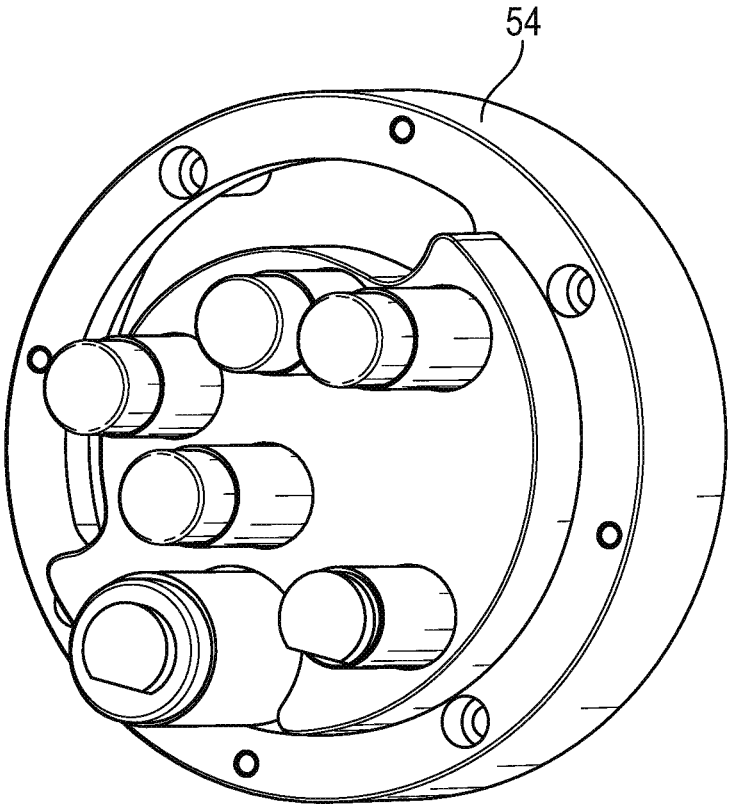
FIG. 7 illustrates a rear perspective view of the motor mount of FIG. 6 in accordance with aspects of the present disclosure.
Figure 8:
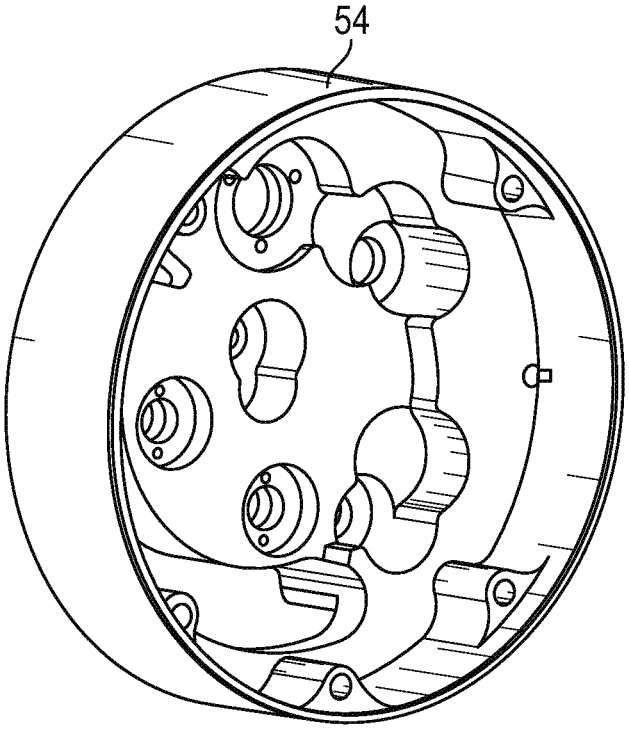
FIG. 8 illustrates a perspective view of the motor mount of FIG. 6 in accordance with aspects of the present disclosure.
Figure 9:
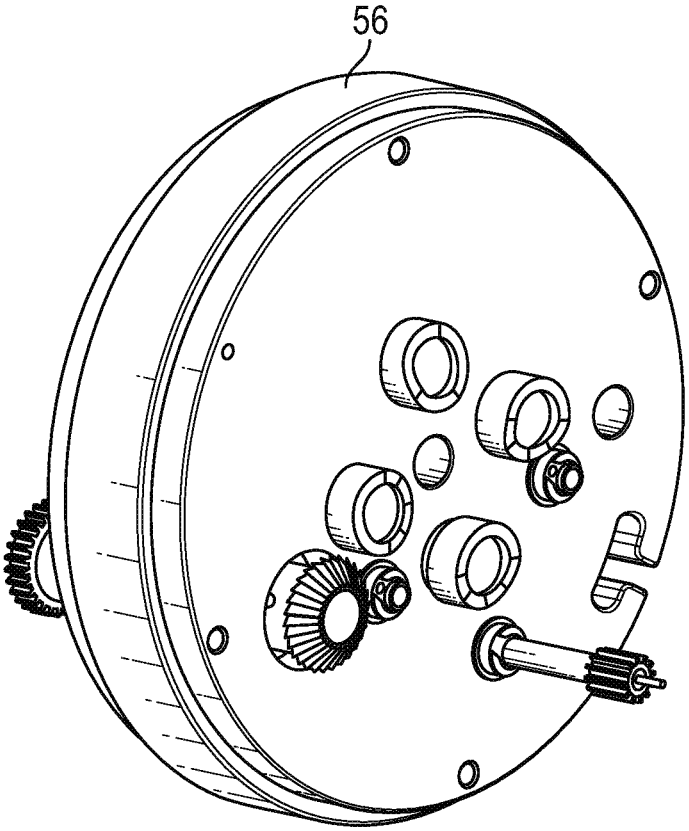
FIG. 9 illustrates a perspective view of an exemplary embodiment of a cam housing in accordance with aspects of the present disclosure.
Figure 10:
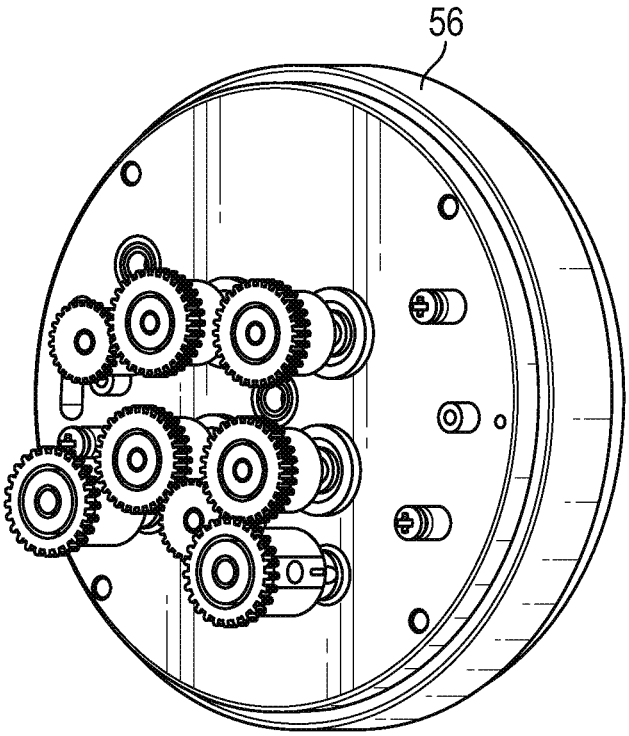
FIG. 10 illustrates a rear perspective view of the cam housing of FIG. 9 in accordance with aspects of the present disclosure.
Figure 11:
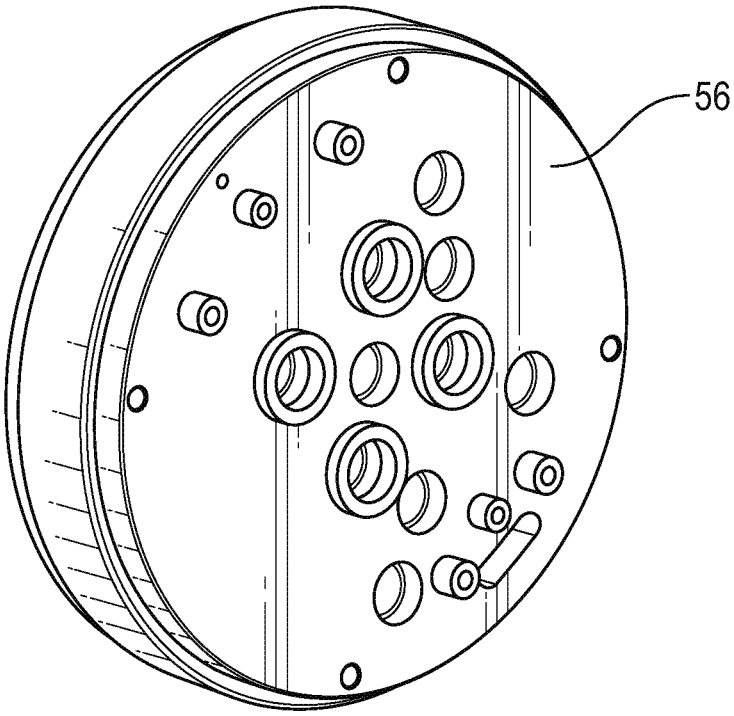
FIG. 11 illustrates a rear perspective view of the cam housing of FIG. 9 with the gears removed in accordance with aspects of the present disclosure.
Figure 12:
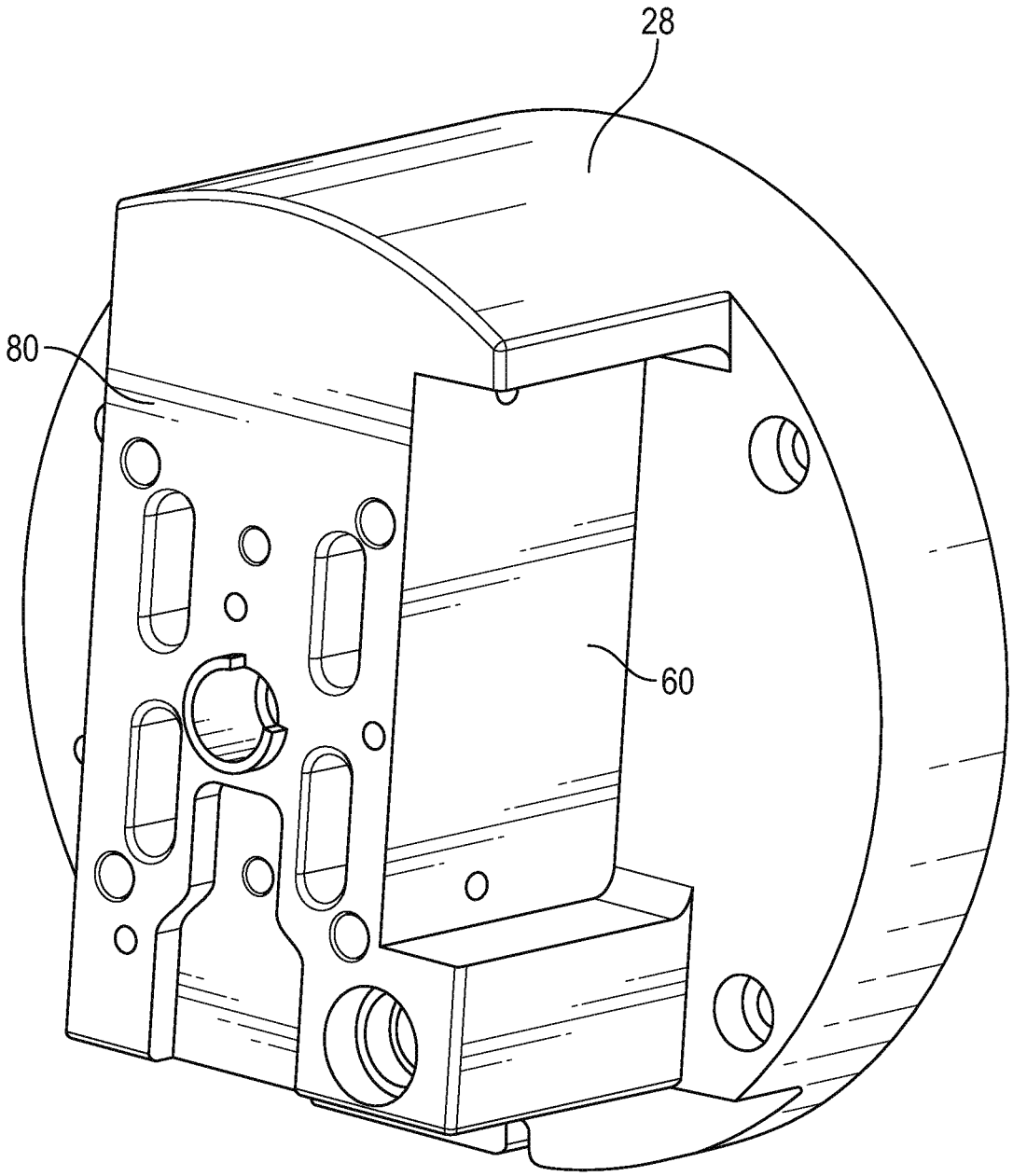
FIG. 12 illustrates a perspective view of an exemplary embodiment of a pump head assembly in accordance with aspects of the present disclosure.
Figure 13:
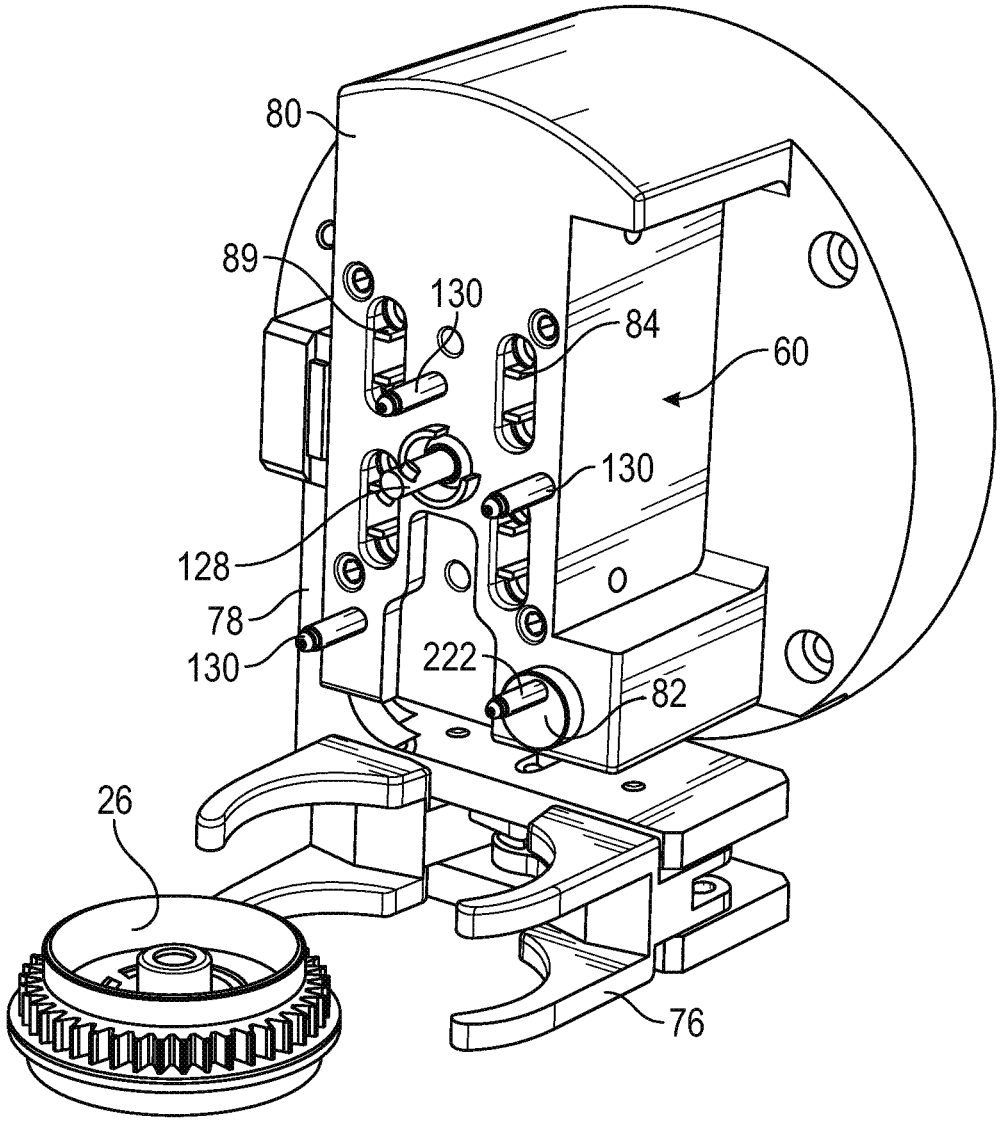
FIG. 13 illustrates a perspective view of the pump head assembly of FIG. 12 with an exemplary embodiment of a gripping system and vial puck in accordance with aspects of the present disclosure.

Next to the rotation housing 46 is the motor mount 54, which is shown alone from various angles in FIGS. 6-8, according to an embodiment. In the embodiment shown in FIGS. 4-8, the cam housing 56, shown in further details from various angles FIGS. 9-11, is connected to the motor mount 54, which includes cams and gears that control the rotary motion of the motors and the axial motion of the pump drive mechanism 20 as it moves into position to pick up a cartridge 16 and a vial 18.

The compounder system also includes a diluent magazine (not shown) that mounts in a slot 60 located on the side of the pump drive mechanism. The diluent magazine may be a disposable piece configured to receive any number of individual diluent manifolds operable as diluent ports. The diluent manifolds (not shown) may be modular so they can easily and removably connect to each other, the magazine, and/or connect to the pump drive mechanism 20.

The final portion of the pump drive mechanism 20 is the pump head assembly 28. The pump head assembly 28 includes the vial grasping arms 76 (sometimes referred to herein as vial calipers or collectively as a vial grip), the vial lift 78, the pump cartridge grasp 80, the pump piston eccentric drive shaft 82 with arm 222, the valve actuation mechanisms 84, as well as the motors that allow the pump drive mechanism 20 to move forward and back and to rotate in order to mix the pharmaceutical in the vial 18 once the diluent has been added to it. The compounder 10 may also include an input screen 86 such as a touch screen 86 as shown in the figures to provide data entry by the user and notifications, instructions, and feedback to the user.

Figure 21:
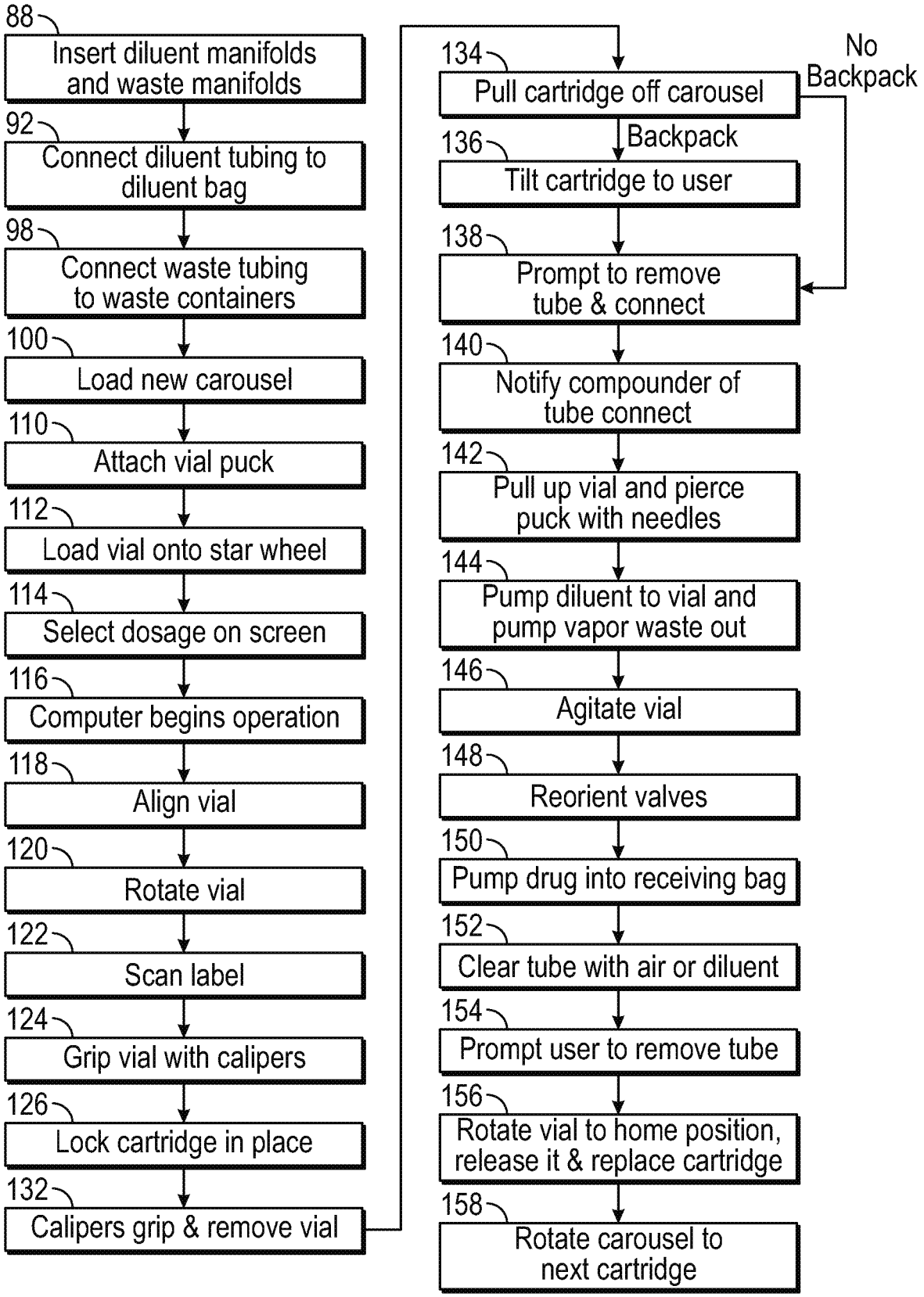
FIG. 21 is a flow chart illustrating an exemplary embodiment of the steps of a process in accordance with aspects of the present disclosure.

The operation of the compounder system 10 will now be generally described in the flowchart illustrated at FIG. 21, according to an embodiment. In the first step 88, a user inserts a new diluent manifold magazine having a plurality of manifolds (e.g., diluent manifolds and waste manifolds) into the slot 60 on the side of the pump head assembly 28. Manifolds may be loaded into the magazine before or after installing the magazine in the slot 60. The manifolds maintain needles inside the housing of the manifold until the cartridge 16 is later locked in place. The magazine may contain any number of diluent manifolds and vapor waste manifolds. In one illustrative system, there may be three diluent manifolds and one vapor waste manifold. In the next step 92, diluent tubing is connected to corresponding diluent bags. The tubes may be routed through locking flanges on a surface (e.g., the front surface) of the compounder frame to hold them in place. For example, in the illustrated embodiment of FIG. 24, the tubes are held in place with locking flanges 2402 on the frame of the compounder. Alternatively, other types of clips or locking mechanisms known in the art may be used to hold the tubes securely in place. In the illustrated embodiment of FIG. 4, the additional flanges 94 positioned on the outside housing 96 of the pump drive mechanism 20 are provided for securing internal wiring of the compounder. In the next step 98, waste tubing may be connected to the vapor waste bag 44. In other embodiments, tubing may be pre-coupled between the manifolds and associated containers such as diluent containers and/or waste containers and the operations of steps 92 and 98 may be omitted.

If desired, in the next step 100, a new carousel 14 may be loaded into a carousel mounting station such as a carousel hub of the compounder system. The carousel 14 may contain any number of disposable cartridges 16 arranged in a generally circular array. In the next step 110, a vial puck 26 is attached to the top of a vial 18 of a powdered or liquid pharmaceutical for reconstitution and the vial 18 is loaded into the star wheel 22 under the carousel 14 in the next step 112. Step 110 may include loading multiple vials 18 into multiple vial puck recesses in star wheel 22. After one or more vials are loaded into the star wheel, the vials are rotated into position to enable and initiate scanning of the vial label of each vial. In one embodiment, the user will be allowed to load vials into the star wheel until all vial slots are occupied with vials before the scanning is initiated. A sensor may be provided that detects the loading of each vial after which a next vial puck recess is rotated into the loading position for the user. Allowing the user to load all vials into the star wheel prior to scanning of the vial labels helps increase the efficiency of compounding. However, in other implementations, scanning of vial labels may be performed after each vial is loaded or after a subset of vials is loaded. Following these setup steps, the next step 114 is for a user to select the appropriate dosage on the input screen.

After the selection on the input screen 86, the compounder 10 begins operation 116. The star wheel 22 rotates the vial into alignment 118 with the vial grasping calipers 76 of the pump head assembly 28. The vial puck 26 includes, for example, gears that interface with gears coupled to a rotational motor that allow the vial 18 to rotate 120 so that a scanner (e.g., a bar code scanner or one or more cameras) can scan 122 a label on the vial 18. The scanner or camera (and associated processing circuitry) may determine a lot number and an expiration date for the vial. The lot number and expiration date may be compared with other information such as the current date and/or recall or other instructions associated with the lot number. Once the vial 18 is scanned and aligned, in the next step 124 the pump drive mechanism 20 moves forward into position to grip the vial 18 with the calipers 76. The forward movement also brings the mounting posts 130 and locking bayonet 128 on the front of the pump head assembly 28 into matching alignment with corresponding openings on a cartridge 16. In the next step 126, the cartridge 16 is locked in place on the pump head assembly 28 with the locking bayonet 128 and the calipers 76 grip 132 the vial puck 26 on the top of the vial 18. The calipers 76 then remove 132 the vial 18 from the star wheel 22 by moving backward, while at the same time pulling 134 the cartridge 16 off of the carousel 14.

In some embodiments, the cartridge 16 includes a backpack that includes a coiled tube. In this embodiment, in step 136 the pump drive mechanism 20 tilts the cartridge 16 toward the user to expose the end of the tube and prompts 138 the user to pull the tube out of the backpack and connect it to the receiving bag 32. In an alternative embodiment, the tube 38 is exposed on the side of the carousel 14 once the cartridge 16 is pulled away from the carousel 14. In another alternative embodiment, the tube 38 is automatically pushed out (e.g., out of the backpack) thus allowing the user to grab onto the connector located at the end of the tube and connect to the receiving container. The system prompts 138 the user to pull the tube out from the carousel 14 and connect it to the input 34 of the IV bag 32. Once the tube 38 is connected, in step 140 the user may notify the compounder 10 to continue the compounding process by interacting with the input screen 86.

At step 142, the vial 18 is pulled up towards the cartridge 16 so that one or more needles such as a coaxial dual lumen needle of the cartridge 16 pierce the top of the vial puck 26 and enter the interior of the vial 18. Although the example of FIG. 21 shows engagement of the needle with the vial puck after the user attaches the tube from the cartridge to the receiving container, this is merely illustrative. In another embodiment, steps 138 and 140 may be performed after step 142 such that engagement of the needle with the vial puck occurs before the user attaches the tube from the cartridge to the receiving container.

Diluent is pumped at step 144 into the vial 18 through the cartridge 16 and a first needle in the proper dosage. If necessary, a second or third diluent may be added to the vial 18 via a second or third diluent manifold attached to the cartridge 16. Simultaneously, vapor waste is pumped 144 out of the vial 18, through a second needle, through the cartridge 16 and the vapor waste manifold, and into the vapor waste bag 44. The valve actuators 84 on the pump head assembly 28 open and close the valves of the cartridge 16 in order to change the fluid flow paths as necessary during the process. Once the diluent is pumped into the vial 18, the pump drive mechanism 20 agitates the vial 18 in the next step 146 by rotating the vial lift 78 up to, for example 180 degrees such that the vial 18 is rotated between right-side-up and upside-down positions. The agitation process may be repeated for as long as necessary, depending on the type of pharmaceutical that is being reconstituted. Moreover, different agitation patterns may be used depending on the type of drugs being reconstituted. For example, for some drugs, rather than rotating by 180 degrees, a combination of forward-backward, and left-right motion of the pump head may be performed to generate a swirling agitation of the vial. A plurality of default agitation patterns for specific drugs or other medical fluids may be included in the drug library stored in (and/or accessible by) the compounder control circuitry. Once the agitation step is complete, the pump drive mechanism rotates the vial to an upside down position or other suitable position and holds it in place. In some embodiments, a fluid such as a diluent already in the receiving container 32 may be pumped (e.g., through the cartridge or via a separate path) into a liquid waste container to allow room in the receiving container for receiving the reconstituted medicine.

In the next step 148, the valve actuators 84 reorient the valves of the cartridge and the pumping mechanism of the cartridge 16 is activated to pump 150 the reconstituted drug into the receiving bag 32 through the attached tube. Once the drug is pumped into the receiving bag 32, in the next step 152 the pump drive mechanism 20 clears the tube 38 by either pumping filtered air or more diluent through the tube 38 into the receiving bag 32 after another valve adjustment to ensure that all of the reconstituted drug is provided to the receiving bag 32. In some scenarios, a syringe may be used as a receiving container 32. In scenarios in which a syringe is used as the receiving container 32, following delivery of the reconstituted drug to the syringe, a vacuum may be generated in tube 38 by pump drive mechanism 20 to remove any air or other vapors that may have been pushed into the syringe so that, when the syringe is removed from tube 38, the reconstituted drug is read for delivery to a patient and no air or other unwanted gasses are present in the syringe.

The system then prompts 154 the user to remove the tube 38 from the receiving container 32. The user may then insert the connector (e.g., a Texium® or SmartSite® connector) into its slot in the backpack or carousel and an optical sensor in the pump head may sense the presence of the connector and automatically retract the tube into either the carousel or the backpack. The tube is pulled back into either the carousel 14 or the backpack, depending on which type of system is in use. In the next step 156, the compounder 10 rotates the vial 18 back into alignment with the star wheel 22 and releases it. The used cartridge 16 may also be replaced on the carousel 14. The used cartridge may be released when a sensor in the pump drive determines that the tube has been replaced in the cartridge (e.g., by sensing the presence of a connector such as a Texium® connector at the end of the tube in the backpack of the cartridge through a window of the cartridge). The carousel 14 and/or star wheel 22 then may rotate 158 to a new unused cartridge 16 and/or a new unused vial 18 and the process may be replicated for a new drug. In some circumstances (e.g., multiple reconstitutions of the same drug), a single cartridge may be used more than once with more than one vial.

The cartridges 16 are designed to be disposable, allowing a user to utilize all the cartridges 16 in a given carousel 14 before replacing the carousel 14. After a cartridge 16 is used, the carousel 14 rotates to the next cartridge 16, and the system software updates to note that the cartridge 16 has been used, thus preventing cross-contamination from other reconstituted drugs. Each cartridge 16 is designed to contain all the necessary flow paths, valves, filters and pumps to reconstitute a drug with multiple diluents if necessary, pump the reconstituted drug into the receiving container, pump vapor waste out of the system into a waste container, and perform a final QS step in order to make sure that the proper amount of drug and diluent is present in the receiving container. This complete package is made possible by the specific and unique construction of the cartridge 16, its flow paths, and its valve construction.

Figure 22:
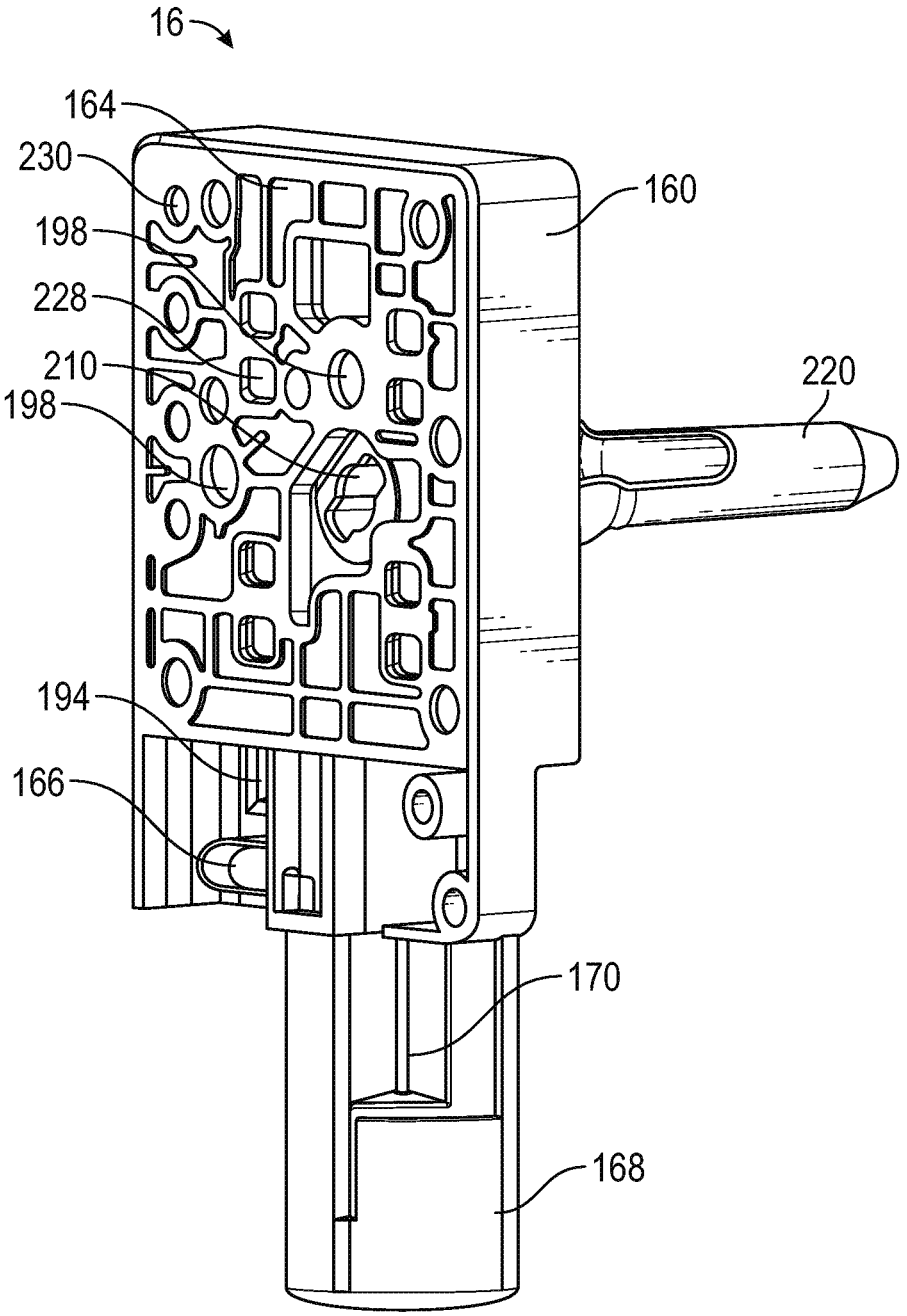
FIG. 22 illustrates a perspective view of an exemplary embodiment of a cartridge in accordance with aspects of the present disclosure.

An embodiment of a cartridge 16 is illustrated in FIG. 22. As shown in FIG. 22, cartridge 16 may include a cartridge frame 160, a cartridge bezel 164, as well as a piston pump 166, a needle housing 168 and a needle assembly 170. The cartridge frame 160 provides the main support for each cartridge 16 and includes diluent chambers, a vapor waste chamber, a pumping chamber, a hydrophobic vent, an exit port, and/or other features as described hereinafter that can be connected to a tube that connects to the receiving container 32.

The frame 160 of the cartridge 16 also includes locating features that allow each cartridge 16 to be removably mounted to the pump head assembly 28. These features include, for example, three openings 198 to receive mounting posts 130 from the pump head assembly 28, and a keyhole 210 that allows a locking bayonet 128 to be inserted therein and turned to lock the cartridge 16 to the pump head assembly 28 for removal from the carousel 14. An outlet port extension 220 may be present in some embodiments. The piston pump 166 is mounted within a chamber with a rod 194 positioned within a silicone piston boot. Furthermore, the bezel 164 includes openings 228 in which the valves 190 of the sealing membrane are located and be accessed by the valve actuators 84. Moreover, the bezel 164 includes openings 230 that allow a fluid manifold to be connected to the diluent and vapor waste chambers in the cartridge 16. Bezel 164 may also include an opening that facilitates the detection of a connector (e.g., a Texium® or SmartSite® connector) when the user inserts the connector into the provided slot when compounding is complete. In operation, the needles of the fluid manifold enter through the openings 230 in the bezel 164 and pierce the sealing membrane to gain fluidic access to the diluent and vapor waste chambers defined in the cartridge 16 between the sealing membrane and the cartridge frame 160. Further details of various embodiments of the cartridge 16 will be discussed hereinafter.

Figure 23:
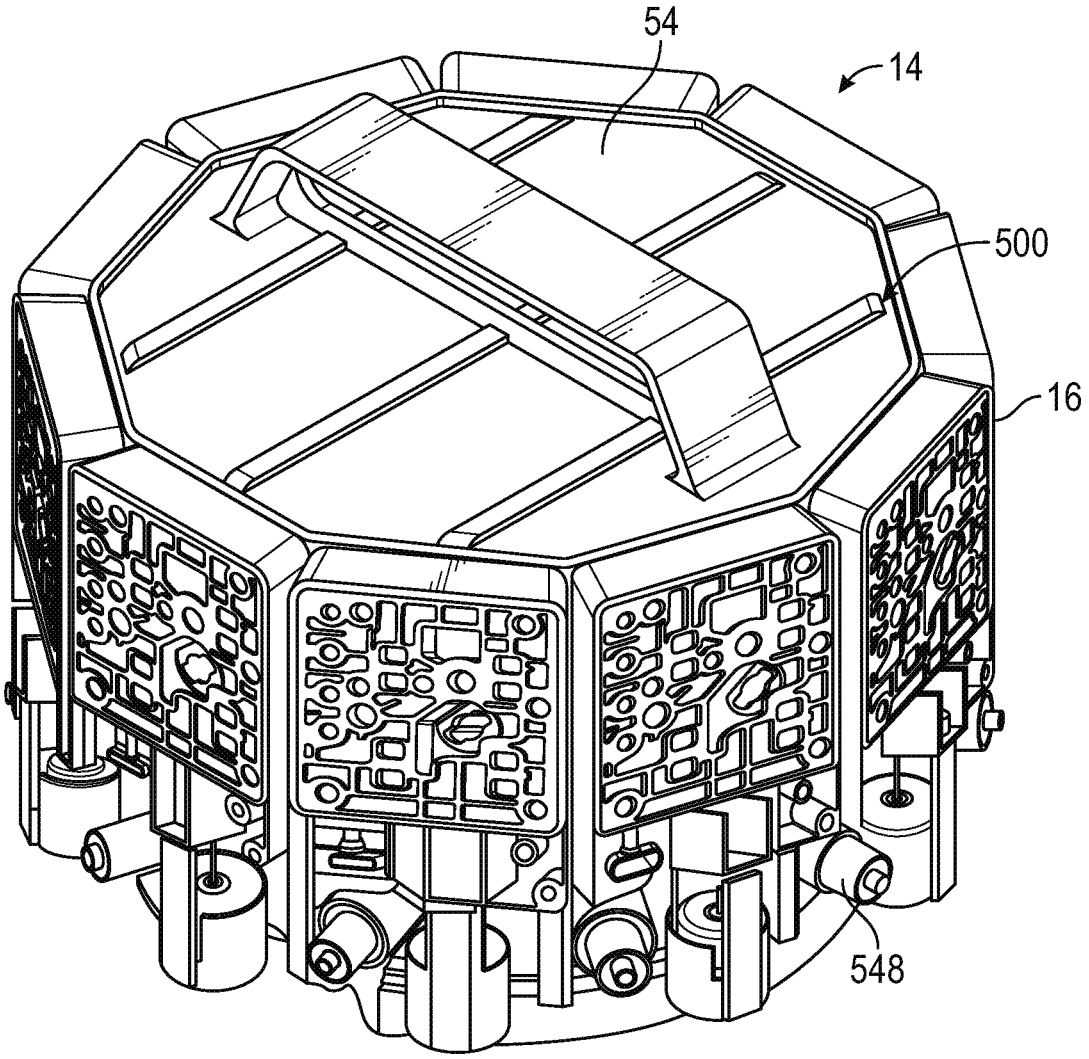
FIG. 23 illustrates a perspective view of an exemplary embodiment of a carousel with a cover in accordance with aspects of the present disclosure.

Referring to FIG. 23, an exemplary embodiment of a carousel 14 removed from the compounder 10 is illustrated, according to an embodiment. The carousel 14 of FIG. 23 includes an array of ten cartridges 16 in this embodiment, but it should be understood that more or fewer cartridges 16 can be present on the carousel 14, leaving some of the carousel 14 pockets 500 empty, or the frame 510 of the carousel can be designed to have more or fewer cartridge pockets 500. The carousel 14 also includes a cover 511 that prevents a user from accessing the tubes coupled to each of the cartridges 16 directly. The cover 511 may be removed if necessary to access the backs of the cartridges 16. In the example implementation of FIG. 23, a connector such as a Texium® attachment 548 is disposed adjacent each cartridge 16, the attachment 548 being attached to the tube 38 that runs from the extension 220 on each cartridge 16.

Figure 24:
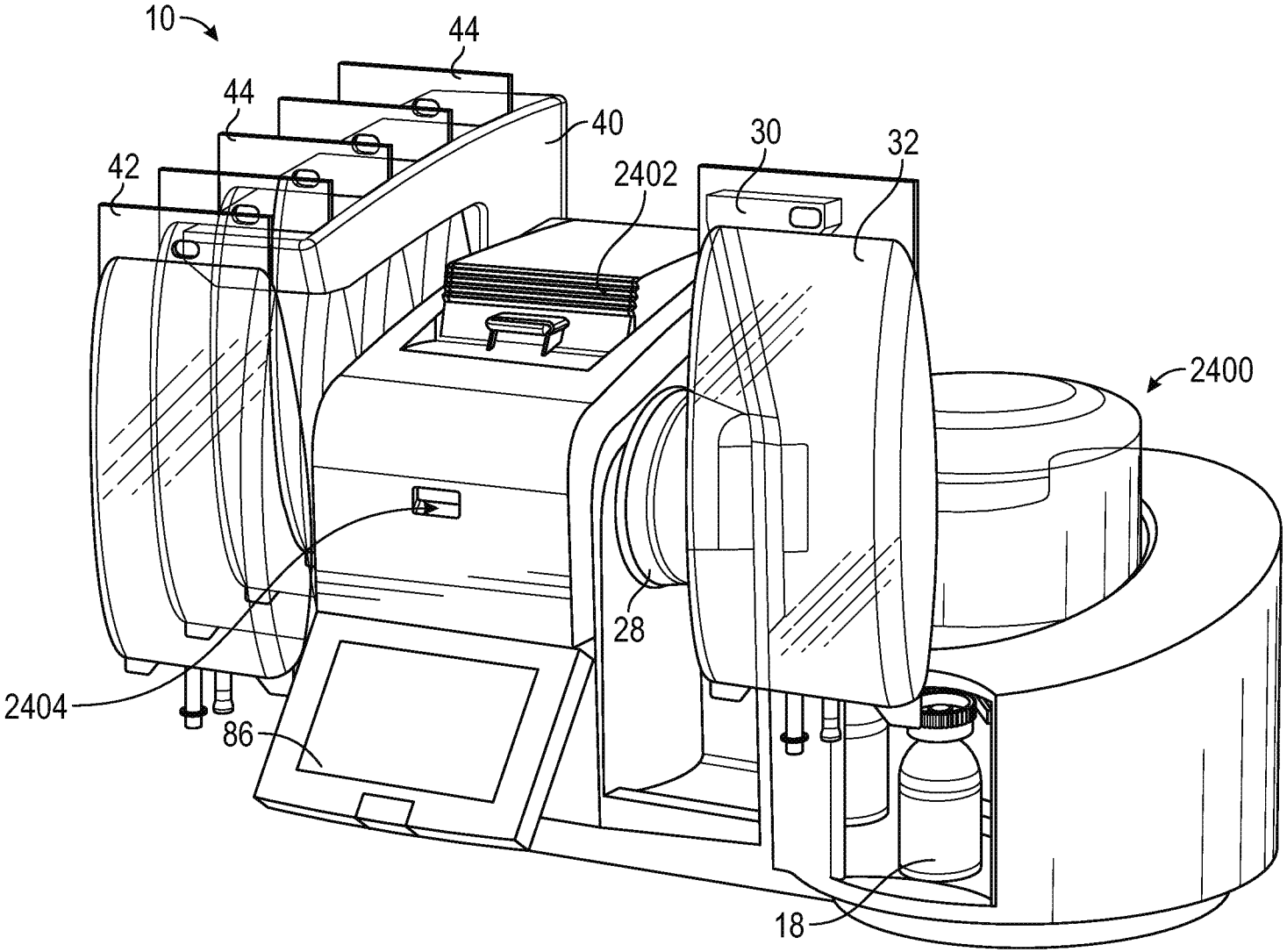
FIG. 24 illustrates a front perspective view of another exemplary embodiment of a compounding system in accordance with aspects of the present disclosure.

FIGS. 24-29 show the compounder 10 according to another embodiment. As shown in FIG. 24, holding apparatus 40 may be implemented as an extended arm providing support for mounting devices for each of containers 42 and 44. Holding apparatus 40 and holding apparatus 30 may each include one or more sensors such as weight sensors configured to provide weight measurements for determining whether an appropriate amount of fluid has been added to or removed from a container or to confirm that fluid is being transferred to and/or from the appropriate container (e.g., that the appropriate diluent is being dispensed). A scanner 2404 may be provided with which each diluent container and/or the receiving container can be scanned before and/or after attachment to compounder 10. As shown in FIG. 24, a carousel cover 2400 and tube management structures 2402 may also be provided on compounder 10 in various embodiments. For example, tubes connected between containers 42 and/or 44 and corresponding manifolds can each be mounted in a groove of tube management structure 2402 to prevent tangling or catching of the tubes during operation of compounder 10.

Figure 25:
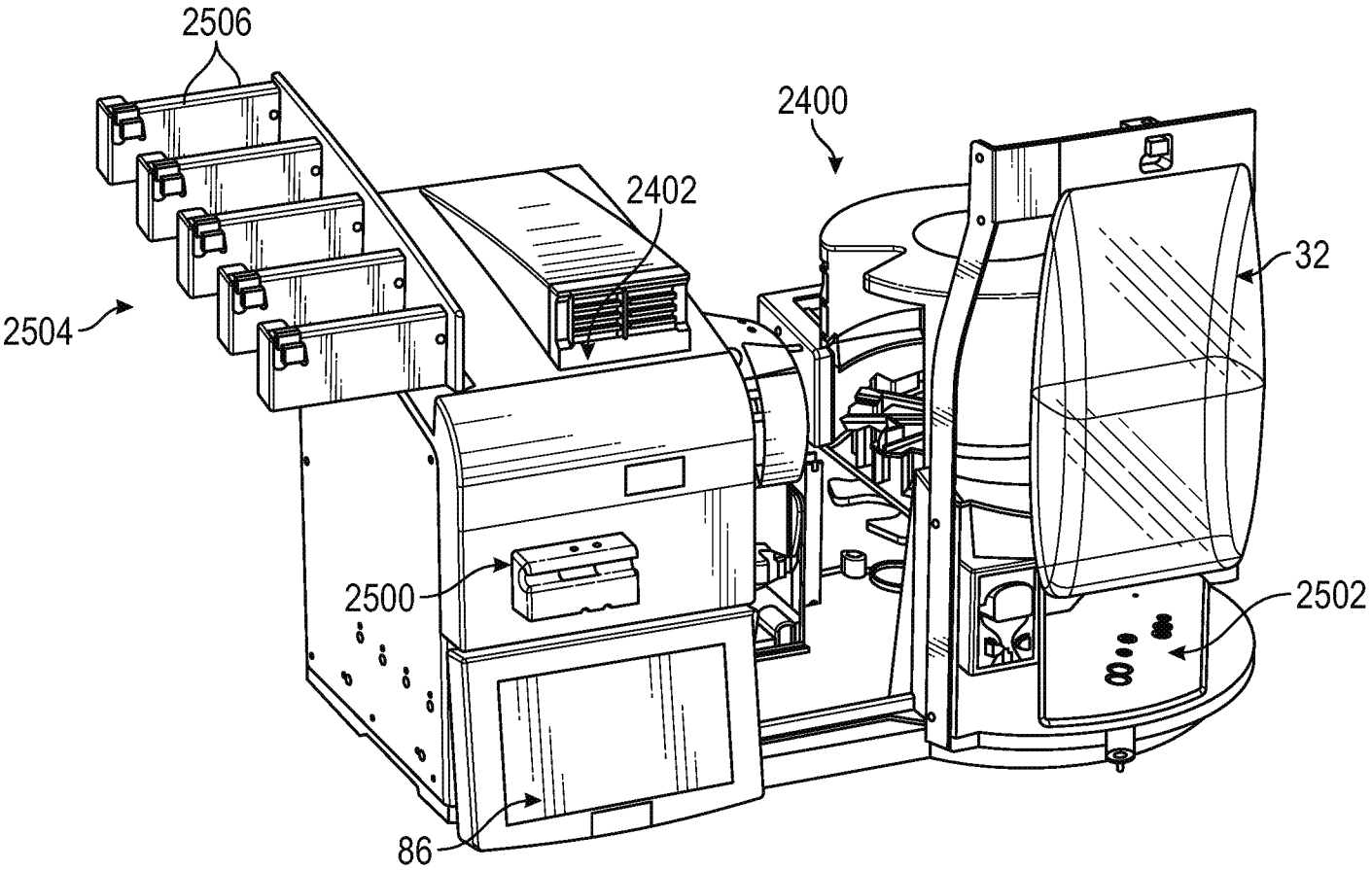
FIG. 25 illustrates another front perspective view of the compounding system of FIG. 24 in accordance with aspects of the present disclosure.

As shown in FIG. 25, an opening 2502 may be provided by which vials 18 can be installed in the star wheel. Additionally, an exterior pump 2500 may be provided for pumping non-toxic liquid waste from, for example, receiving container 32 to a waste container 44 (e.g., for pumping a desired amount of saline out of receiving container 32 quickly and without passing the liquid waste through a cartridge and/or other portions of the compounder).

A fluidics module 2504 may be provided that includes several container mounts 2506. Container mounts 2506 may be used for hanging diluent and waste containers and may include sensor circuitry for sensing when a container has been hung and/or sensing the weight of the container. In this way, the operation of compounder 10 can be monitored to ensure that the correct diluent contain has been scanned and hung in the correct location and that the waste is being provided in an expected amount to the appropriate waste container.

Figure 26:
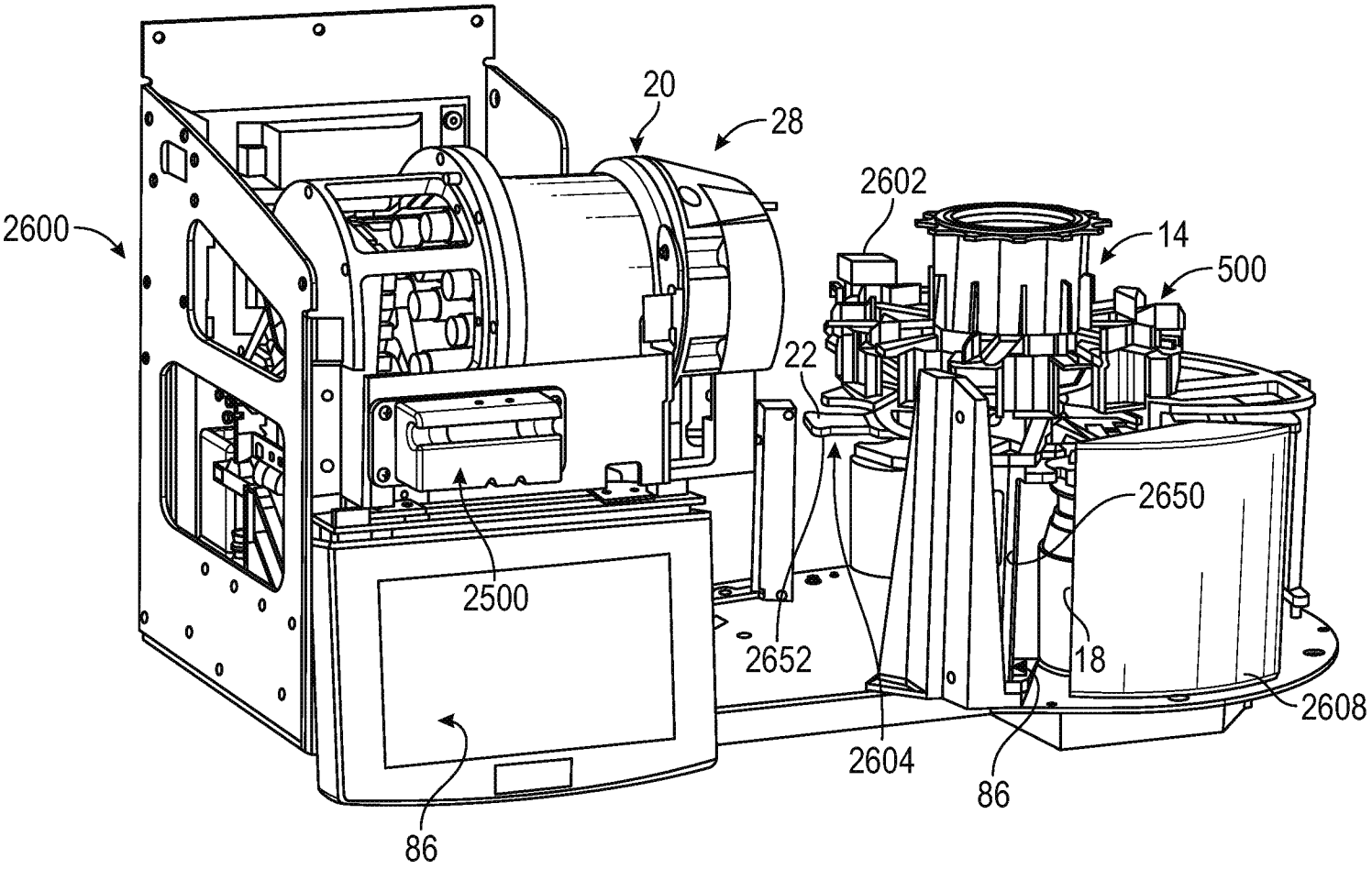
FIG. 26 illustrates a front perspective view of the compounding system of FIG. 24 with portions of the housing removed in accordance with aspects of the present disclosure.

As shown in FIG. 26, pump 2500 and display 86 may be mounted to a chassis 2600. Pump drive 20 may be mounted partially within the chassis 2600 with pump head assembly 28 extending from the chassis to a position which allows the pump head assembly to rotate (e.g., to turn over or agitate a vial). Carousel 14 is also shown in FIG. 26 without any cartridges mounted therein so that cartridge mounting recesses 500 can be seen.

Star wheel 22 (sometimes referred to herein as a vial tray) is shown in FIG. 26 with several empty vial puck recesses 2604. Vial tray 22 may be rotated and an actuating door 2608 may be opened to facilitate loading of vials 18 into the vial puck recesses 2604 in vial tray 22. In some embodiments, door 2608 may be closed before rotation of vial tray 22 to ensure that the operator's fingers are not in danger of injury from the rotating tray. However, this is merely illustrative. In other embodiments a sensor such as sensor 2650 (e.g., a light curtain) may be provided instead of (or in addition to) door 2608 to sense the presence of an operator in the vicinity of tray 22 and prevent rotation of the tray if the operator or any other obstruction is detected.

Similarly, a lid may be provided for carousel 14 to prevent contamination of cartridges 16 loaded therein, and to prevent injury to an operator due to rotation of the carousel. A lid sensor (not shown) may also be provided to detect the position (e.g., an open position or a closed position) of the lid. Rotation of carousel 14 may be prevented if the lid is not detected in a closed position by the lid sensor.

Each vial 18 that is inserted may be detected using a sensor such as sensor 2652 (e.g., a load sensor or an optical sensor) when placed in a vial puck recess 2604. When detected, the inserted vial may be moved to a scanning position by rotating vial tray 22 and then the inserted vial 18 may be rotated within its position in vial tray 22 using a vial rotation motor 2602 to allow the vial label to be scanned.

Figure 27:
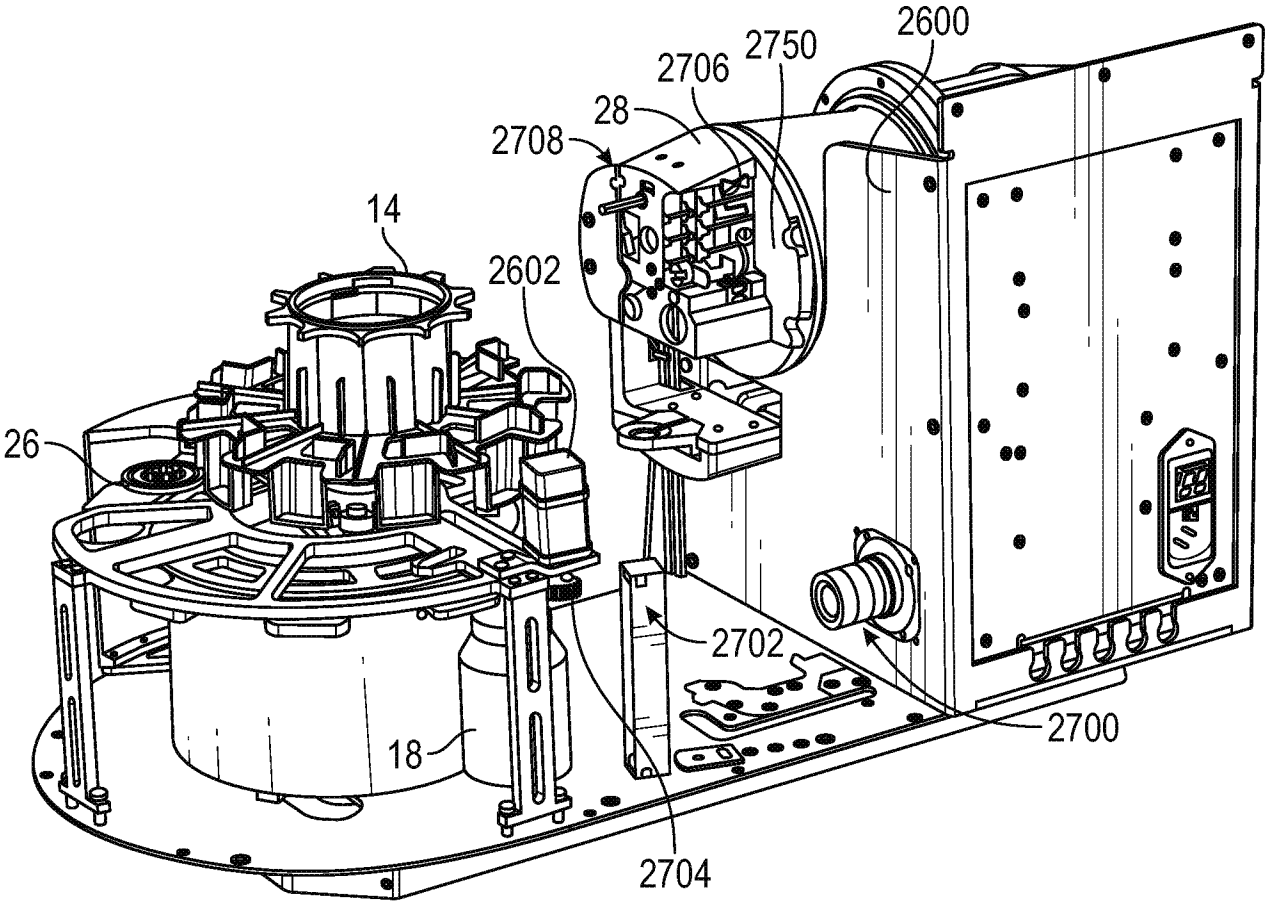
FIG. 27 illustrates a rear perspective view of the compounding system of FIG. 24 with portions of the housing removed in accordance with aspects of the present disclosure.

A reverse perspective view of compounder 10 is shown in FIG. 27 in which scanning components can be seen. In particular, a camera 2700 is mounted in an opening in chassis 2600 and configured to view a vial 18 in a scanning position. Motor 2602 may rotate vial 18 through one or more full rotations so that camera 2700 can capture images of the vial label. In some embodiments, an illumination device 2702 (e.g., a light-emitting diode or other light source) may be provided that illuminates vial 18 for imaging with camera 2700.

As shown in FIG. 27 one or more gears 2704 coupled to motor 2602 may be provided that engage corresponding gears on a vial puck 26 to which a vial 18 is attached at the scanning position. The vial tray 22 may be rotated so that the vial puck gears engage the rotation motor gears so that when the motor 2602 is operated the vial 18 is rotated.

FIG. 27 also shows how a magazine 2706 containing one or more manifolds may be mounted in a recess in pump head assembly 28. A magazine slot in magazine 2706 for the vapor waste manifold may be keyed to prevent accidental connection of a diluent manifold in that slot (or a waste manifold in a diluent slot in the magazine). Other diluent slots in magazine 2706 may have a common geometry and thus any diluent manifold can fit in the magazine diluent slots. One or more manifold sensors such as manifold sensor 2750 (e.g., an optical sensor) may be provided in the manifold recess in pump head assembly 28. Manifold sensor 2750 may be configured to detect the presence (or absence) of a manifold in a manifold recess (slot) in magazine 2706 to ensure that an appropriate manifold (e.g., a diluent manifold or waste manifold) is loaded at the expected position for compounding operations. In this way, the pump head may detect a manifold presence. The pump head and/or manifold sensors may communicate with the diluent load sensors to ensure proper positioning of the diluent manifolds. Various operational components 2708 such as valve actuators, needle actuators, mounting posts, a locking bayonet, and a drive pin can also be seen extended from pump head assembly 28 which are configured to secure and operate a pump cartridge 16.

Figure 28:
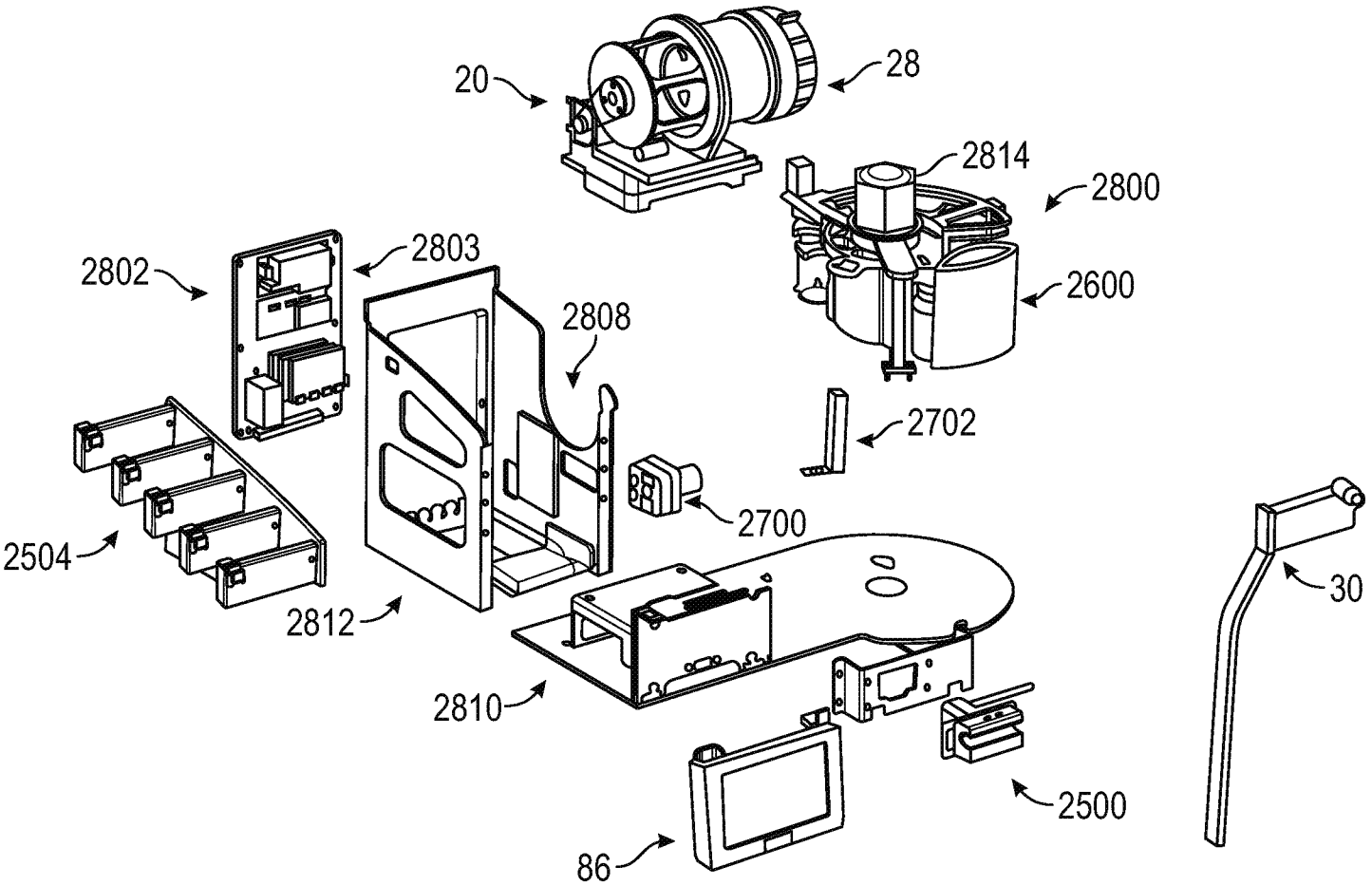
FIG. 28 illustrates an exploded perspective view of the compounding system of FIG. 24 in accordance with aspects of the present disclosure.

An exploded view of various components of compounder 10 is shown in FIG. 28. Components discussed above such as display 86, pump 2500, dose hanger 30, fluidics module 2504, pump drive 20 with pump head assembly 28, camera 2700, and lighting device 2702 are shown. Additional components such as a chassis base 2810 and chassis housing 2812 of chassis 2600 are also shown in FIG. 28. A rear panel 2802 having an electronics assembly 2803 can be mounted to chassis housing 12 and pump drive 20 may be seated in an opening 2808 in chassis housing 2812 that allows pump head assembly 28 to protrude from chassis housing 2812. Processing circuitry for managing operations of compounder system 10 may be included in electronics assembly 2803.

A vial tray and carousel drive assembly 2800 is also shown in which actuating door 2608 and a carousel hub 2814 can be seen. Carousel 14 may be placed onto carousel hub and rotated by vial tray and carousel drive assembly 2800 operating to rotate hub 2814 to move a selected cartridge in the carousel into position to be retrieved and operated by pump drive 20. Vial tray and carousel drive assembly 2800 may include separate drive assemblies for the vial tray and for the carousel such that vial tray 22 and carousel 14 may be rotated independently.

Figure 29:
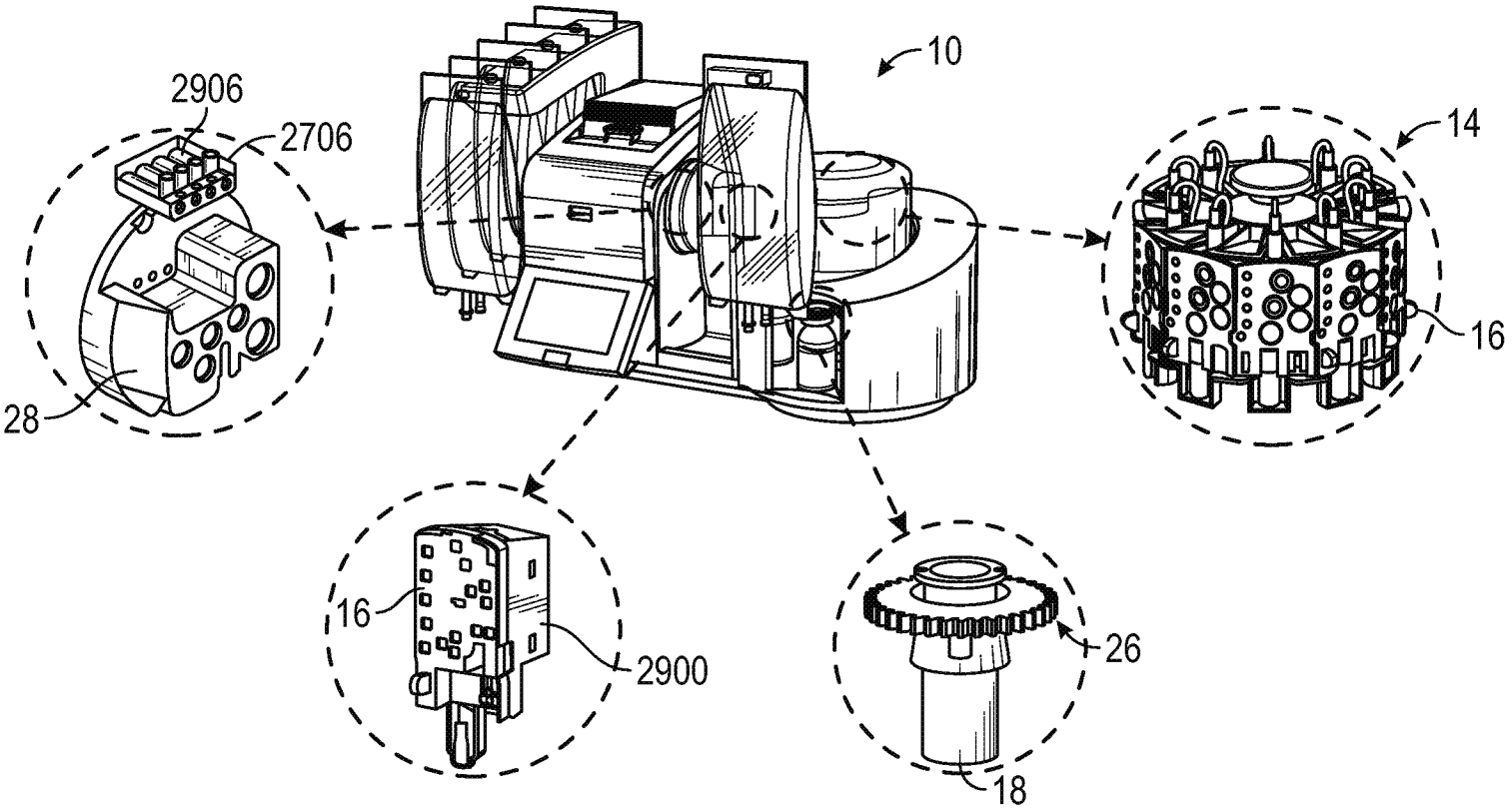
FIG. 29 illustrates a perspective view of the compounding system of FIG. 24 with various components shown in enlarged views for clarity in accordance with aspects of the present disclosure.
Figure 30:
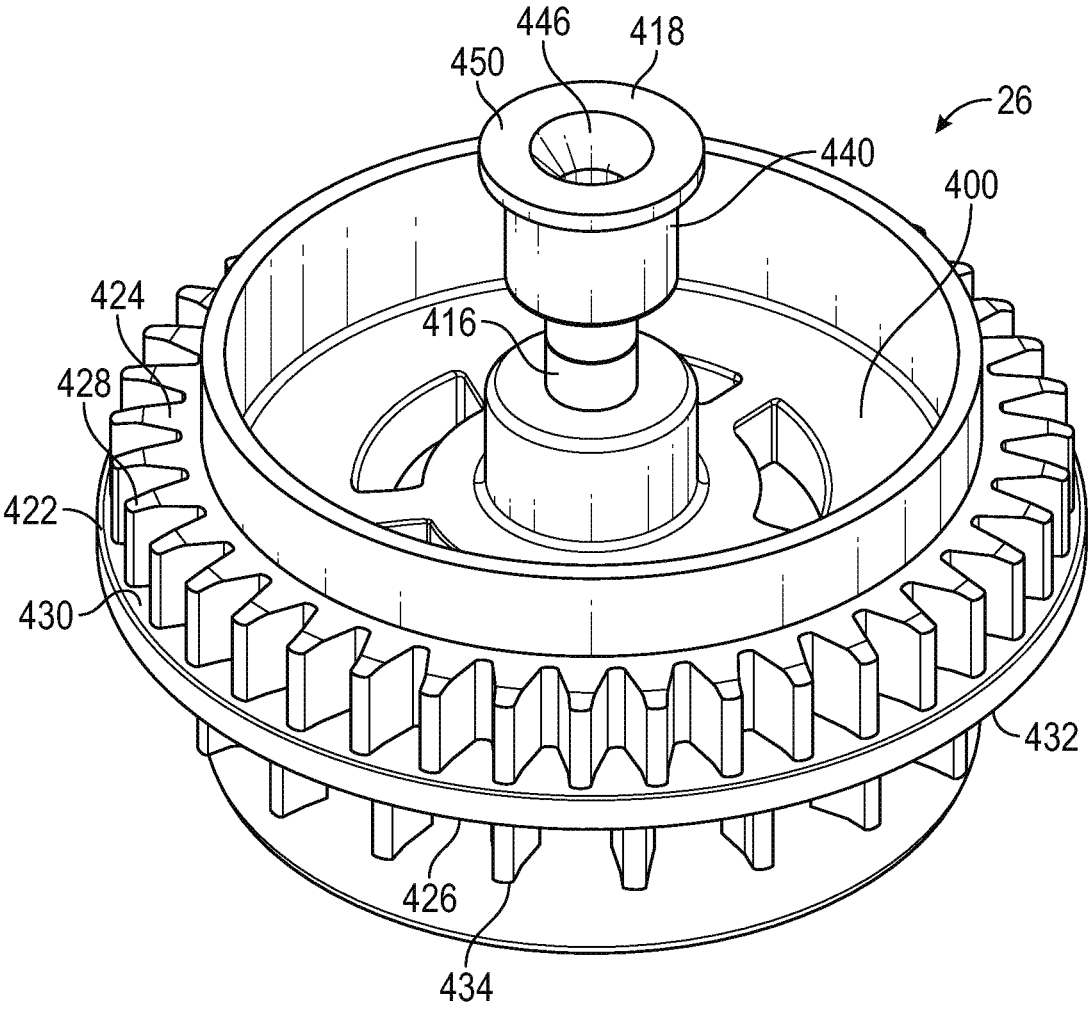
FIG. 30 illustrates a perspective view of an exemplary embodiment of a vial puck in accordance with aspects of the present disclosure.
Figure 31:
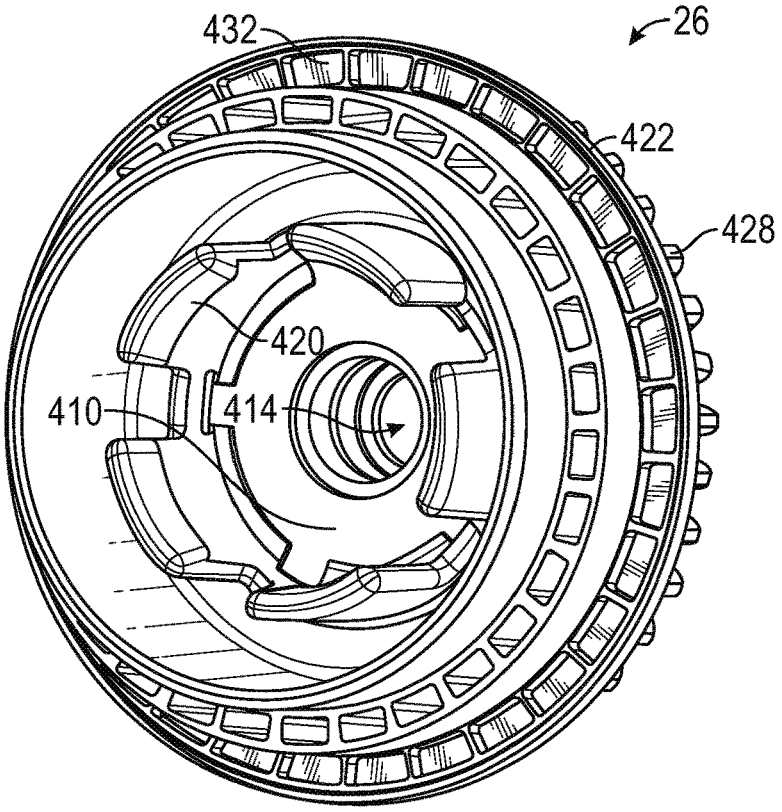
FIG. 31 illustrates a perspective view of the vial puck of FIG. 30 in accordance with aspects of the present disclosure.
Figure 32:
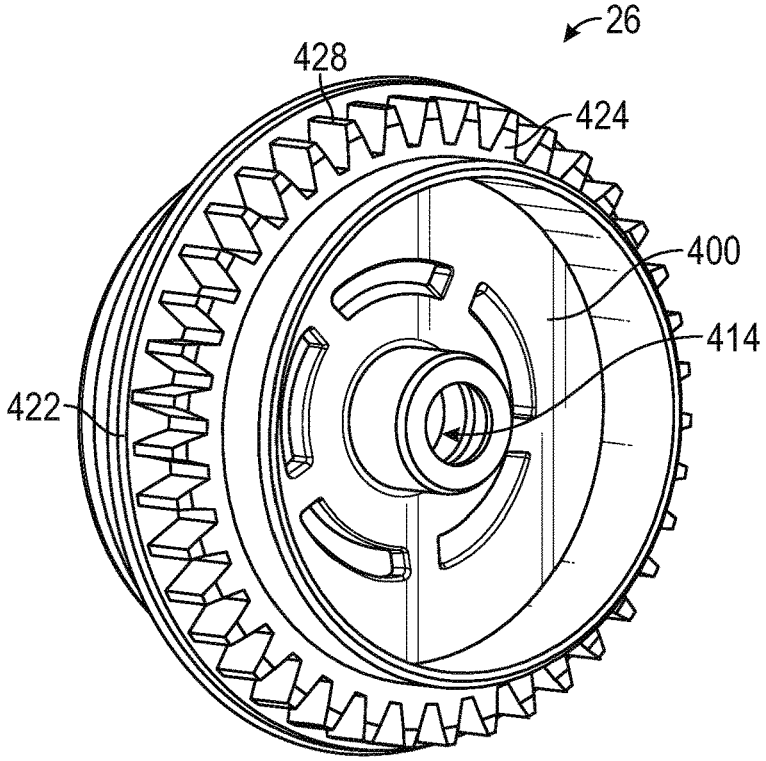
FIG. 32 illustrates a perspective view of the vial puck of FIG. 30 in accordance with aspects of the present disclosure.

FIG. 29 shows another perspective view of compounder 10 highlighting the locations of various particular components such as the carousel 14 with cartridges 16 mounted therein, a cartridge 16 having a backpack 2900, a vial puck 26 for mounting vials 18, and pump head assembly 28 with a diluent magazine 2706 containing a plurality of manifolds 2906 in accordance with an embodiment. Further features of the vial puck will be described hereinafter in connection with FIGS. 30-51.

Before a vial 18 is loaded into the compounder 10, a mating system in the form of a vial puck 26 may be attached to the vial in order to provide various structures with which the compounder can secure, move, and identify each vial 18.

The vial puck 26 accomplishes multiple objectives. First, it can be attached to a vial in advance of loading the vial 18 into the vial tray 22 of the compounder 10 and maintain a seal so that the drug in need of reconstitution maintains its sterility and effectiveness. Next, the design of the vial puck 26 is such that it can be attached to multiple sized vials 18. In this way, vials of differing size can be placed into uniform vial slots in the vial tray. Another feature of the vial puck 26 is that it provides a geared surface to interact with a mechanism (e.g., one or more gears 2704 coupled to motor 2602, see FIG. 27) in the compounder 10 to rotate it in order to scan the outside of the vial 18 for important drug and reconstitution information. The vial puck 26 is also drip free to prevent contamination of the surfaces of the compounder 10 during the reconstitution process. Further details of various vial puck features that provide the above-noted advantages are described in further detail hereinafter.

FIGS. 30-34 illustrate exemplary embodiments of the vial puck 26 and a corresponding second silicone tip 418 that is positioned on the needle assembly 170 of a cartridge 16. In the example of FIGS. 30-34, the vial puck 26 has a top surface 400, a bottom surface 410, a main body 412, an opening 414, a first silicone tip 416, a second silicone tip 418 attached to a needle assembly 170 of a cartridge 16, vial attachment flanges 420, an annular flange 422, a first gear 424, and a second gear 426.

Vial puck 26 may be formed from, for example, an injection molded plastic and may have a generally circular shape to match the shape of the calipers 76 of the compounder 10 and of a corresponding vial slot in vial tray 22. An annular flange 422 surrounds the main body 412. The first gear 424 is made up of teeth 428 and disposed on the top surface 430 of the annular flange 422. Flange 422 may be sized and shaped such that the flange is supported by a corresponding circular surface of the vial tray when installed in the compounder. The flange may allow the vial puck to rest in the vial slot while being rotated, for example, for reading of a label on the vial. The teeth 428 are illustrated as triangular, but they can take any shape that can provide a gripping surface for the calipers 76, the star wheel 22 and/or the puck rotation mechanism (e.g., one or more gears 2704 coupled to motor 2602). The second gear 426 is disposed on the bottom surface 432 of the annular flange 422. The second gear 426 is made up of teeth 434 that are illustrated as triangular, but they can take any shape that can provide a gripping surface for the calipers 76, the star wheel 22 and/or the puck rotation mechanism.

The top surface 400 of the vial puck 26 includes an extension extending upwards from the top surface 400. The extension includes an opening 414 defined therein. The bottom surface 410 of the vial puck 26 includes at least one mating feature, illustrated in, for example, FIGS. 31, 33, and 34 as a plurality of vial attachment flanges 420 that are shaped to grip the underside 438 of a vial cap 436 to hold the vial puck 26 in place on the vial 18. The vial attachment flanges 420 are capable of biasing outwards in order to slide over the vial cap 436 and snap into place on the bottom surface 438 of the vial cap 436.

A specialized first silicone tip 416 may be disposed in the opening 414 and substantially matches the shape of the opening 414 in order to create a vapor and liquid tight seal. The first silicone tip 416 creates a vapor and liquid tight seal between the first silicone tip 416 and the vial cap 436 due to a flange 452 that extends annularly from the main body 440 of the first silicone tip 416. When the vial puck 26 is attached to the vial cap 436, the flange is compressed between the underside 442 of the opening 414 and the top of the vial cap 436 when the attachment flanges 420 are snapped into place on the bottom surface 438 of the vial cap 436. This seal prevents any leakage during the filling and agitation processes of the compounder. The first silicone tip 416 has a passageway 446 defined therein to allow passage of the needles 316, 318 of a cartridge to enter the vial 18 after piercing the top surface 448 of the first silicone tip 416. The top surface 448 of the first silicone tip 416 is substantially flat and of a thickness to easily allow the needles 316, 318 to pierce it, but also to contract back to seal the vial 18 when the needles 316, 318 are removed.

Figure 35:
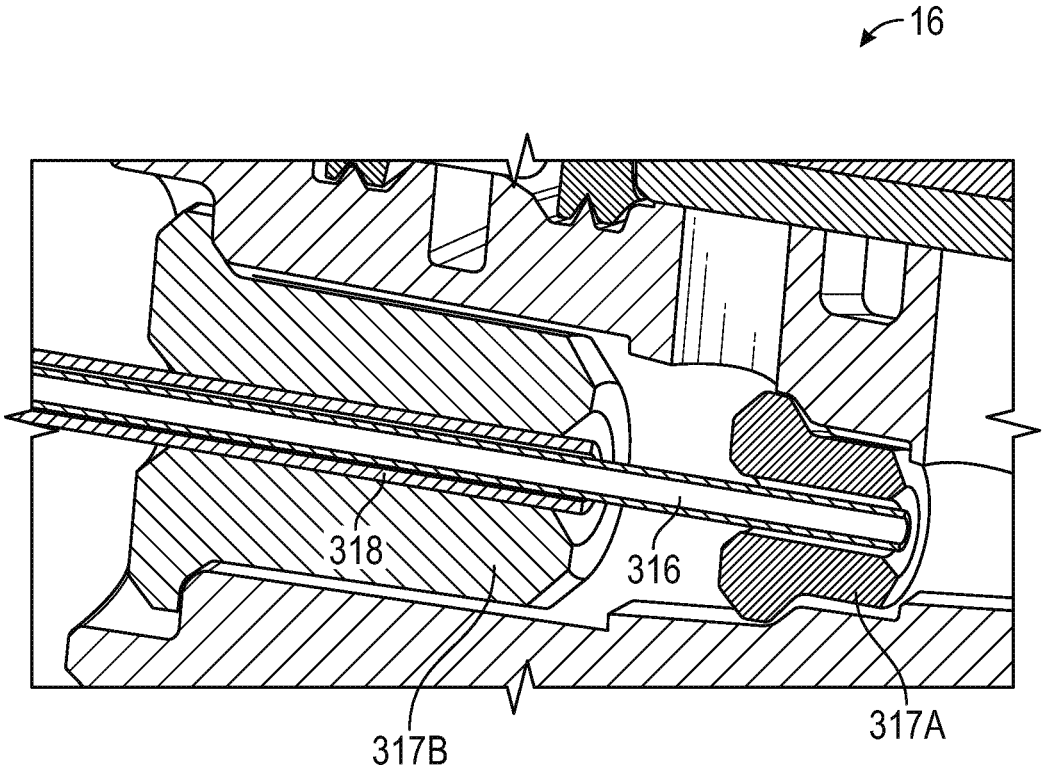
FIG. 35 illustrates a cross-sectional view of an exemplary embodiment of a needle assembly including a silicone mating cap in accordance with aspects of the present disclosure.

Referring to FIG. 35, a cross section of the needle assembly 170 of a cartridge 16 is illustrated according to one embodiment. As shown in FIG. 35, needles 316 and 318 may be secured within cartridge 16 by a corresponding needle housing 317*a* and second needle housing 317B. Second silicone tip 418 (see, e.g., FIG. 30) may be disposed on the end of the needles 316, 318 that is opposite the first needle housing 317A.

The second silicone tip 418 substantially matches the shape of the first silicone tip 416 that is attached to the vial puck 26. The function of the second silicone tip 418 is twofold. First, it acts as a safety mechanism to cover the end 444 of the needles 316, 318 before they are extended into the vial 18. Second, when the top surface 450 of the second silicone tip 418 is pressed against the top surface 448 of the first silicone tip 416, it creates a seal that allows the needles 316, 318 to pierce both the first 416 and the second 418 silicone tips without leakage of vapor or liquid. Furthermore, when the needle is removed from the vial 18, the two silicone tips 416, 418 have a squeegee or wiping effect on the needles 316, 318, which prevents dripping when the needles 316, 318 are removed. Second silicone tip 416 may be disposed in a needle housing of cartridge 16 within which the end of the needles is disposed when no vial puck is pressed against the needle housing to prevent injury to an operator handling the cartridge.

Figure 14:
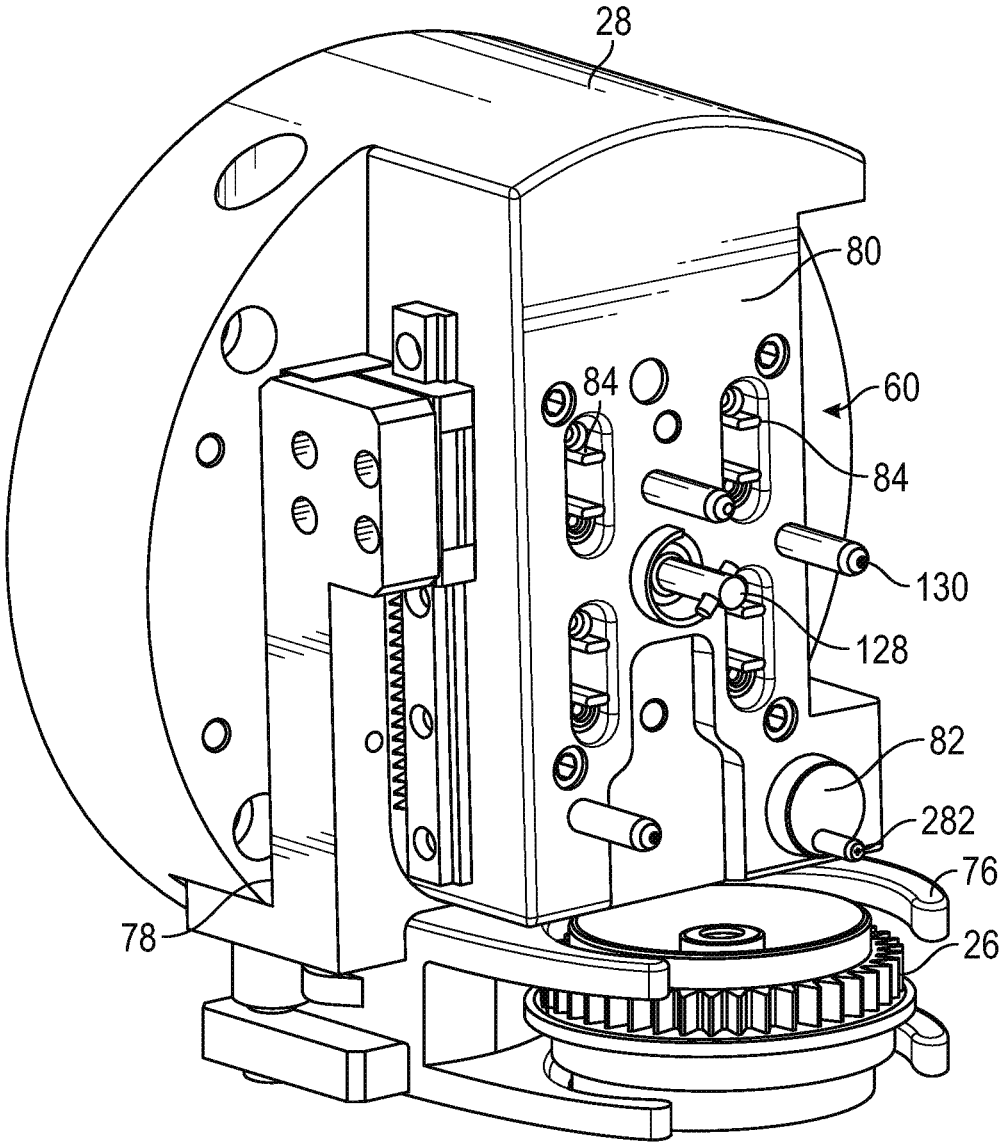
FIG. 14 illustrates a perspective view of the pump head assembly, gripping system and vial puck of FIG. 13 in accordance with aspects of the present disclosure.
Figure 15:
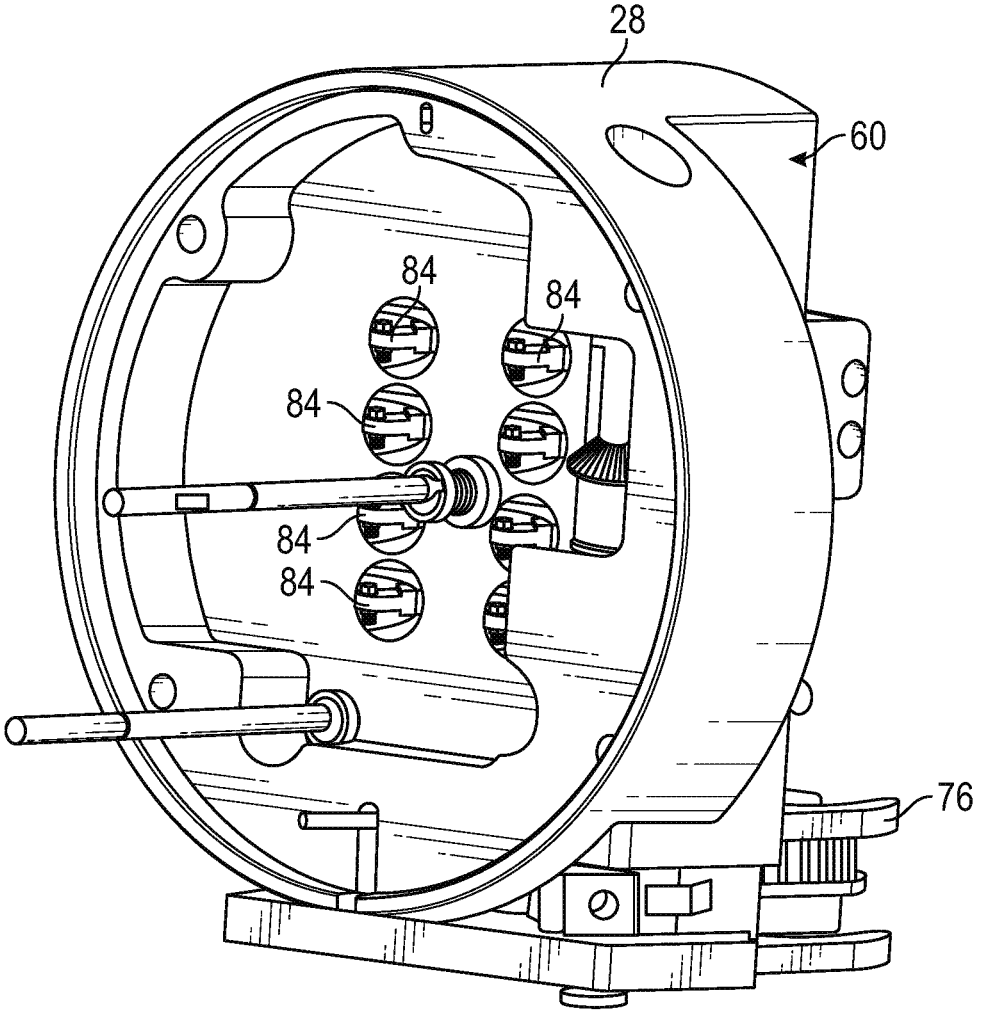
FIG. 15 illustrates a rear perspective view of the pump head assembly, gripping system and vial puck of FIG. 13 in accordance with aspects of the present disclosure.
Figure 16:
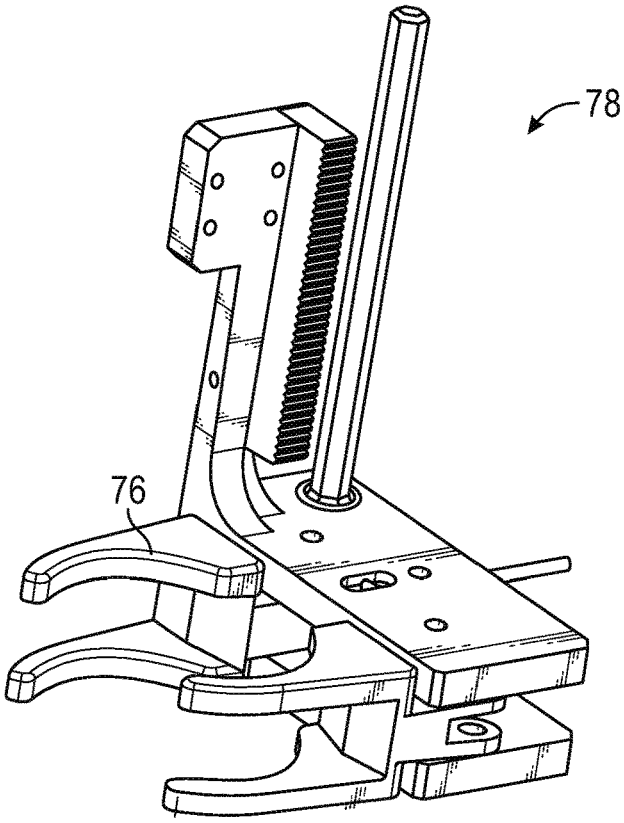
FIG. 16 illustrates a perspective view of an exemplary embodiment of a gripping system in accordance with aspects of the present disclosure.
Figure 17:
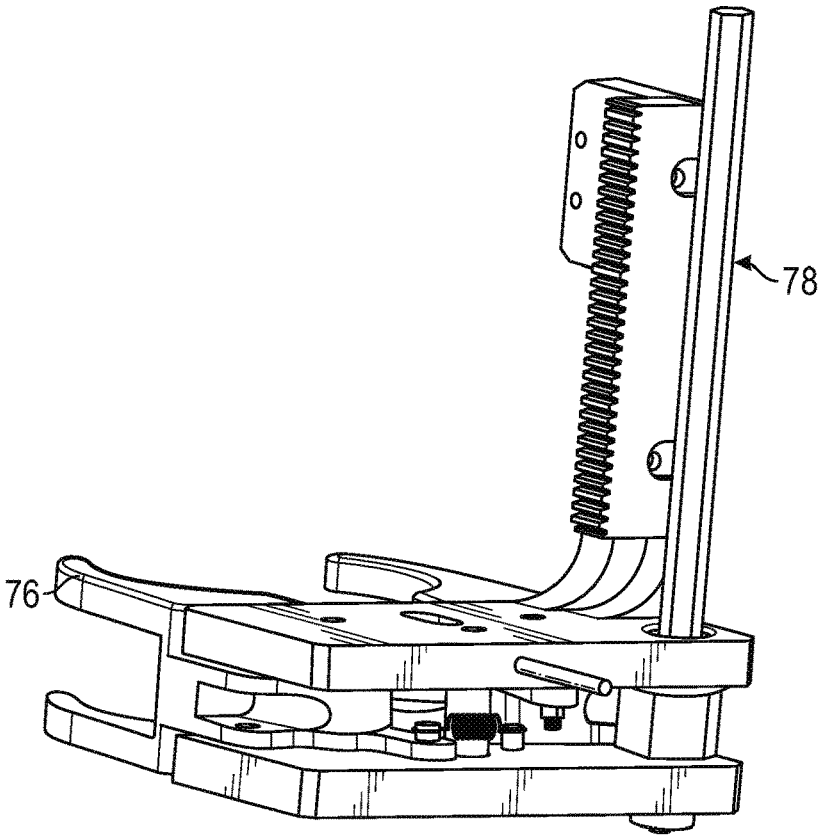
FIG. 17 illustrates a rear perspective view of the gripping system of FIG. 16 in accordance with aspects of the present disclosure.
Figure 18:
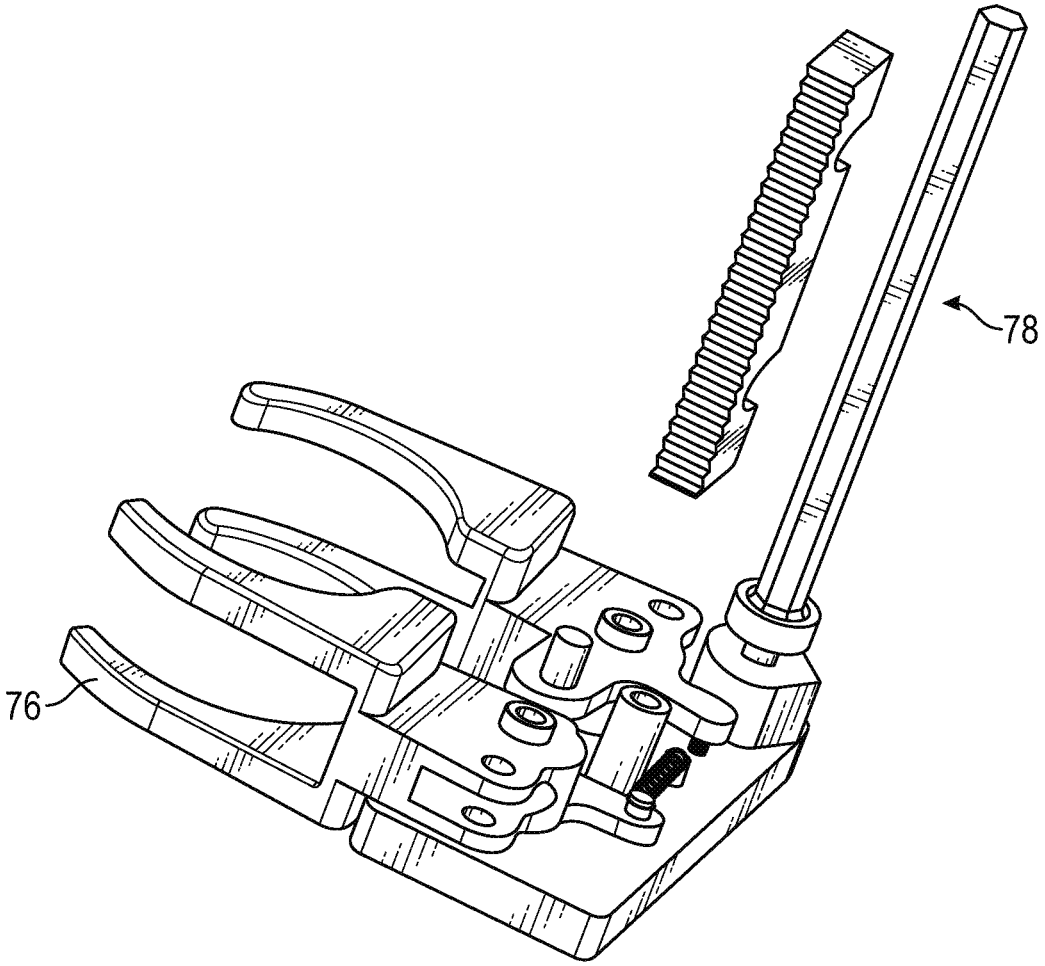
FIG. 18 illustrates a side perspective view of the gripping system of FIG. 16 in accordance with aspects of the present disclosure.
Figure 19:
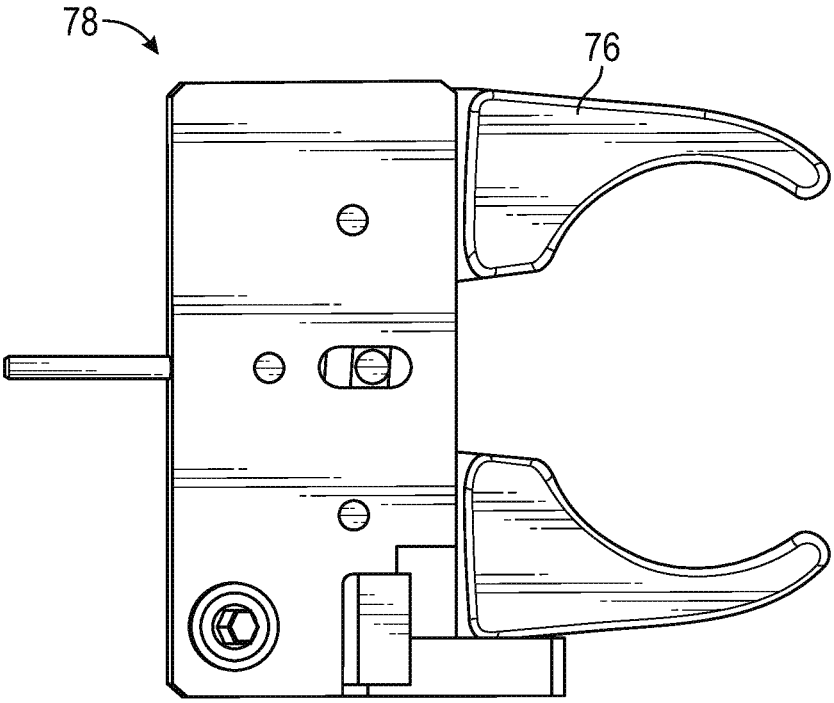
FIG. 19 illustrates a top plan view of the gripping system of FIG. 16 in accordance with aspects of the present disclosure.
Figure 20:
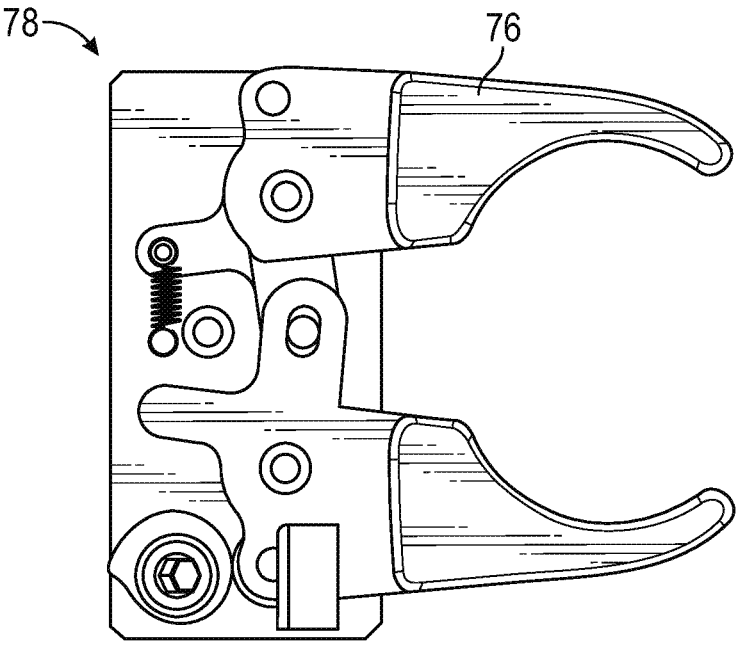
FIG. 20 illustrates a top plan view of the gripping system of FIG. 16 in accordance with aspects of the present disclosure.
Figure 33:
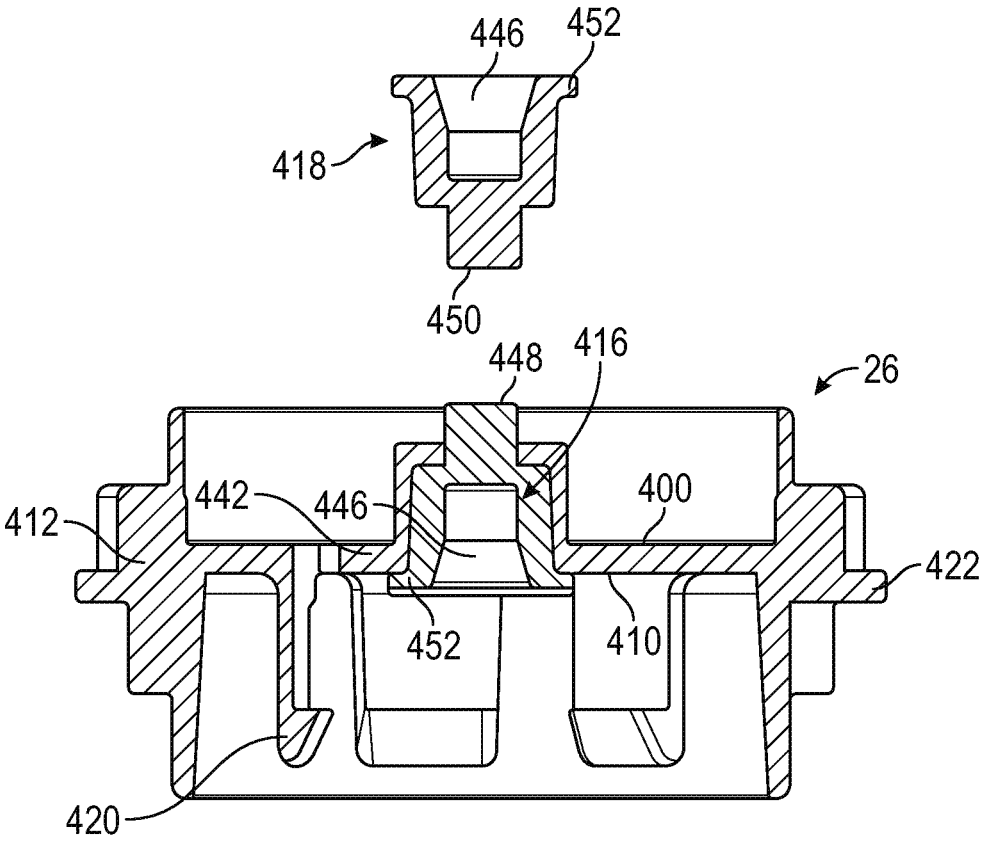
FIG. 33 illustrates a cross-sectional view of the vial puck of FIG. 30 in accordance with aspects of the present disclosure.
Figure 34:
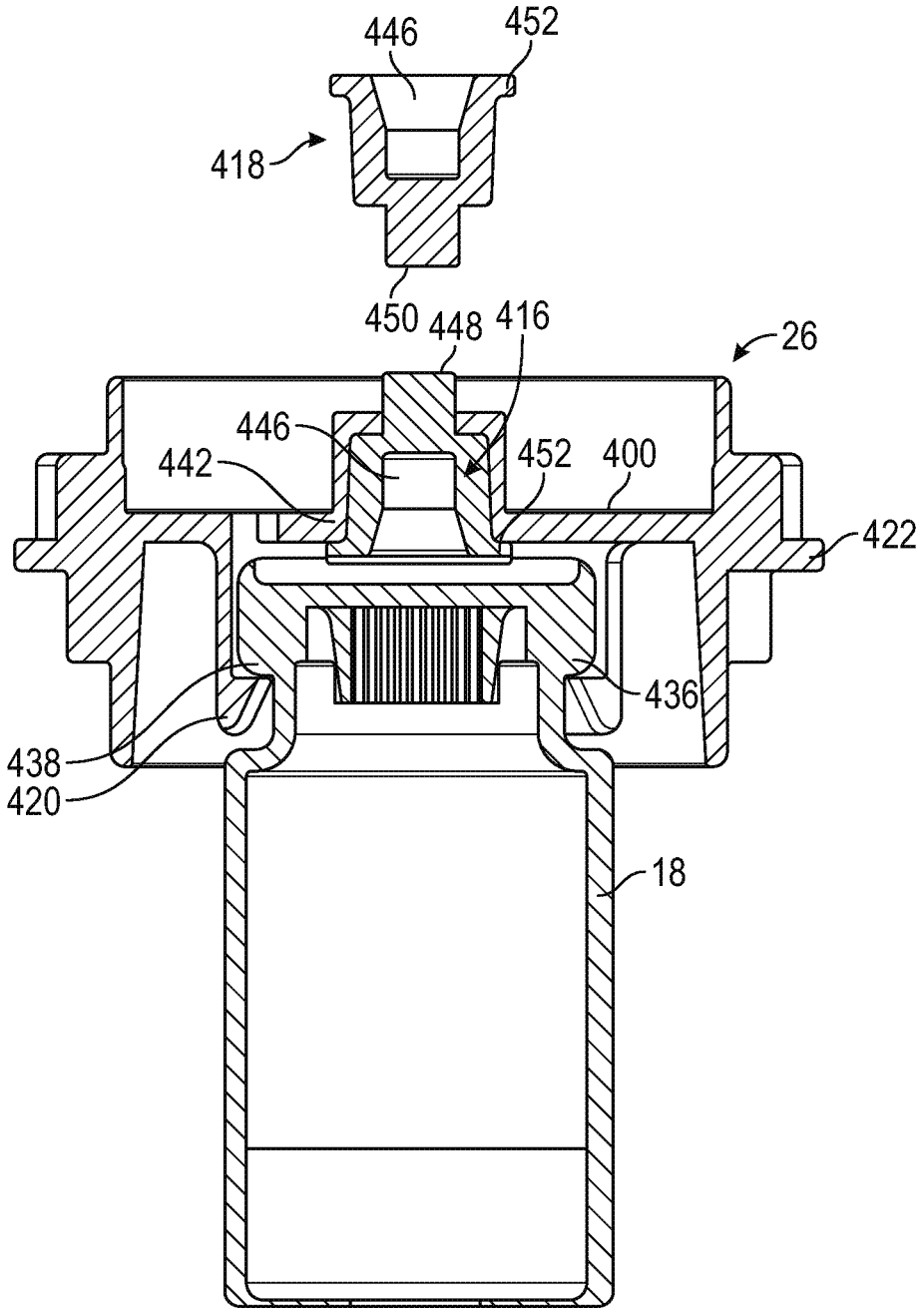
FIG. 34 illustrates a cross-sectional view of the vial puck of FIG. 30 attached to a vial in accordance with aspects of the present disclosure.

In operation, the vial puck 26 is attached to the vial cap 436 before insertion into the vial tray 22 of the compounder 10. The vial 18 is shown in the vial tray 22 in, for example, FIGS. 2 and 24. FIG. 33 illustrates a cross-sectional view of the vial puck 26 attached to a vial according to one embodiment. The vial tray 22 rotates the vial 18 into position so that a vial rotation mechanism (e.g., one or more gears 2704 coupled to motor 2602) can connect with the gears 424 and/or 426 on the vial puck 26 and rotate the vial 18 to scan information imprinted on the outside of the vial 18. Next, the vial grip 76 of the compounder 10 grips (grasps) the vial puck 26 as shown in FIG. 14. The vial grip 76 and vial lift 78 pull the vial 18 up into contact with the needle housing 168 on the cartridge 16 such that the bottom surface of the needle housing 168 contacts the top surface 400 of the vial puck 26 and the needle assembly 170 is extended such that the first 416 and second 418 silicone tips are pressed together and the needles 316, 318 pierce the tips 416, 418 and enter the vial 18. The vial puck 26 maintains a vapor and liquid tight seal throughout the reconstitution process described above.

Figure 36:
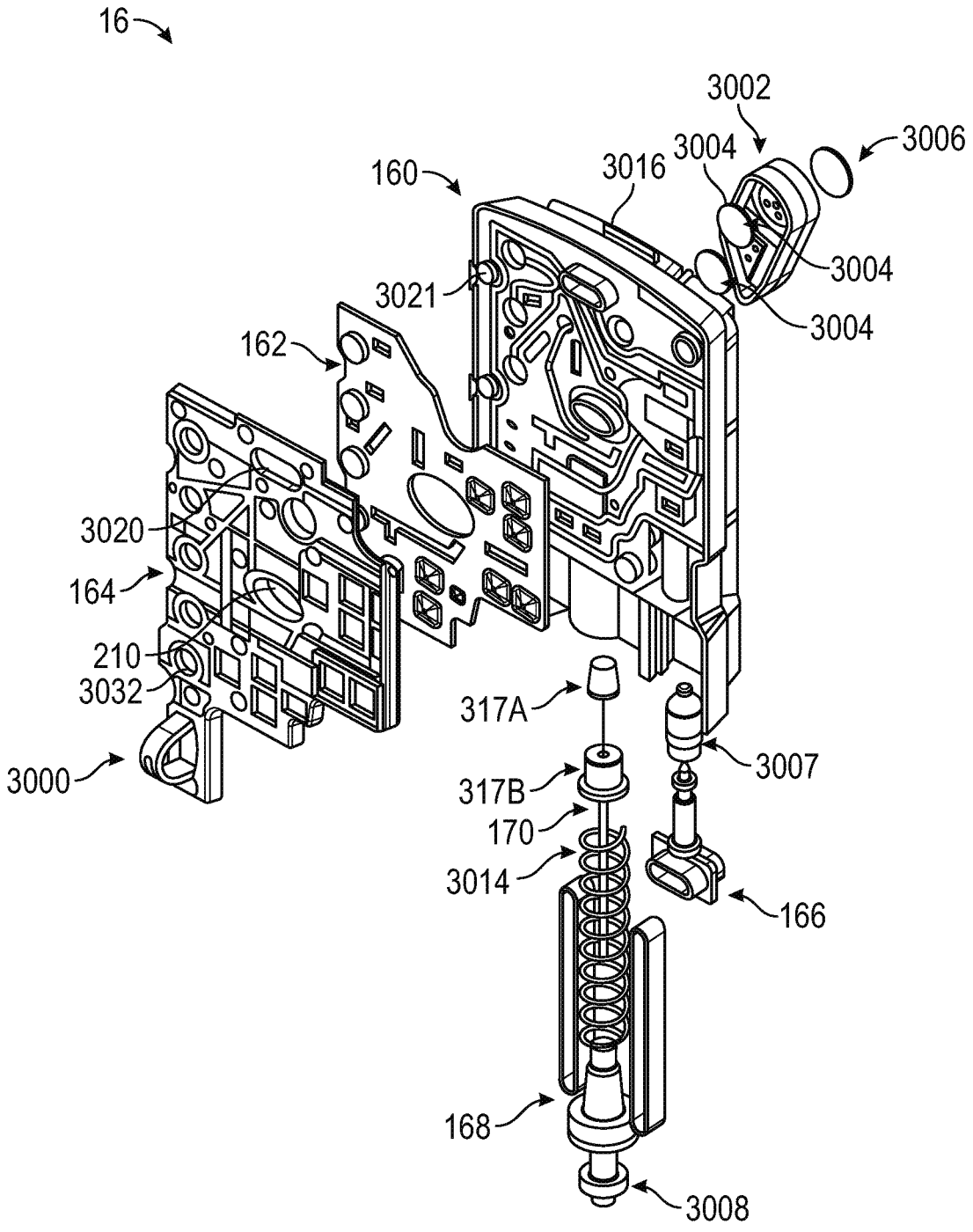
FIG. 36 illustrates an exploded perspective view of another embodiment of a pump cartridge in accordance with aspects of the present disclosure.

Turning now to FIG. 36, an exploded perspective view of another embodiment of cartridge 16 shows the three main portions of the cartridge 16: the cartridge frame 160, the cartridge sealing membrane 162, the cartridge bezel 164, as well as the piston pump 166, the needle housing 168 and the needle assembly 170. In the example of FIG. 36, cartridge bezel 164 includes an additional opening 3022 to provide access to a pressure dome formed on membrane 162 to allow sensing of pressure in the fluid pathways of cartridge 16. An air-in-line sensor fitment 3000 is also provided that is configured to mate with an air-in-line (AIL) sensor in the compounder.

In order to control the flow of gasses such as vapor waste and sterile air within the cartridge, cartridge 16 may be provided with gas flow control structures such as an air filter 3006 and one or more check valve discs 3004 that mount to frame 160 with a check valve cover 3002. Air filter 3006, check valve discs 3004, and check valve cover 3002 may cooperate to allow vapor waste to flow in only one direction from the vial to the waste port and to allow sterile (filtered) air to flow in only one direction from a vent adjacent the air filter to the vial.

As shown in FIG. 36, piston 166 may include a piston boot 3007 that, for example, provides a moveable seal for controlling the volume of a pump chamber when piston 166 is actuated. FIG. 36 also shows various structures for control of another embodiment of needle housing 168 in which needle assembly 170 includes a dual lumen needle with a first needle overmold 317A, a second needle overmold 317B, a needle spring 3014, and a needle membrane 3008. An opening 3020 in bezel 164 may be provided that aligns with a corresponding opening 3021 in frame 160 to allow a view through cartridge 16 (e.g., by a sensor of the pump drive mechanism) into a backpack that is mounted to cartridge 16 as will be described in further detail hereinafter. A protrusion 3016 formed on a top side of cartridge frame 160 may be provided as a mounting structure for the backpack.

Figure 37B:
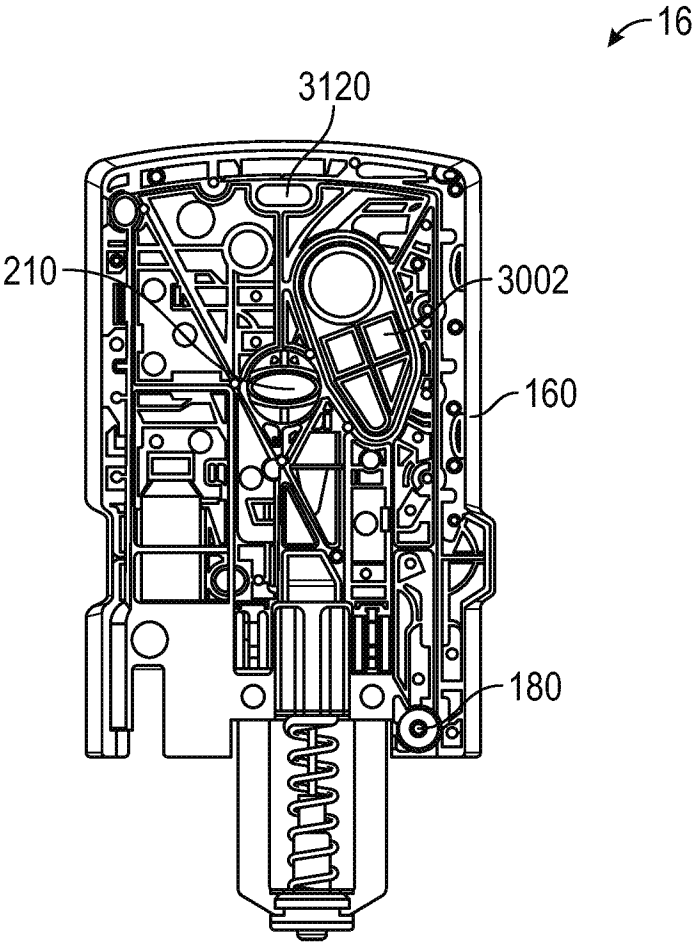
FIG. 37B illustrates a front plan view of the cartridge of FIG. 36 in accordance with aspects of the present disclosure.
Figure 37A:
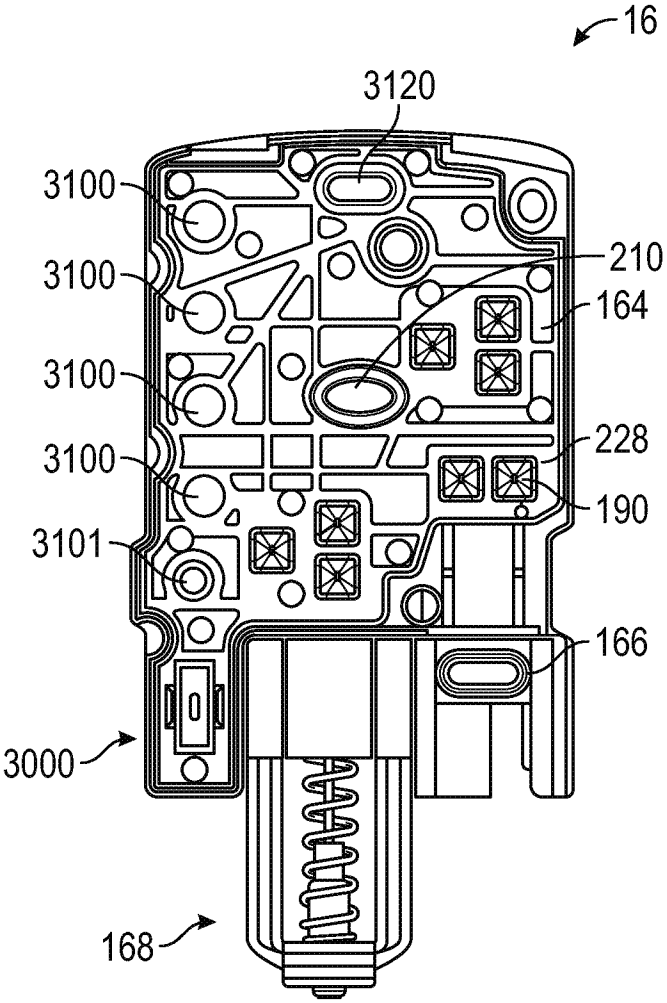
FIG. 37A illustrates a rear plan view of the cartridge of FIG. 36 in accordance with aspects of the present disclosure.

FIGS. 37A and 37B show assembled views of the cartridge embodiment shown in FIG. 36 from the bezel side and frame side respectively in which an opening 3120 (formed by openings 3020 and 3021 of FIG. 36) that allows a view completely through cartridge 16 can be seen. As shown in FIG. 37A, in some embodiments, cartridge 16 may include four diluent and waste ports 3100 and a pressure dome 3101. Output port 180 for coupling to a receiving container is also shown.

Figure 38:
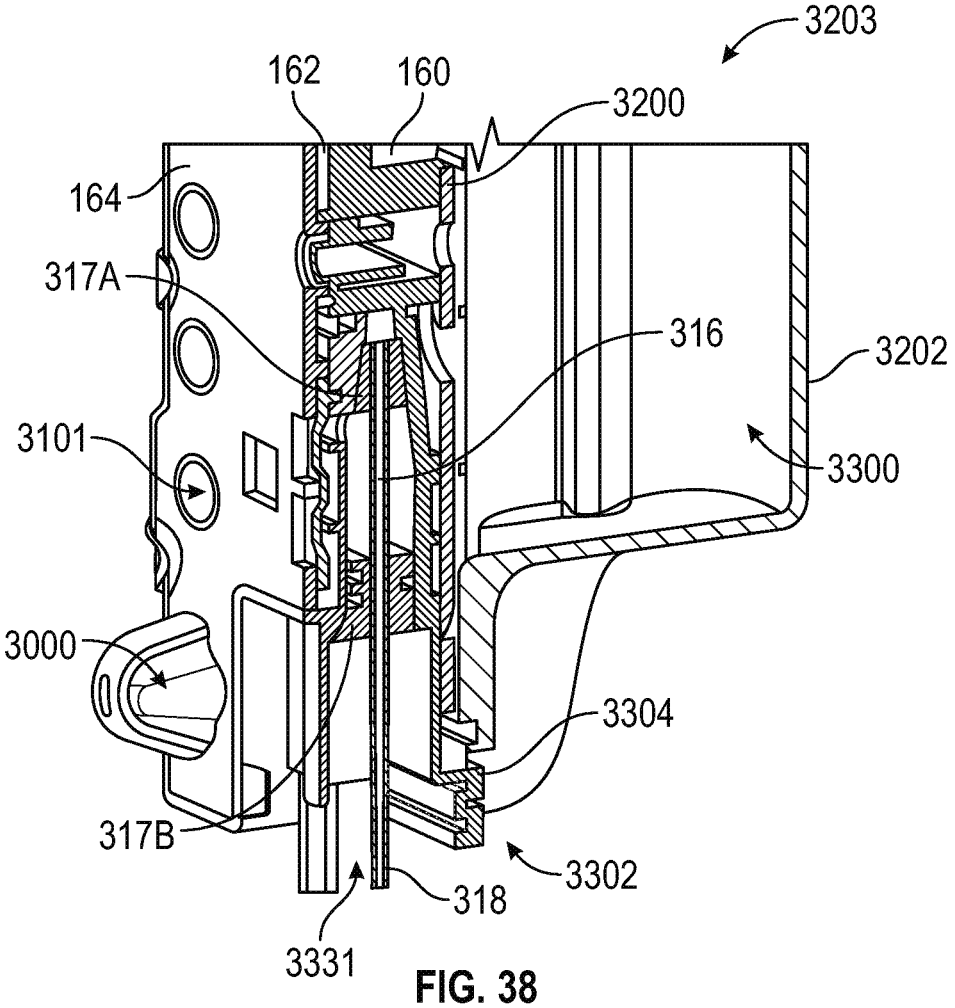
FIG. 38 illustrates a cross-sectional view of a portion of the cartridge of FIG. 36 taken through a needle housing in accordance with aspects of the present disclosure.
Figure 39:
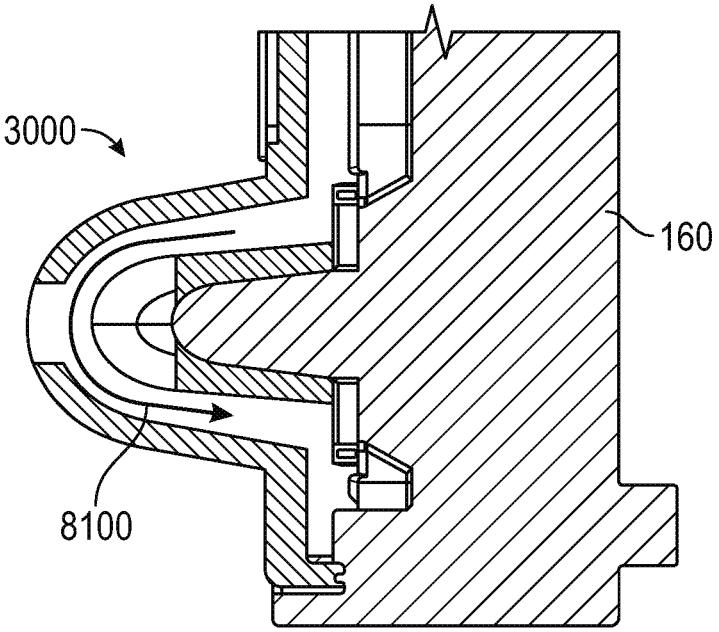
FIG. 39 illustrates a cross-sectional view of a portion of the cartridge of FIG. 36 taken through an air-in-line fitment in accordance with aspects of the present disclosure.

FIG. 38 is an enlarged cross sectional perspective side view of a portion of a cartridge and backpack assembly 3203 in which an internal cavity 3300 and bottom side latching features 3302 of backpack 3202 can be seen. Backpack 3202 may be attached to cartridge 16 to form a cartridge and backpack assembly. As shown, a protruding portion 3304 of cartridge frame 160 can extend perpendicularly from the frame and between latching features 3302 of backpack 3202 (e.g., through an opening in backpack 3202) to secure the backpack to cartridge 16 at the bottom side. Needle housings 317A and 317B are also shown disposed in a needle cavity 3331 in cartridge frame 160 respectively securing needles 316 and 318. An additional structure 3200 may be disposed between backpack 3202 and cartridge 16. Structure 3200 may be substantially planar and may be shaped and positioned to latch cartridge and backpack assembly 3203 to carousel 14. FIG. 39 is an enlarged cross-sectional side view of air-in-line sensor fitment 3000 showing how a flow path 8100 may be provided in the fitment that can be viewed and/or monitored by an air-in-line sensor in pump head assembly 28.

Figure 40:
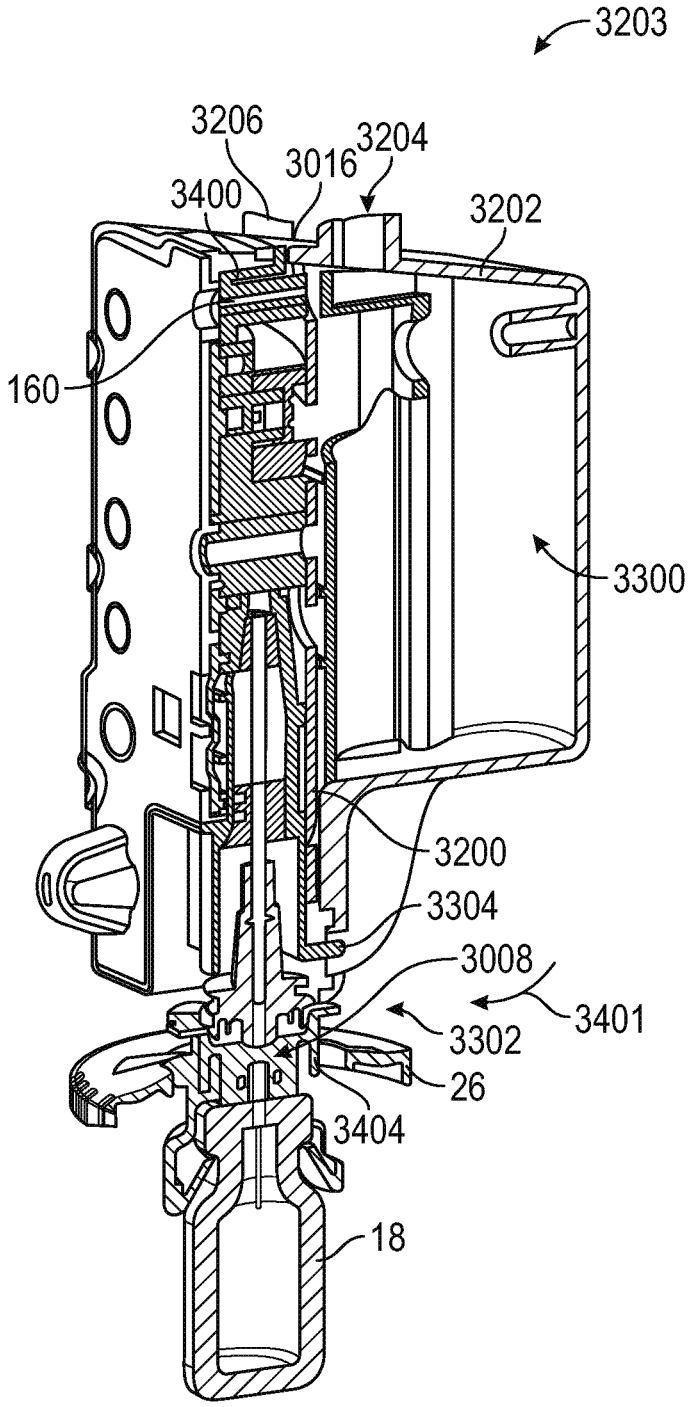
FIG. 40 illustrates a cross-sectional perspective view of the cartridge of FIG. 36 disposed adjacent a vial in accordance with aspects of the present disclosure.

FIG. 40 is cross-sectional perspective side view of cartridge and backpack assembly 3203 in which protrusion 3016 and protrusion 3304 of cartridge frame 160 can be seen cooperating to couple cartridge 16 to backpack 3202 to form cartridge and backpack assembly 3203. To install backpack 3202 onto cartridge 16, an opening of backpack 3202 can be positioned over protrusion 3016 and backpack 3202 can be rotated (e.g., in a direction 3401) to push latching features 3302 of backpack 3202 against latching protrusion 3304 until latching protrusion 3304 snaps into position between latching features 3302. As shown, protrusion 3016 may be formed on a flexible arm 3400. Flexible arm 3400 may allow backpack 3202 to be pulled downward by a small distance when backpack 3202 is rotated to press latching feature 3302 onto protrusion 3304. Flexible arm 3400 may be resilient to maintain an upward force the holds latching features 3302 in a latched position against protrusion 3304.

An opening 3204 is also shown in which a connector such as a Texium® connector can be stored, the connector coupled to tubing that runs from an outlet port of the cartridge through tube management structures of the backpack and to a receiving container to provide reconstituted drug from the vial to the receiving container. One or more protrusions 3206 may extend through a top surface of the backpack and may be retractable by deformation of structure 3200 to withdraw the protrusion 3206 from a recess in carousel 14 to release assembly 3203 from the carousel.

In the example of FIG. 40, a vial 18 and vial puck 26 are positioned adjacent to cartridge and backpack assembly 3203 with needle assembly 170 extended into the vial through sealing member 3008 of cartridge 16 and sealing member 3404 of vial puck 26 which, when pressed together as shown may provide a drip free seal and allow fluid to be provided into and/or removed from vial 18 (e.g., by fluidly coupling the vial 18 to one or more controllable fluid pathways of cartridge 16 via the needle assembly 170). As shown, when the needle assembly 170 is extended into the vial, portions of the vial puck 26 may be located adjacent to latching features 3302 of backpack 3202. Vial puck 26 and vial 18 may be grasped by vial grasping calipers 76 and lifted from vial tray 22 into the position shown in FIG. 40 by vial lift 78. Calipers 76 and vial lift 78 may lift vial puck 26 such that the vial puck compresses needle housing 168 to lift seals 3008 and 3404 onto the needle assembly.

When compressed together, seals 3008 and 3404 create a dry connection between the cartridge and the vial. The needle assembly can extend through seals 3008 and 3404 to form fluid and/or vapor paths between the cartridge and the vial for reconstitution and compounding operations. Seals 3008 and/or 3404 may be compressed (e.g., compressed by 10% radially) within their respective housings to cause a wiping effect on the needle assembly so that when the vial puck and vial are removed (e.g., lowered), the needle assembly is wiped by seals 3008 and 3404 and no liquid is left on the needle assembly or the outer surfaces of the seals.

Figure 41:
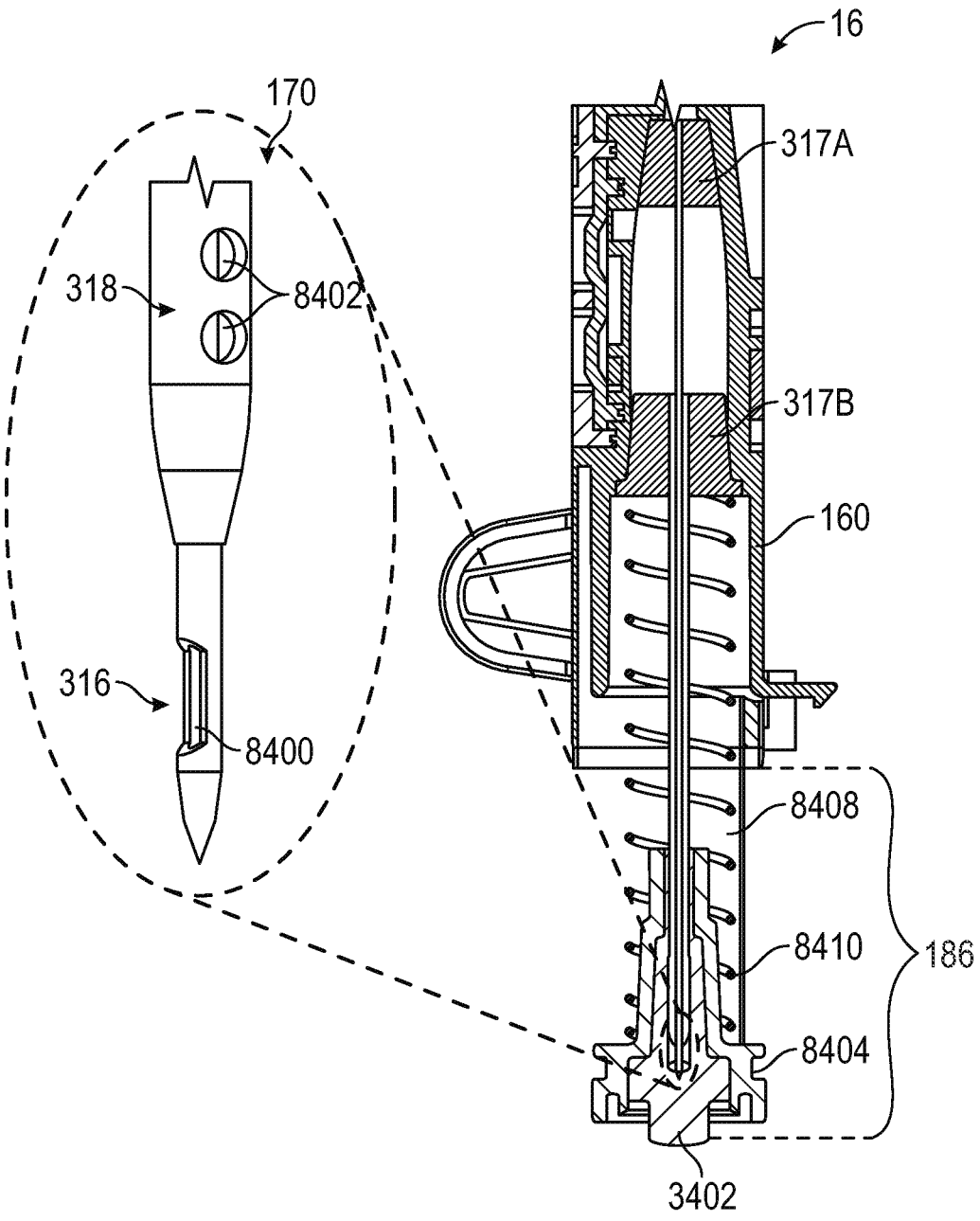
FIG. 41 illustrates a cross-sectional side view of a portion of the cartridge of FIG. 36 in the vicinity of a dual lumen needle in accordance with aspects of the present disclosure.

FIG. 41 shows a cross-sectional view of a portion of cartridge 16 along with an enlarged view of a portion of needle assembly 170. As shown in FIG. 41, needle housing 186 may include a sealing membrane 3008 formed within an annular housing member 8404 that is attached to cartridge frame 160 via one or more housing arms 8408. A spring 8410 may be provided that extends from needle housing 317B into needle housing 186 such that compression of spring 8410 is necessary to extend needles 316 and 318 through sealing membrane 3008. In this way, a user handling cartridge 16 is prevented from being injured by access to needle assembly 170. In operation, a vial puck 26 may be pressed against annular housing member 8404 to compress spring 8410 such that needle assembly 170 extends through sealing membrane 3008 and through a sealing membrane 3404 of the vial puck 26 into the vial.

Dual lumen needles 316 and 318 may be respectively provided with openings 8400 and 8402 that provide fluid access to central bores of the needles. Needle 316 may, for example, be a 24 gauge needle held in cartridge frame 160 by a high density polyethylene (HDPE) overmold 317A, the needle having an opening 8400 for venting the drug vial. Opening 8400 may be formed using a slot cut as shown to reduce coring of the sealing membranes as the needle is inserted and retracted. Needle 318 may, for example, be an 18 gauge needle held in cartridge frame 160 by a high density polyethylene (HDPE) overmold 317B, the needle having one or more openings 8402 for fluid flow into and/or out of the vial. Openings 8402 may include two drilled holes configured to reduce coring and to allow up to, for example, 60 mL/min of fluid flow.

In this way, during reconstitution operations, diluent may be provided into the vial via openings 8402 of needle 318 and vapor waste may be simultaneously extracted from the vial via opening 8400 in needle 316. During compounding operations, a reconstituted drug may be pulled from the vial via openings 8402 of needle 318 and sterile air may be provided into the vial via opening 8400 of needle 316.

Figure 42:
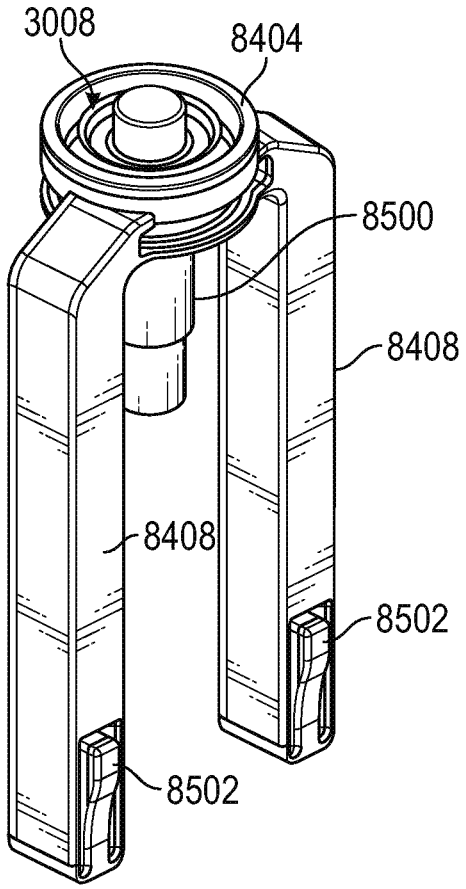
FIG. 42 illustrates a perspective view of a needle housing member of the cartridge of FIG. 36 in accordance with aspects of the present disclosure.

FIG. 42 shows an inverted perspective view of annular housing member 8404 and housing arms 8408 showing how housing members 8404 and 8408 may be formed from an integral structure that houses sealing membrane 3008. A needle guide structure 8500 may extend from annular housing member 8404 between arms 8408. Engagement features such as compressible snap features 8502 may be provided on arms 8408 for securing arms 8408 within cartridge frame 160.

Figure 43:
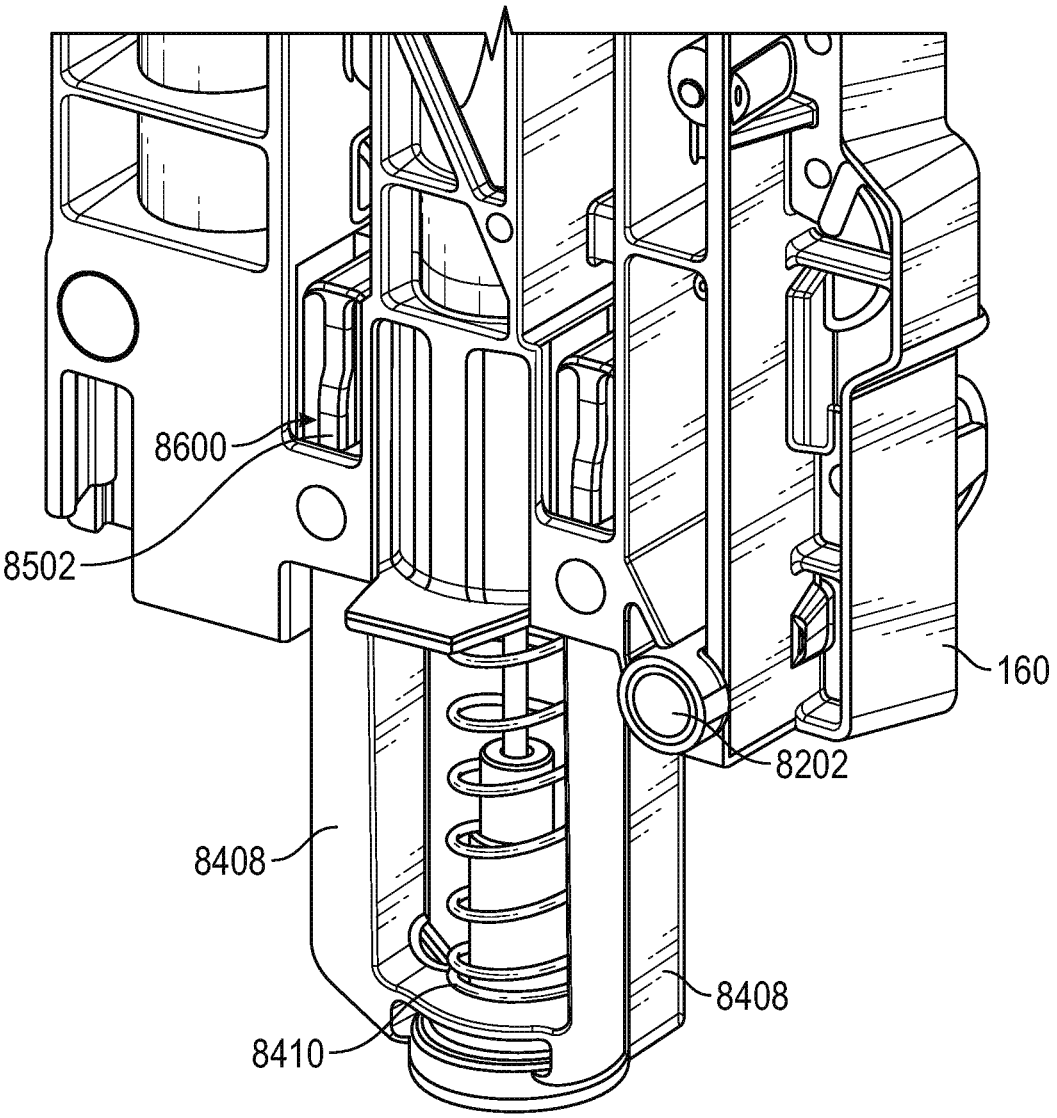
FIG. 43 illustrates a perspective view of a portion of the cartridge of FIG. 36 in the vicinity of the needle housing in accordance with aspects of the present disclosure.
Figure 44:
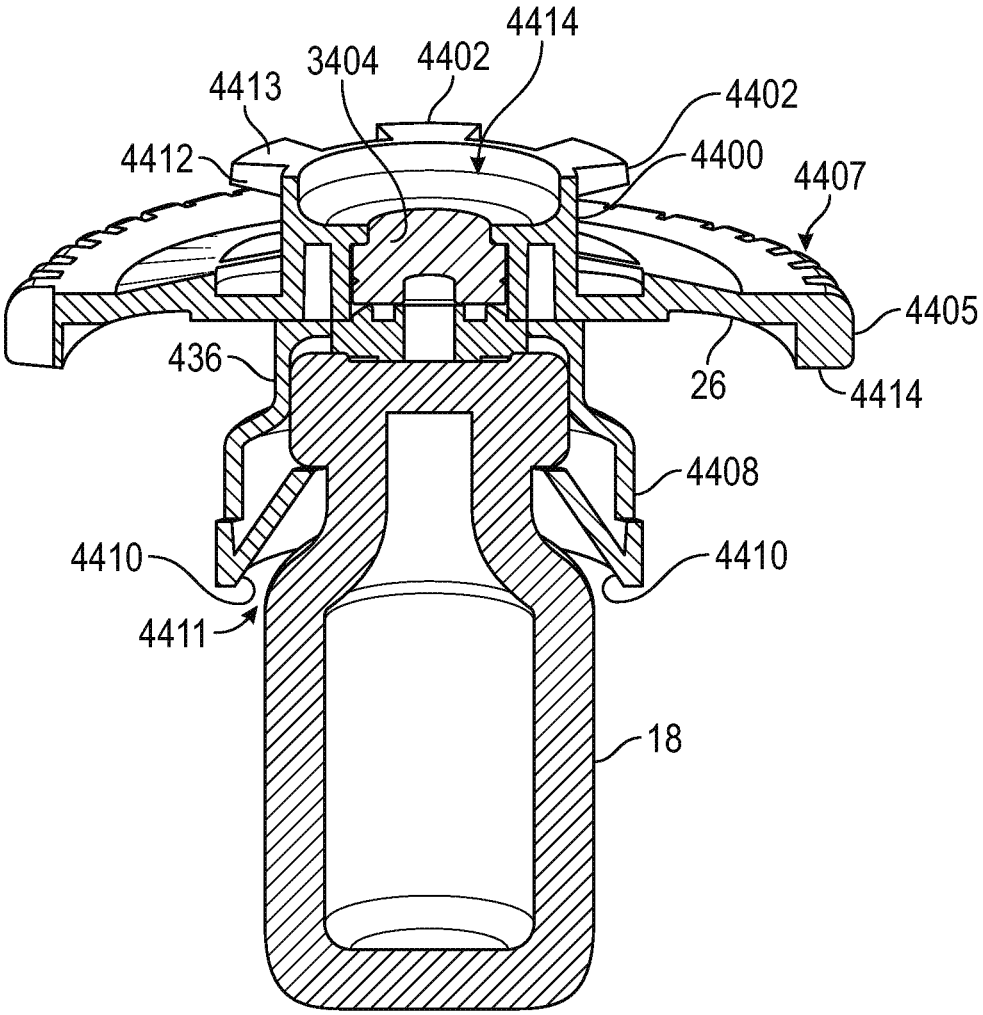
FIG. 44 illustrates a cross-sectional view of a vial puck attached to a vial in accordance with aspects of the present disclosure.
Figure 45:
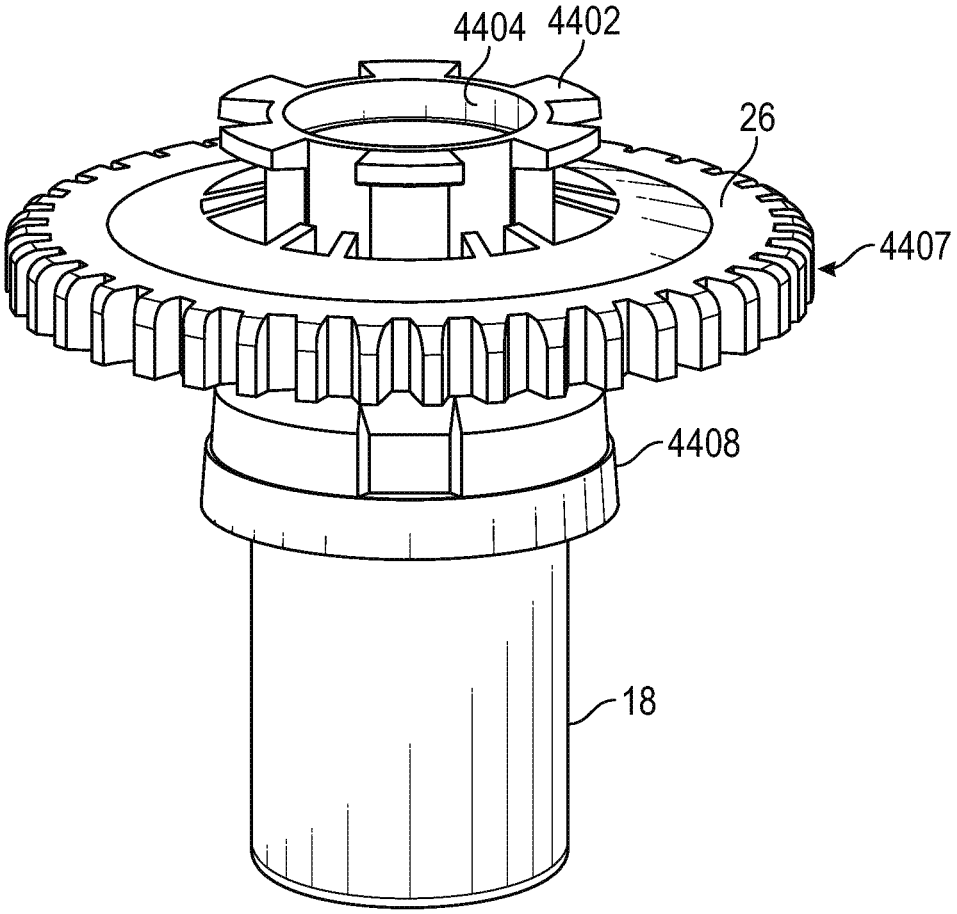
FIG. 45 illustrates a perspective top view of a vial puck attached to a vial in accordance with aspects of the present disclosure.

FIG. 43 shows arms 8408 disposed partially within and extending from cartridge frame 160. As shown, snap features 8502 are engaged with a ledge 8600 on cartridge frame 160 with spring 8410 fully extended such that needle assembly 170 is contained completely within the needle housing assembly.

FIGS. 44-49 illustrate another exemplary embodiment of the vial puck 26. In the example of FIGS. 44-49, the vial puck 26 includes a substantially cylindrical central portion 4400, a plurality of lateral extensions 4402 protruding substantially perpendicularly from the top of the central portion 4400, a substantially circular gear 4405 having teeth 4407 extending around a periphery of the central portion 4400 below the top protrusions 4402, a sealing member 3404, and a lower extension 4408 extending from the bottom of cylindrical central portion 4400. Gear 4405, cylindrical central portion 4400, lateral extensions 4402, and sealing member 3404 may for a top portion of vial puck 26 that is attached to a lower portion of the vial puck formed by lower extension 4408 in one or more embodiments.

A recess 4404 may be provided in cylindrical central portion 4400 into which the annular housing member 8404 of cartridge 16 may be extended so that sealing member 3008 of needle housing 168 may be compressed against sealing member 3404 disposed within central portion 4400. Recess 4404 may be provided with a geometry that guides the needle housing to properly position the needle assembly over sealing member 3404. Vial calipers 76 may contact a lower surface 4412 of protrusions 4402 to grasp the vial puck and vial for lifting of the vial out of the vial tray and into position for compounding operations. Calipers 76 may engage lower surface 4412 and upper surface 4413 of extensions 4402 in addition to central portion 4400 between extensions 4402 and gear 4405 to allow for stability during vial agitation including, for example, complete inversion of vial 18.

Gear 4405 may be configured to seat within one of vial puck recesses 2604 of vial tray 22. For example, gear 4405 may have a lower surface 4414 configured to rest against a corresponding surface of vial tray 22 in the vial puck recess 2604 when the vial puck and vial are inserted into the compounder system 10. Gear teeth 4407 may be arranged to engage with corresponding gear teeth on a corresponding gear 2704 coupled to a motor 2602 for rotating vial 18 for label imaging operations or other positioning operations for vial 18. Although the gear teeth 4407 are shown on an outer surface of puck 26, in another embodiment, the gear teeth could be alternatively formed within an interior recess in gear 4405 so that a corresponding gear could be lowered into the recess to engage the teeth for rotating the vial.

When vial 18 is rotated using gear 4405, the bottom surface 4414 of gear 4405 may remain in sliding contact with the surface of vial tray 22 to support and position the vial while the vial is rotated. Bottom extension 4408 may be shaped and configured to accommodate a vial of a particular size. Vial pucks 26 may be provided with a commonly sized set of protrusions 4402 and a commonly sized gear 4405 and bottom extensions 4408 of various sizes so that vials of various sizes can be placed into and manipulated by compounder system 10 in a uniform manner. As examples, vial pucks 26 may be provided that can attach to vials with widths of 13 mm, 20 mm, 28 mm, 32 mm, or sizes having volumes up to, for example, 100 mL.

Flanges 4410 may be provided within a vial recess 4411 in bottom extension 4408 that provide a one-way snap system for engaging vial 18 within bottom extension 4408 that allows for "easy" (e.g., below 10 lbs of force) vial insertion and relatively difficult removal (e.g., with above 30 lbs of force). When a vial is place within lower extension 4408, flanges 1140 may grip the underside of a vial cap 436 to hold the vial puck 26 in place on the vial 18. The vial attachment flanges 4408 are capable of biasing outwards in order to slide over the vial cap 436 and snap into place on the bottom surface of the vial cap 436. Sealing member 3404 may be an integrated dry disconnect membrane formed from, for example polyisoprene or similar materials that provide dry disconnection during use.

Figure 46:
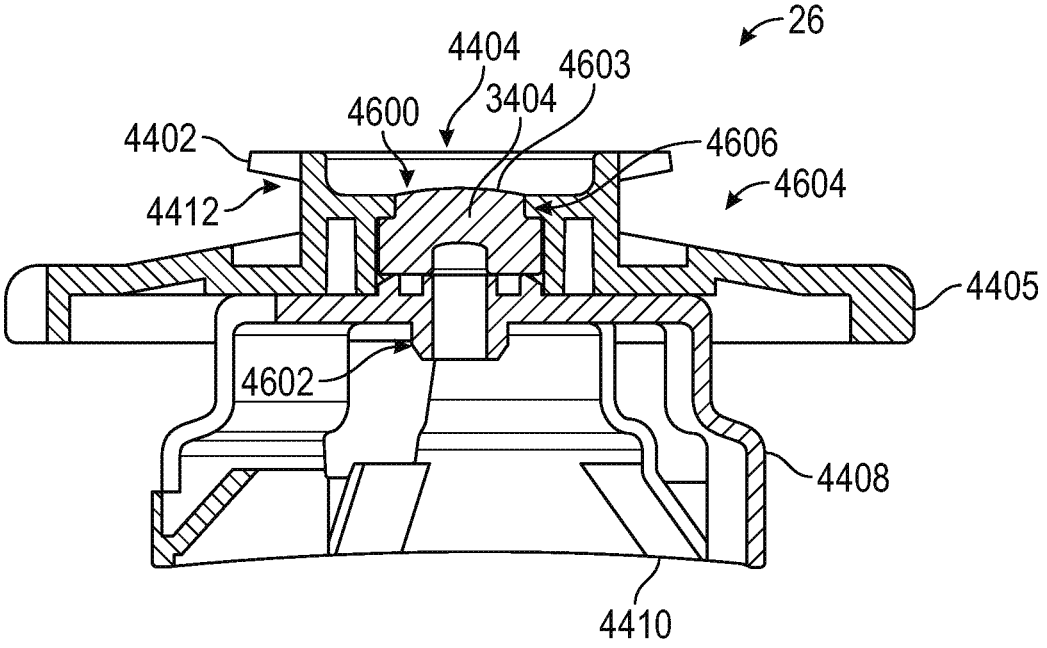
FIG. 46 illustrates a cross-sectional view of a portion of a vial puck in accordance with aspects of the present disclosure.
Figure 47:
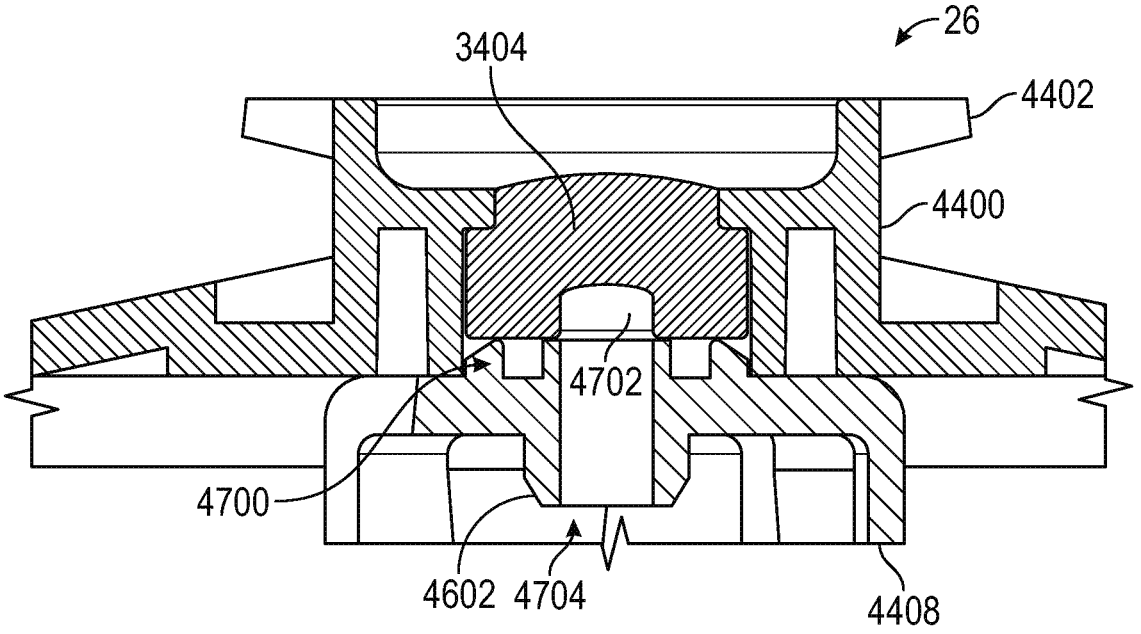
FIG. 47 illustrates a cross-sectional view of a portion of a vial puck showing features of a sealing member of the vial puck in accordance with aspects of the present disclosure.

FIGS. 46 and 47 show cross-sectional views of vial puck 26 without a vial attached for clarity. As shown in FIG. 46, sealing member 3404 may be disposed in a central opening within central portion 4400 of vial puck 26 and may have a convex outer surface 4603. The central opening in which sealing member 3404 is disposed may be smaller than sealing member 3404 so that sealing member 3404 is compressed by a surface 4606 of vial puck 26 when installed in vial puck 26 (e.g., radially compressed by up to or approximately 10% to provide a wiping effect on a needle that is inserted or removed from sealing member 3404). A cylindrical vertical extension 4602 may be provided that, when a vial is attached to vial puck 26, pushes against a vial septum to form a hermetic seal and to potentially allow for beyond use dating. As shown in FIG. 46, a ramped surface 4604 may be provided on gear 4405 that, in combination with an opposing ramped lower surface 4412 of extensions 4402 help guide vial gripper 76 into proper position for gripping vial puck 26.

The top surface 4600 of the vial puck in recess 4404 may have a smooth geometry to facilitate easy swapping by an operator for simple disinfection of the surface. In one embodiment, lower extension 4408 and central portion 4400 may be ultrasonically welded together to sandwich membrane 3404 in place acting as hermetic seal. Gear 4405 and extensions 4402 may be integrally formed with central portion 4400 to form a top portion of vial puck 26. As shown in FIG. 47, lower extension 4408 may include a central bore 4704 through which a needle assembly may extend and may include a cylindrical rib 4700 that presses against sealing member 3404 to act as a redundant seal to ensure leak prevention. Sealing member 3404 may include a recess 4702 in a lower surface that is aligned with the central bore of lower extension 4408.

Figure 48:
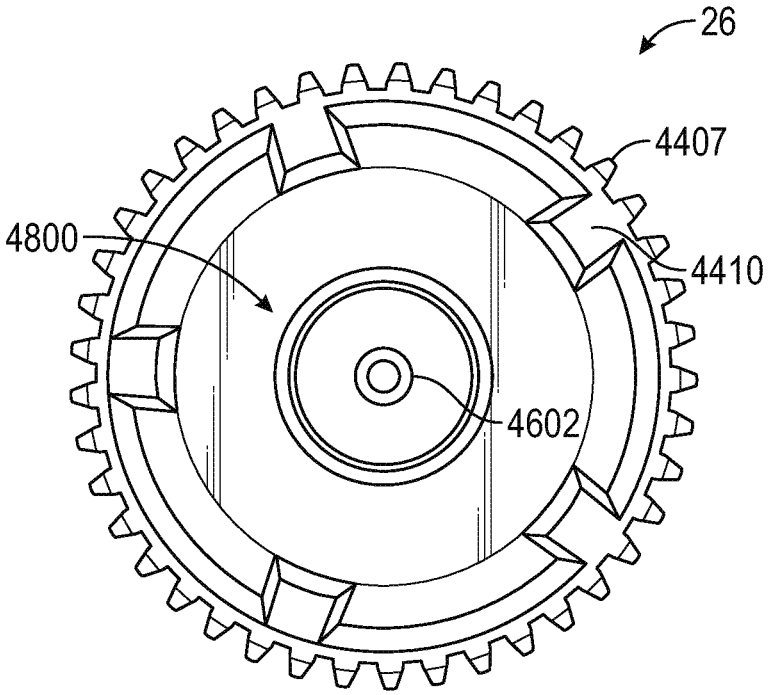
FIG. 48 illustrates bottom view of a vial puck in accordance with aspects of the present disclosure.
Figure 49:
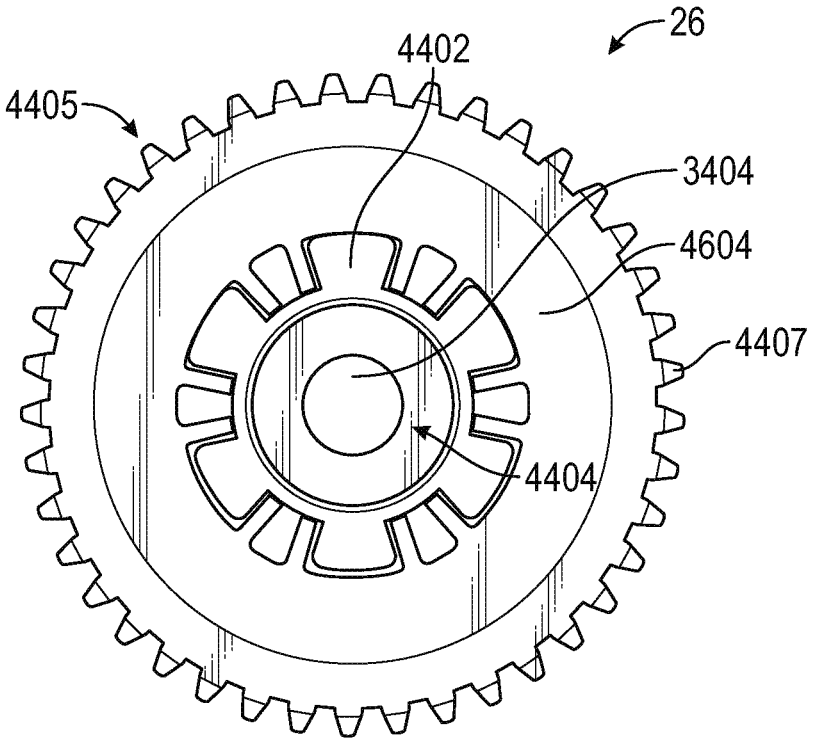
FIG. 49 illustrates top view of a vial puck in accordance with aspects of the present disclosure.

FIG. 48 shows a bottom view of vial puck 26 according to an embodiment. As shown in FIG. 48, in addition to cylindrical protrusion 4602, an additional cylindrical protrusion 4800 may also be provided for larger vials (e.g., 28 mm and 32 mm vials) to provide an additional hermetic seal that provides improved vial stabilization for the larger vials. A top view of vial puck 26 is shown in FIG. 49 in which extensions 4402, gear teeth 4407 of gear 4405, ramped surface 4604, and sealing member 3404 within recess 4404 can be seen.

Figure 50:
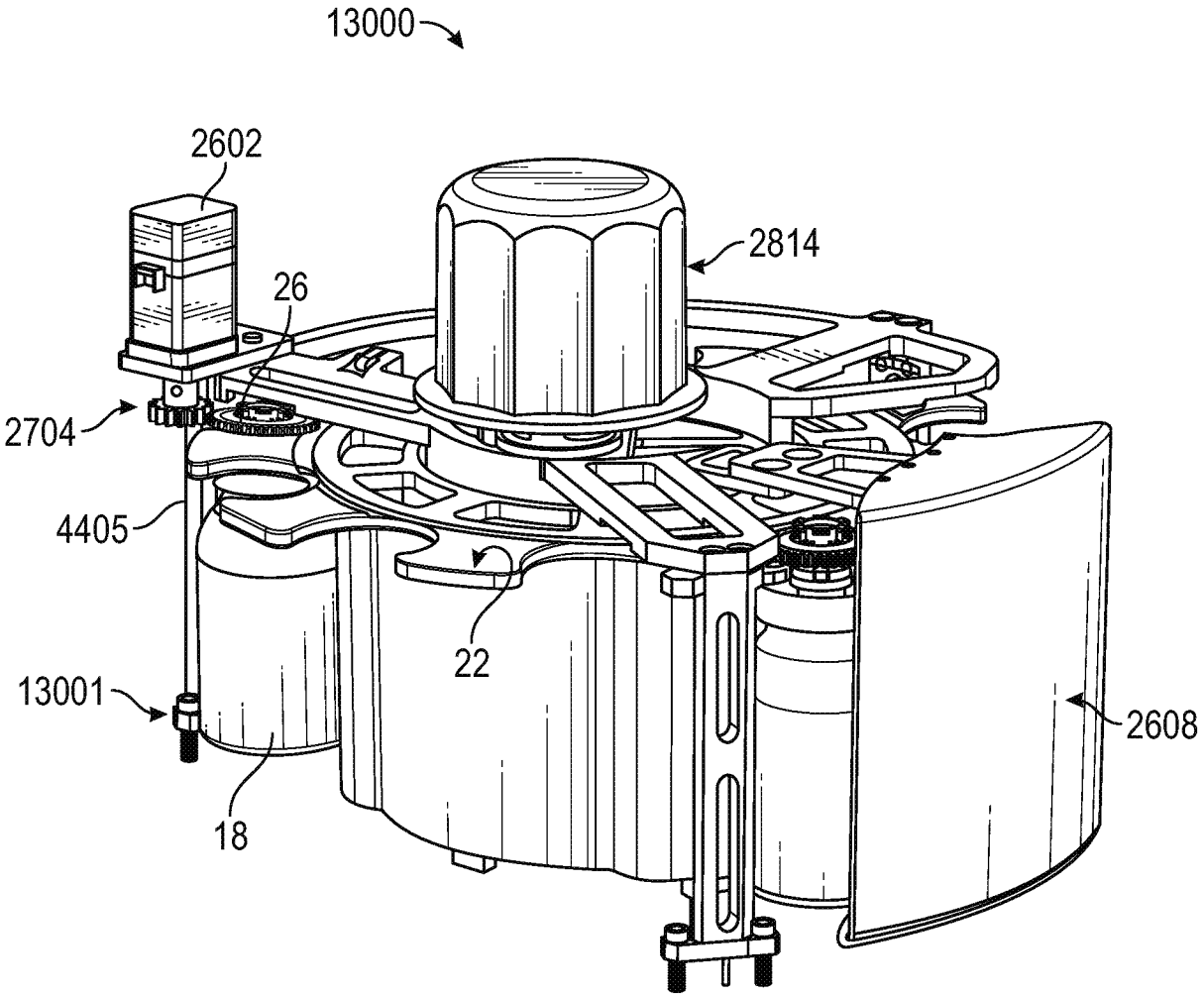
FIG. 50 illustrates a perspective view of a vial and carousel drive assembly for a compounding system in accordance with aspects of the present disclosure.

Turning now to FIG. 50, a perspective view of a vial and carousel drive assembly 13000 is shown, according to an embodiment. In the example, of FIG. 30, vial tray 22 has been rotated so that a vial 18 is in an imaging position 13001 at which the label on the vial may be imaged. In the imaging position 3001, gear 4405 of the vial puck 26 that is attached to the vial 18 is engaged with gear 2704 of motor 2602. In this way, motor 2602 can be operated to rotate vial 18 while vial 18 is in the vial puck recess of vial tray 22 at the imaging position. While motor 2602 rotates vial 18, a camera such as camera 2700 (see, e.g., FIGS. 27 and 28) may capture images of the label on vial 18. A light source such as light source 2702 may be operated to illuminate at least a portion of the label while the images are captured. Light source 2702 may be a line-wise light source configured to illuminate a vertical line on the vial while the vial is rotated so that each captured image includes an image of a vertical line on the vial. The vertical line images may be combined using processing circuitry associated with the camera and/or processing circuitry such as one or more processors for the compounder system to form a rectilinear image of the entire vial label.

Figure 51:
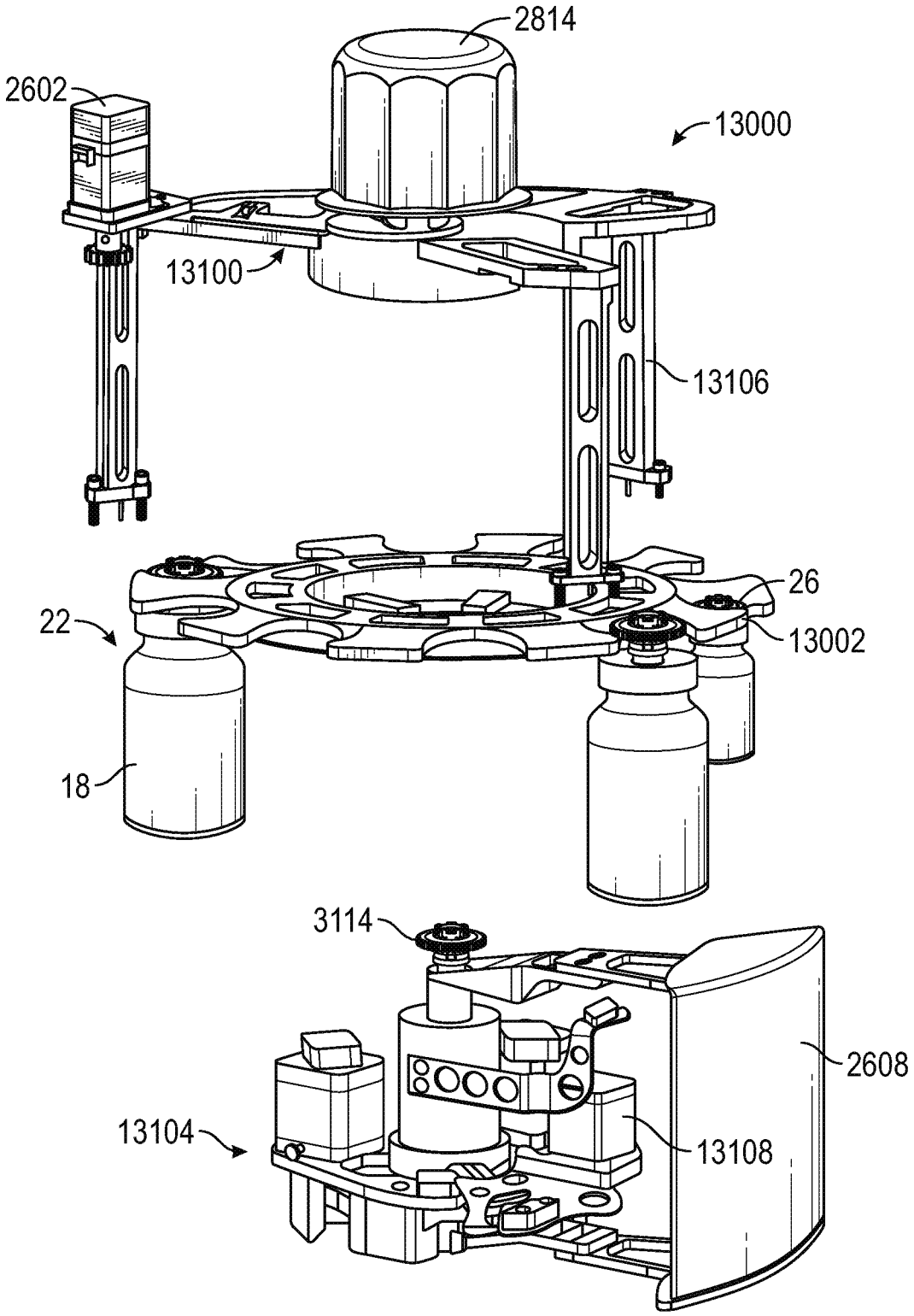
FIG. 51 illustrates an exploded perspective view of the vial and carousel drive assembly of FIG. 50 in accordance with aspects of the present disclosure.

FIG. 51 shows an exploded perspective view of the vial and carousel drive assembly 13000. As shown in FIG. 51, assembly 13000 may include a carousel support frame 13100 on which the carousel hub 3814 and vial spin drive 2602 are mounted and that includes legs 13106. Assembly 13000 may also include a drive mechanism having one or more additional motors such as motor 13108 configured via a plurality of gears and/or belts to actuate door 2608, rotate vial tray 22, and/or rotate carousel hub 2814 to rotate a carousel of cartridges mounted thereon. As shown, vial tray 22 may be disposed at least partially between carousel support frame 13100 and drive mechanism 3104.

As shown in FIGS. 50 and 51, carousel hub 2814 may have a polygonal shape. Carousel 14 may be provided with a central opening having a corresponding polygonal shape so that, when carousel 14 is placed onto carousel hub 2814 and carousel hub 2814 is rotated, the carousel is correspondingly rotated. However, other patters for the central opening and carousel hub 2814, such as a "D" shape, or other suitable shape are contemplated. As shown in FIG. 51, drive mechanism 13104 may have an extension 3114 that extends into carousel hub 2814 to rotate hub 2814 responsive to operation of a motor of drive mechanism 13104.

It should be appreciated that the examples described above in which the sealing member (e.g., sealing member 3404) of vial puck 26 is formed by a single sealing member is merely illustrative. In some embodiments, in order to provide an improved drip-free seal, the seal of each vial puck 26 may be formed by a plurality of sealing members. In one example, three sealing members may be provided to form a seal for vial puck 26.

Figure 52:
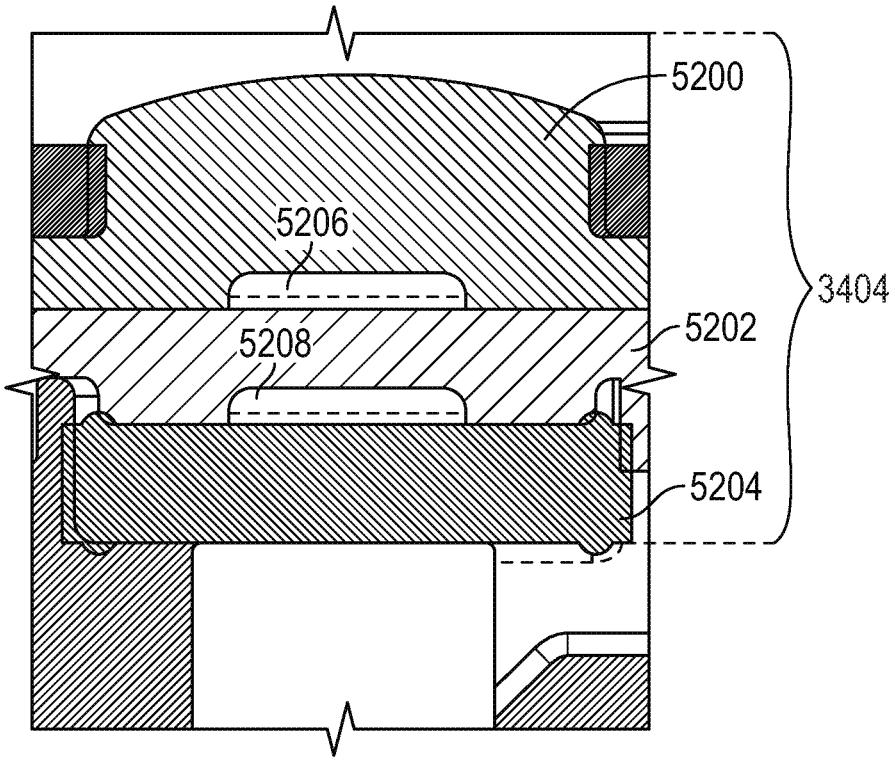
FIG. 52 illustrates a cross-sectional side view of a portion of a vial puck having multiple sealing members in accordance with aspects of the present disclosure.

FIG. 52 shows a cross-sectional view of a portion of vial puck 26 in an implementation with three sealing members. As shown in FIG. 52, sealing member 3404 may be formed from an outer sealing member 5200, an intermediate sealing member 5202, and an inner sealing member 5204. Intermediate sealing member 5202 may be disposed between outer sealing member 5200 and an inner sealing member 5204.

As shown in FIG. 52, outer sealing member 5200 may, similarly to sealing member 3404 in FIG. 47, include a portion that extends through an opening within central portion 4400 of vial puck 26 and may have a convex outer surface. The central opening in which outer sealing member 5200 is disposed may be smaller than sealing member 5200 so that sealing member 5200 is compressed by a surface of vial puck 26 when installed in vial puck 26 (e.g., radially compressed by up to or approximately 10% to provide a wiping effect on a needle that is inserted or removed from sealing member 5200).

Outer sealing member 5200 may include a recess 5206 in a surface adjacent to intermediate sealing member 5202. Intermediate sealing member 5202 may also include a recess 5208 on an interior surface adjacent to inner sealing member 5204. Providing multiple sealing members such as the three sealing members (i.e., member 5200, member 5202, member 5204) may provide an enhanced wiping of needle 170 to provide an improved dry disconnect in comparison with implementations with a single sealing member. However, this is merely illustrative. In various embodiments, one, two, three, or more than three sealing members for each vial puck may be provided. Similarly, interstitial spaces formed from recesses 5206 and 5208 may further increase the efficiency of the wiping of needle 170, however, in various embodiments, sealing members may be provided with or without recesses 5208 and/or 5208.

The subject technology is illustrated, for example, according to various aspects described above. Various examples of these aspects are described as numbered concepts or clauses (1, 2, 3, etc.) for convenience. These concepts or clauses are provided as examples and do not limit the subject technology. It is noted that any of the dependent concepts may be combined in any combination with each other or one or more other independent concepts, to form an independent concept. The following is a non-limiting summary of some concepts presented herein:

Concept 1. A vial puck, comprising: a cylindrical central portion; a plurality of substantially perpendicular extensions that extend from a top of the cylindrical central portion; a substantially circular gear extending from the cylindrical central portion; a bottom extension extending from a bottom of the cylindrical central portion, the bottom extension having a vial recess configured to receive a vial containing a drug; and a sealing member disposed in the cylindrical central portion, wherein the sealing member is configured to provide a drip free seal for a needle assembly that passes through the central cylindrical portion, the circular gear, and the sealing member into the vial.

Concept 2. The vial puck of Concept 1 or any other Concept, further comprising a plurality of flanges on an interior surface of the vial recess that secure the vial in the vial recess.

Concept 3. The vial puck of Concept 2 or any other Concept, further comprising a cylindrical protrusion within the vial recess configured to press against a vial septum of the vial Concept 4. The vial puck of Concept 3 or any other Concept, further comprising an additional cylindrical protrusion within the vial recess configured to stabilize the vial Concept 5. The vial puck of Concept 1 or any other Concept, further comprising a cylindrical protrusion on the bottom extension that presses against the sealing member to form a seal Concept 6. The vial puck of Concept 1 or any other Concept, wherein the cylindrical central portion compresses the sealing member radially Concept 7. The vial puck of Concept 6, wherein the cylindrical central portion compresses the sealing member radially by approximately 10 percent Concept 8. The vial puck of Concept 1 or any other Concept, wherein the sealing member is disposed in a recess in the cylindrical central portion and wherein the recess in the cylindrical central portion is configured to guide the needle assembly to the sealing member Concept 9. The vial puck of Concept 8 or any other Concept, further comprising a first ramped surface on the gear and a second ramped surface on at least one of the perpendicular extensions, the first and second ramped surfaces configured to guide a vial grip of a compounder system to grip the cylindrical central portion and the perpendicular extensions Concept 10. A method, comprising: providing a vial puck on a vial containing a drug; providing the vial puck in a vial puck recess in a vial tray of a compounder system; rotating the vial tray to move the vial and vial puck to a first position; grasping the vial puck with vial calipers of the compounder system; lifting the vial puck and vial out of the vial tray with a vial lift coupled to the vial calipers; and lifting the vial puck and vial to compress a needle housing of the compounder system to expose a needle assembly and to extend the needle assembly through sealing members of the vial puck and the needle housing into the vial Concept 11. The method of Concept 10 or any other Concept, further comprising, before lifting the vial puck and vial out of the vial tray: rotating the vial tray to move the vial and vial puck to a second position; engaging a gear of the vial puck with a gear of the compounder system; and rotating the vial using the engaged gears of the vial puck and the compounder system Concept 12. The method of Concept 11 or any other Concept, further comprising: providing a diluent into the vial via the needle assembly; while grasping the vial puck with the vial calipers, agitating the vial; and extracting a reconstituted drug from the vial via the needle assembly Concept 13. The method of Concept 12 or any other Concept, further comprising, lowering the vial puck and vial, with the vial lift and vial calipers, to withdraw the needle assembly from the vial and from the sealing members Concept 14. The method of Concept 13 or any other Concept, wherein the lowering comprises wiping the needle assembly with the sealing members Concept 15. The method of Concept 14 or any other Concept, further comprising: replacing the vial and vial puck into the vial puck recess in the vial tray with the vial lift and vial calipers; rotating the vial tray; and grasping and lifting an additional vial puck and attached vial from the vial tray with the vial lift and vial calipers Concept 16. The method of Concept 10 or any other Concept, wherein providing the vial puck on the vial containing the drug comprises inserting the vial into a vial recess in a lower extension of the vial puck and securing the vial within the vial recess using a plurality of flanges within the vial recess Concept 17. The method of Concept 16 or any other Concept, wherein providing the vial puck on the vial containing the drug further comprises pressing at least one cylindrical protrusion in the vial recess onto a vial septum of the vial.

Concept 18. A compounder system, comprising: vial calipers coupled to a vial lift; a cartridge comprising a needle assembly and at least one controllable fluid pathway fluidly coupled to the needle assembly; a vial tray having at least one vial puck recess; and a vial puck, comprising: a lower portion configured to receive and secure a vial containing a drug; and an upper portion comprising: a first portion configured to seat in the at least one vial puck recess; a second portion configured to be grasped by the vial calipers; and a sealing member configured to receive the needle assembly therethrough, wherein the vial lift is configured to move the vial that is grasped by the vial calipers toward the cartridge such that the needle assembly is provided through the sealing member to fluidly couple the at least one controllable fluid pathway to the vial via the needle assembly.

Concept 19. The compounder system of Concept 18 or any other Concept, wherein the first portion comprises a gear and wherein the compounder system further comprises an additional gear configured to (a) engage the gear of the first portion and (b) rotate the vial while the vial puck is seated in the at least one vial puck recess.

Concept 20. The compounder system of Concept 18 or any other Concept, further comprising a pump head assembly configured to operate a piston and a valve of the cartridge to pump a fluid through the at least one controllable fluid pathway to or from the vial via the needle assembly.

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

One or more aspects or features of the subject matter described herein may be realized in digital electronic circuitry, integrated circuitry, specially designed ASICs (application specific integrated circuits), computer hardware, firmware, software, and/or combinations thereof. For example, infusion pump systems disclosed herein may include an electronic system with one or more processors embedded therein or coupled thereto. Such an electronic system may include various types of computer readable media and interfaces for various other types of computer readable media. Electronic system may include a bus, processing unit(s), a system memory, a read-only memory (ROM), a permanent storage device, an input device interface, an output device interface, and a network interface, for example.

Bus may collectively represent all system, peripheral, and chipset buses that communicatively connect the numerous internal devices of electronic system of an infusion pump system. For instance, bus may communicatively connect processing unit(s) with ROM, system memory, and permanent storage device. From these various memory units, processing unit(s) may retrieve instructions to execute and data to process in order to execute various processes. The processing unit(s) can be a single processor or a multi-core processor in different implementations.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

The word "exemplary" is used herein to mean "serving as an example or illustration." Any aspect or design described herein as "exemplary" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item; rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, or operations in the processes or methods disclosed are illustrations of exemplary approaches. Based upon implementation preferences or scenarios, it is understood that the specific order or hierarchy of steps, operations or processes may be rearranged. Some of the steps, operations or processes may be performed simultaneously. In some implementation preferences or scenarios, certain operations may or may not be performed. Some or all of the steps, operations, or processes may be performed automatically, without the intervention of a user. The accompanying method claims present elements of the various steps, operations or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way.

What is claimed is:

1. A compounder system, comprising:
vial calipers coupled to a vial lift;
a cartridge comprising a needle assembly and at least one controllable fluid pathway fluidly coupled to the needle assembly;
a vial tray having a plurality of vial puck recesses;
a vial puck, comprising:
a lower portion configured to receive and secure a vial containing a drug; and
an upper portion comprising:
a first portion configured to seat in a first vial puck recess of the plurality of vial puck recesses, the first portion comprising a first gear;
a second portion configured to be grasped by the vial calipers; and
a sealing member configured to receive the needle assembly therethrough; and
a second gear,
wherein the vial lift is configured to move the vial that is grasped by the vial calipers toward the cartridge such that the needle assembly is provided through the sealing member to fluidly couple the at least one controllable fluid pathway to the vial via the needle assembly, and
wherein the second gear is configured to (a) engage the first gear of the first portion and (b) rotate the vial while the vial puck is seated in the first vial puck recess.

2. The compounder system of claim 1, further comprising a cylindrical portion that presses against the sealing member to form a seal.

3. The compounder system of claim 2, wherein the cylindrical portion compresses the sealing member radially.

4. The compounder system of claim 3, wherein the cylindrical portion compresses the sealing member radially by approximately 10 percent.

5. The compounder system of claim 2, wherein the sealing member is disposed in a recess in the cylindrical portion and wherein the recess in the cylindrical portion is configured to guide the needle assembly to the sealing member.

6. The compounder system of claim 5, further comprising a first ramped surface on the first gear and a second ramped surface, the first and second ramped surfaces configured to guide a vial grip of a compounder system to grip the cylindrical portion.

7. The compounder system of claim 1, wherein the sealing member comprises a convex outer surface.

8. The compounder system of claim 1, further comprising a pump head assembly configured to operate a piston and a valve of the cartridge to pump a fluid through the at least one controllable fluid pathway to or from the vial via the needle assembly.

9. The compounder system of claim 1, further comprising a plurality of flanges on an interior surface of the first vial puck recess that secure the vial in the first vial puck recess.

10. The compounder system of claim 9, further comprising a cylindrical protrusion within the first vial puck recess configured to press against a vial septum of the vial.

11. The compounder system of claim 10, further comprising an additional cylindrical protrusion within the first vial puck recess configured to stabilize the vial.

12. A method of operating the compounder system of claim 1, the method comprising:
coupling the vial puck the vial containing the drug;
placing the vial puck in the first vial puck recess;
rotating the vial tray to move the vial and vial puck to a first position;
grasping the vial puck with the vial calipers;
lifting the vial puck and vial out of the vial tray with the vial lift; and
lifting the vial puck and vial to compress a needle housing of the compounder system to expose the needle assembly and to extend the needle assembly through the sealing member of the vial puck and the needle housing into the vial.

13. The method of claim 12, further comprising, before lifting the vial puck and vial out of the vial tray:
rotating the vial tray to move the vial and vial puck to a second position;
engaging the first gear with the second gear; and
rotating the vial using the first and second engaged gears.

14. The method of claim 13, further comprising:
providing a diluent into the vial via the needle assembly;
while grasping the vial puck with the vial calipers, agitating the vial; and
extracting a reconstituted drug from the vial via the needle assembly.

15. The method of claim 14, further comprising, lowering the vial puck and vial, with the vial lift and vial calipers, to withdraw the needle assembly from the vial and from the sealing members.

16. The method of claim 15, wherein the lowering comprises wiping the needle assembly with the sealing member.

17. The method of claim 16, further comprising:
replacing the vial and vial puck into the first vial puck recess in the vial tray with the vial lift and vial calipers;
rotating the vial tray; and
grasping and lifting an additional vial puck and attached vial from a second vial puck recess of the plurality of vial puck recesses in the vial tray with the vial lift and vial calipers.

18. The method of claim 12, wherein providing the vial puck on the vial containing the drug comprises inserting the vial into the first vial puck recess in a lower extension of the vial puck and securing the vial within the first vial puck recess using a plurality of flanges within the first vial puck recess.

19. The method of claim 18, wherein providing the vial puck on the vial containing the drug further comprises pressing at least one cylindrical protrusion in the first vial puck recess onto a vial septum of the vial.

* * * * *